United States Patent [19]

Tomisawa et al.

[11] Patent Number: 4,558,624

[45] Date of Patent: Dec. 17, 1985

[54] EFFECT IMPARTING DEVICE IN AN ELECTRONIC MUSICAL INSTRUMENT

[75] Inventors: Norio Tomisawa, Hamamatsu; Hideo Suzuki, Takatsuka, both of Japan

[73] Assignee: Nippon Gakki Seizo Kabushiki Kaisha, Hamamatsu, Japan

[21] Appl. No.: 693,211

[22] Filed: Jan. 17, 1985

Related U.S. Application Data

[63] Continuation of Ser. No. 433,020, Oct. 6, 1982, abandoned.

[30] Foreign Application Priority Data

Oct. 15, 1981 [JP] Japan ..... 56-163393

[51] Int. Cl.[4] ..... G10H 1/02

[52] U.S. Cl. ..... 84/1.26; 84/1.13; 84/1.24

[58] Field of Search ..... 84/1.01, 1.13, 1.26, 84/1.03, 1.24, 1.27; 307/152

[56] References Cited

U.S. PATENT DOCUMENTS

| | | | |
|---|---|---|---|
| 4,185,531 | 1/1980 | Oberheim et al. | 84/1.19 |
| 4,189,972 | 2/1980 | Yamada et al. | 84/1.25 |
| 4,301,704 | 11/1981 | Nagai et al. | 84/1.19 |
| 4,344,347 | 8/1982 | Faulkner | 84/1.26 |
| 4,351,220 | 9/1982 | Yamada et al. | 84/1.25 |
| 4,442,751 | 4/1984 | Ezawa | 84/1.25 |

*Primary Examiner*—Forester W. Isen

*Attorney, Agent, or Firm*—Spensley Horn Jubas & Lubitz

[57] ABSTRACT

Analog output signals of a key touch sensor and tonal effect setting manual operators are respectively time division multiplexed and thereafter are converted to digital signals by using an analog to digital converter on a time shared basis. The key touch sensor capable of detecting a key touch of a depressed key can also be used for obtaining an initial touch detection signal by additionally providing a device for holding a peak value of an output signal of the sensor at the beginning of depression of the key. Control factors of various tonal effects are controlled in response to these converted digital signals. Control factors of an attack pitch control effect are controlled in response to the key touch. In imparting a delay vibrato effect, the attack pitch control is automatically applied before the delay vibrato is initiated. In imparting a vibrato effect, the attack pitch control is automatically applied and the vibrato is applied thereafter if a key has been depressed in a staccato form. Selection as to whether a slur effect should be imparted or not is automatically made depending upon whether the key has been depressed in a legato form or not. A modulating signal for the vibrato is obtained by repeatedly calculating a numerical value setting the frequency of the modulating signal by a first calculator and repeatedly calculating a small value setting the amplitude of the modulating signal by a second calculator in response to a carryout signal of the first calculator.

36 Claims, 38 Drawing Figures

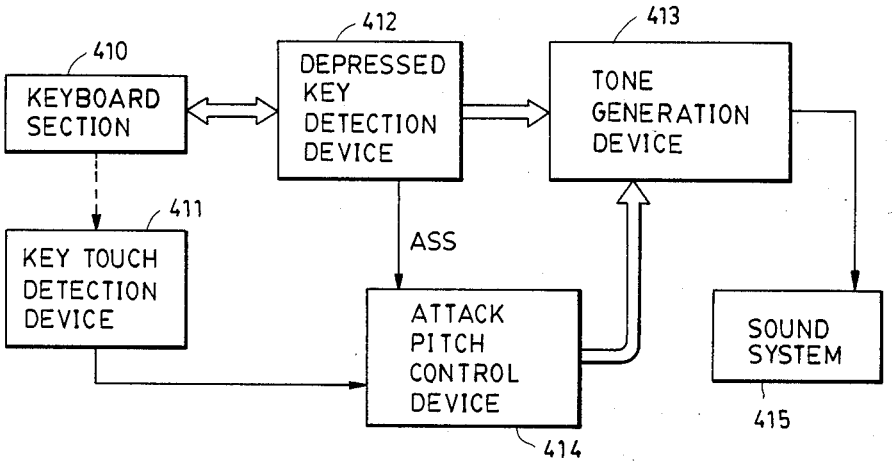
FIG. 1
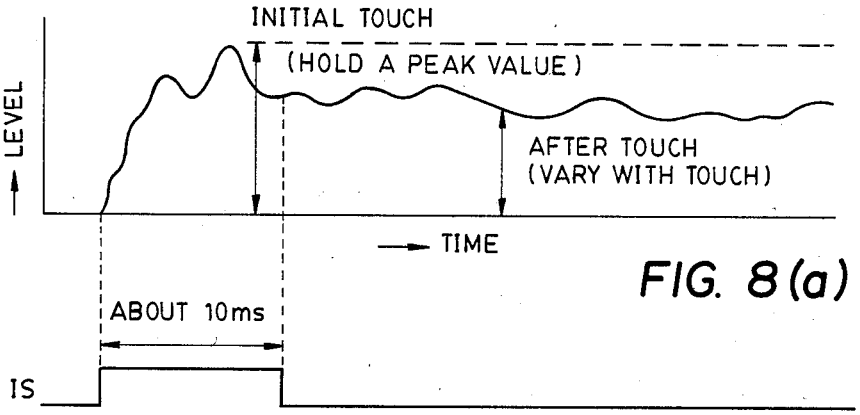
FIG. 8(a)
FIG. 8(b)

EFFECT IMPARTING DEVICE IN AN ELECTRONIC MUSICAL INSTRUMENT

RELATED APPLICATION

The present application is a continuation of application Ser. No. 06/433,020 filed Oct. 6, 1982, now abandoned.

BACKGROUND OF THE INVENTION

This invention relates to an electronic musical instrument equipped with a device capable of imparting various tonal effects including an attack pitch control, touch response, vibrato and slur, etc.

The attack pitch control is a control for changing the tone pitch repeatedly or gradually during a short period of time at the beginning of sounding of the tone. The technique of the attack pitch control is employed in the electronic musical instrument for simulating turbulence in the pitch at the beginning of sounding of a tone such, for example, as turbulence in the pitch at the beginning of playing a wind instrument. In the attack pitch control in the prior art electronic musical instrument, control factors such as the initial depth of pitch deviation remain unchanged once they have been set by selection switches, unless the setting is subsequently changed. The prior art electronic musical instrument, therefore, can provide only an attack pitch control which is poor in expression. An example of the prior art attack pitch control is disclosed in the specification of U.S. Pat. No. 4,189,972. The disclosed control, however, is a simple and monotonous one according to which the attack pitch control always starts from a pitch which is below a nominal pitch by a predetermined cent value and thereafter gradually approaches the nominal pitch.

The above-mentioned U.S. Pat. No. 4,189,972 discloses also a vibrato device and a delay vibrato device. In the disclosed devices, however, the attack pitch control device in no way is associated with the vibrato device or the delay vibrato device but the respective tonal effects are individually selected to be imparted to the tone by individual selection switches. For imparting a richer expression to vibrato or delay vibrato, it is desired that the attack pitch control should be automatically added in association with vibrato or delay vibrato. No such effect imparting device has heretofore been known.

The above-mentioned U.S. Pat. No. 4,189,972 further discloses the art of generating, in digital, a modulating signal for vibrato or delay vibrato and processing this signal. More specifically, there is disclosed an art of oscillating a clock of a variable frequency by a voltage-controlled type oscillator (hereinafter referred to as "VCO"), counting up or down contents of a counter one by one and forming a digital modulating signal. In the disclosed art, the vibrato frequency is controlled by variably adjusting the oscillation frequency of the VCO. The vibrato depth is controlled by suitably shifting an output signal of the counter by a shift circuit. This disclosed device has the disadvantage that the provision of the VCO for variably adjusting the vibrato frequency necessitates a relatively large-scale circuit construction. Besides, the requirement in this device for conducting the depth control by numerical shifting results in a complicated circuit construction of the shift circuit. Since the number obtained by shifting of a binary number is limited to a number which is $2^n$ of the original number, a shift circuit of a simple construction can perform only a simple depth control and a complicated shift circuit having a function to add or subtract various shifted numerical values must be employed for obtaining a complicated depth control. Alternatively, it is conceivable to use a multiplier instead of a shift circuit for effecting the depth control. This, however, will further complicate the circuit construction.

There are two types of tone control by touch response which is well known in the art. One is an initial touch control according to which a key touch at the beginning of key depression (i.e., initial touch) is detected in accordance with a key depressing force, speed of the key depression or other factors and the tone pitch, tone level and tone color are controlled in accordance with this initial touch. Another is an after touch control according to which a key touch (i.e. after touch) is detected in accordance with a key depressing force or depth of the key depression in sustained state of key depression and the tone pitch, tone level and tone color are controlled in accordance with this after touch. For simulating performances by an electronic musical instrument to performances by a natural musical instrument, it is desirable to perform both of the above described touch response controls. For realizing this, the prior art electronic musical instrument required touch sensors for both of the controls resulting in requirement of a keyboard of an extremely complicated construction accompanied by a high manufacturing cost.

There is also known an electronic musical instrument capable of imparting a portamento effect. The portamento effect in the prior art electronic musical instrument, however, is imparted only when this effect has been selected by a manual selection switch. Accordingly, the portamento effect is imparted whenever a key is depressed and this often gives rather a monotonous impression to the audience. Alternatively, there is a device in which the portamento effect is selectively imparted by operating a foot switch. This device is cumbersome because the foot switch must be operated each time the portamento effect is to be imparted.

For imparting, in an electronic musical instrument of a digital processing type, various tonal effects such as the attack pitch control, vibrato, delay vibrato, portamento and touch response, control amounts of various control elements such as tone level, the speed of modulation and the depth of modulation must be given in a digital amount. For this purpose, a digital setter for directly setting digital data corresponding to one of the control elements is provided inidividually for each of the control elements. For obtaining sufficient range and resolution of the control amounts in such digital setter, a great number of contacts are required. The prior art electronic musical instrument in which a number of such digital setters must be provided for the respective control elements requires an increased cost of manufacture, an increased number of wiring and a broader space for mounting such digital setters. It is conceivable for overcoming the above problem to use an analog voltage setting potentiometer as the data setter and obtaining digital data by digitally converting the output voltage of this potentiometer. Provision of an analog to digital converter for each potentiometer, however, inevitably necessitates a higher cost of manufacture and a broader circuit space. It is therefore desired to realize a digital data setting device capable of overcoming the above described problem.

SUMMARY OF THE INVENTION

It is an object of the invention to provide an effect imparting device in an electronic musical instrument which has overcome the above described problems. More specifically, it is an object of the invention to perform the tonal effect imparting control automatically in association with the key operation on the keyboard for performance of music to realize tonal effects which are rich in expression in accordance with the key operation. It is another object of the invention to simplify, reduce in size or economize the construction of a device or circuit used for imparting the various tonal effect thereby to realize desired tonal effects advantageously with a construction of a relatively small scale.

More specifically, it is another object of the invention to provide an electronic musical instrument capable of realizing an attack pitch control which is rich in expression by performing the attack pitch control in accordance with a key touch in manual playing of keys. For achieving this object, the electronic musical instrument according to the invention includes key touch detection means which detects the key touch in accordance with the key depressing force, the speed of key depression, depth of depression or other factors and utilizes the output of this key touch detection means in attack pitch control means for modulation controlling the pitch of a tone signal at the beginning of sounding of the tone so that one or more of modulating factors in the pitch modulation will be controlled in accordance with the output of the key touch detection means. As the modulating factors, there are such factors as depth in the pitch deviation, an envelope for timewisely changing the depth in the pitch deviation, repetition period of a modulating signal and duration of time for applying the attack pitch modulation. In a preferred embodiment, a maximum amount of the pitch deviation in the attack pitch is set in response to the key touch. In a typical attack pitch control, a periodic pitch modulation is made in accordance with an envelope which is at maximum in an initial pitch deviation and decays gradually thereafter. In this case, an amount of the initial pitch deviation is set in response to the key touch. According to such attack pitch control responsive to the key touch, in a case where, for example, turbulence in the pitch at the beginning of playing a wind instrument is to be simulated by the attack pitch control, a subtle variation in the pitch deviation caused by change in the strength of breath at the beginning of playing can be expressed by controlling the key touch.

It is another object of the invention to provide an electronic musical instrument capable of automatically applying the attack pitch control in association with the key operation in the vibrato performance for adding richer expression to the vibrato effect. For this purpose, staccato detection means for detecting whether or not the depressed key has been changed in a staccato form, i.e., whether or not a new key has been depressed after an old key has been released, is provided in association with depressed key detection means. At the beginning of sounding of the tone corresponding to the key depressed in the staccato form, vibrato is not applied but instead the attack pitch control is performed, and vibrato is applied only after completion of the attack pitch control. As to tones corresponding to keys which have not been depressed in the staccato form, vibrato is applied from the beginning. Thus, the attack pitch control is automatically mixed in the vibrato performance in accordance with the manner of key depression so that an excellent tonal effect can be expected. In a preferred embodiment, a term "legato form" is used to designate a manner of key depression which is contrary to the staccato form and, in performing a detection operation of a newly depressed key in the depressed key detection means, "any new key-on" is distinguished from "legato new key-on". The detection of "any new key-on" corresponds to detection of the staccato form and the detection of "legato new key-on" corresponds to detection of the legato form.

It is still another object of the invention to provide an electronic musical instrument capable of automatically applying the attack pitch control in association with a delay vibrato effect. This object is achieved by associating delay vibrato start control means with attack pitch control means and, if the delay vibrato effect has been selected, applying the attack pitch control automatically before the delay vibrato starts, i.e., applying the attack pitch control at the beginning of sounding of the tone and applying the delay vibrato thereafter.

It is still another object of the invention to provide an electronic musical instrument capable of imparting a slur effect, i.e., a portamento effect, in association with the key operation for the musical performance whereby monotonousness which tends to be caused by uniformly applying the slur effect or portamento effect can be prevented and, moreover, necessity for conducting frequent switch manipulating operation can be obviated and selection of the slur effect can be faciliated. For this purpose, legato detection means for detecting whether or not the key has been depressed in the legato form, i.e., whether or not a new key has been depressed while depression of the old key is continuing, is provided in association with the depressed key detection means. A slur control device is controlled by the legato detection means so that the slur effect is imparted to the tone if the key has been depressed in the legato form whereas no slur effect is imparted if the key has not been depressed in the legato form. Accordingly, the slur effect is automatically imparted or not imparted depending upon whether or not the manner of key depression is the legato form or the staccato form. This is a very convenient arrangement.

It is still another object of the invention to provide an electronic musical instrument incorporating a digital type modulating signal generation device and being capable of freely setting the frequency, depth and other factors of a modulating signal with a simple construction. This modulating signal generation device comprises a first calculation circuit which repeatedly adds or subtracts numerical data for setting the frequency of the modulating signal and outputs a calculation timing control signal each time contents of calculation has reached a predetermined value, a second calculation circuit which adds or subtracts a predetermined amount of deviation each time this calculation timing signal is applied, and a calculation control circuit which controls the addition or subtraction of the second calculation circuit in accordance with a target value for setting the depth of the modulating signal so that the contents of calculation in the second calculation circuit repeats increase and decrease within the range of this target value, the contents of calculation of the second calculation circuit being outputted as the modulating signal.

It is still another object of the invention to provide an electronic musical instrument incorporating a touch response device in which the circuit construction about the keyboard has been simplified with resulting reduction in the cost of manufacture by performing detections of the initial touch and after touch by a common key touch sensor. This object is achieved by constructing the touch response device in such a manner that the initial touch can be detected by utilizing a touch sensor which can detect the key touch even during depression of the key in accordance with the key depressing force, the speed of key depression or the depth of key depression relating to the key depressed in the keyboard, i.e., an after touch sensor. Waiting time of a predetermined time duration is set from the start of key depression and a signal corresponding to the initial touch is detected in response to a touch detection signal outputted from the after touch sensor during this waiting time. For example, a peak value of the touch detection signal outputted from the after touch sensor during this waiting time is detected as the signal corresponding to the initial touch. The initial touch control is performed by controlling one or more of the tone pitch, tone color and tone level of the tone in response to the signal representing the initial touch thus detected. It is possible to perform the after touch control in response to the output of the after touch sensor in parallel with the initial touch control. In order to perform the initial touch control in such a manner that it will not cause inconvenience to sounding of the tone after detection of the initial touch, an arrangement is made to delay starting of sounding of the tone by the above described waiting time.

It is still another object of the invention to provide an electronic musical instrument incorporating a digital data setting device of an economized manufacturing cost, number of wirings, mounting space and circuit space. This object is achieved by a digital data setting device which has a plurality of analog signal setting means for setting an amount of control with respect to various tonal effects and in which outputs of these analog signal setting means are converted to digital data on a time shared basis by a single analog to digital converter.

It is still another object of the invention to prevent adverse effects which may be caused by an abrupt and sharp change in a set value in the above described digital data setting device. Inconveniences will sometimes arise in the tone control if, as a result of abruptly manipulating a manual operator of the analog signal setting means, the analog to digital converter immediately follows the abrupt change in the input analog signal to bring about an abrupt change in the output digital data. If the control factor is the tone level, for example, an undesirable abrupt change in the tone level or clicking will be brought about. If the control factor is an effect control factor such as vibrato speed or tremolo speed, an abrupt change in the tonal effect will be brought about and this gives an unnatural impression. Particularly in the electronic musical instrument in which an effect setting manual operator is sometimes operated during the musical performance, an erroneous operation of excessively moving the manual operator tends to occur against the intention of the player resulting in the above described problem. Particularly in digitally converting an output signal of a key touch sensor, even a small noise causes serious adverse effects, for the sensor output which is originally a small signal is amplified before it is converted to a digital signal. According to the present invention, in the digital data setting device which includes a plurality of analog signal setting means and converts the output signals thereof to digital signals on a time shared basis by a single analog to digital converter, the converting function of the analog to digital converter is controlled in such a manner that difference between digital data which is to be obtained this time and digital data which was obtained last time comes within a predetermined range of value so that an amount of change of the digital data which is to be obtained this time relative to the precedingly obtained digital data will be restricted and an abrupt change in the amount of the tone control will be prevented.

BRIEF DESCRIPTION OF THE DRAWINGS

FIG. 1 is a block diagram showing the basic construction of an electronic musical instrument to effect the attack pitch control in response to the key touch according to the invention;

FIGS. 8 (*a*), (*b*) is a waveform diagram to show that both the initial touch and after touch are detected based on the output of the after touch sensor shown in FIG. 6;

FIG. 15 (*b*) is a time chart showing various control signals shown in FIGS. 13 and 14 in corresponding relation with the diagram illustrated in FIG. 15 (*a*);

FIG. 20 (*b*) is a diagram showing the change of the envelope data of modulating signals in the delay vibrato control, said data corresponding to three different target values, respectively;

FIG. 20 (*c*) is a diagram showing the change of modulating signals in the vibrato control, said signals corresponding to two different depths (envelope instantaneous values), respectively;

DESCRIPTION OF PREFERRED EMBODIMENTS

Figure 2:
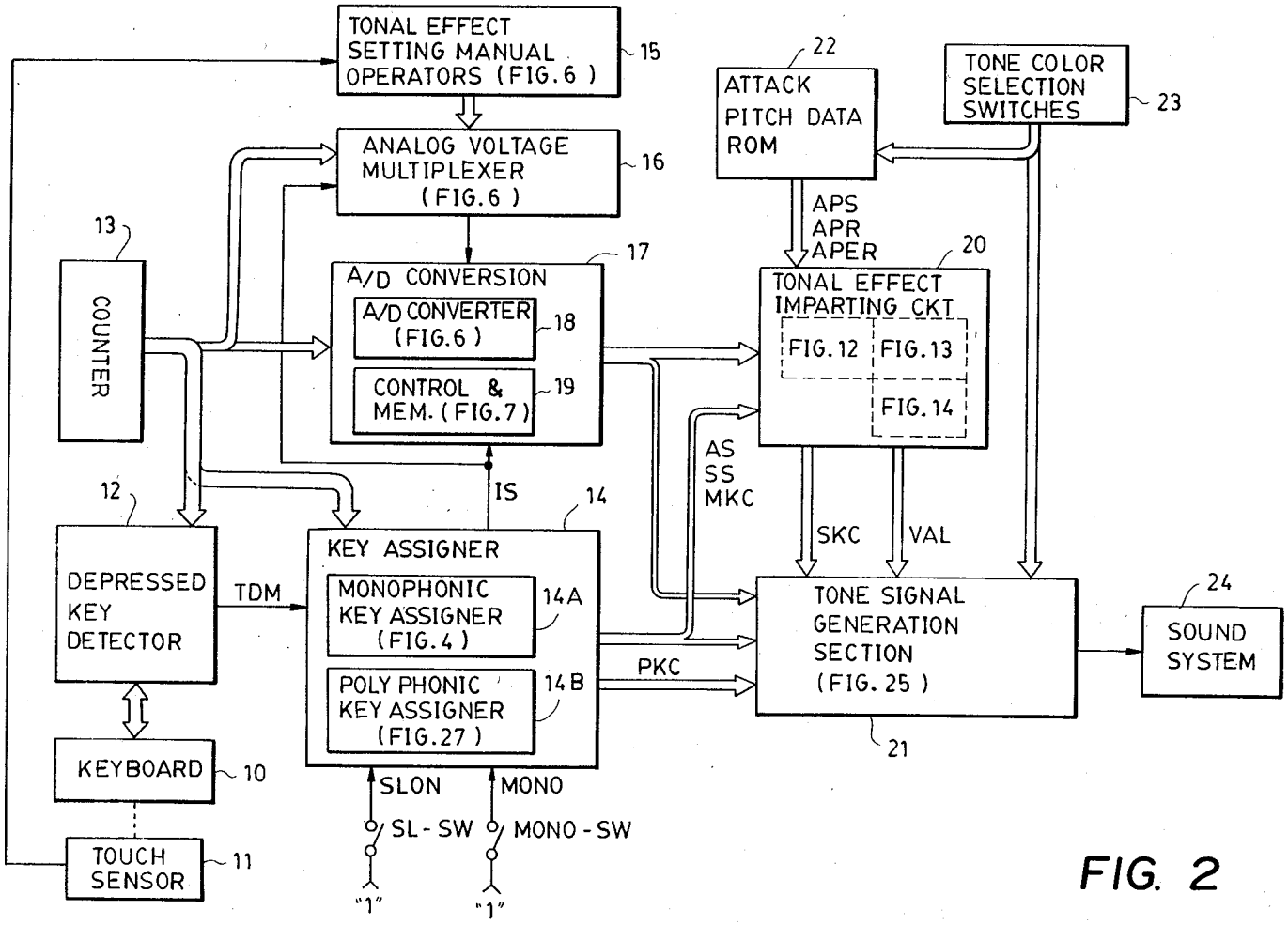
FIG. 2 is a block diagram showing in detail the entire construction of an embodiment of the electronic musical instrument according to the invention.

The embodiment shown in FIG. 1 shows the basic construction of the electronic musical instrument according to the invention. A keyboard 410 includes a plurality of keys. A key depressed in the keyboard 410 is detected by a depressed key detection device 412. A tone generation device 413 generates a tone signal corresponding to the depressed key in response to the output of the depressed key detection device 412. A key touch detection device 411 detects a key touch in accordance with a depressing force, a depressing speed or depth of depression or any other factor that is available for detection of the key touch concerning the key being depressed in the keyboard. An attack pitch control device 414 modulates the pitch of the tone signal generated in the tone generation device 413 at the beginning of sounding of the tone, i.e., within a predetermined period of time from the start of sounding of the tone and also controls one or more factors for modulating the pitch in accordance with the output of the touch detection device 411. When a new key has been depressed, the depressed key detection device 412 generates an attack pitch start signal ASS corresponding to the tone sounding start timing of the newly depressed key and supplies this signal to the attack pitch control device 414. The attack pitch control device 414 includes modulating signal generation means and starts generation of a modulating signal in response to the attack pitch start signal ASS. A typical modulating signal for the attack pitch control is a cyclic signal which is controlled in depth by an envelope having depth (i.e., pitch difference) which is largest initially and attenuates gradually thereafter. It should be noted, however, that the envelope shape of the modulating signal is not limited to such typical example. The key touch detection device 411 outputs an initial touch detection signal representing the key touch in an initial stage of key depression and supplies this signal to the attack pitch control device 414. The attack pitch control device 414 sets a maximum value (typically an initial value) of the envelope of the modulating signal in response to the initial touch detection signal. The pitch of the tone signal generated by the tone generation device 413 is modulated by this modulating signal. A tone signal imparted with the attack pitch control corresponding to the key touch is thereby generated and this tone signal is sounded through a sound system 415.

DESCRIPTION OF ENTIRE CONSTRUCTION OF A MORE SPECIFIC EMBODIMENT

Referring nextly to FIG. 2 and subsequent figures, a more specific embodiment of the electronic musical instrument according to the invention will now be described.

Figure 3:
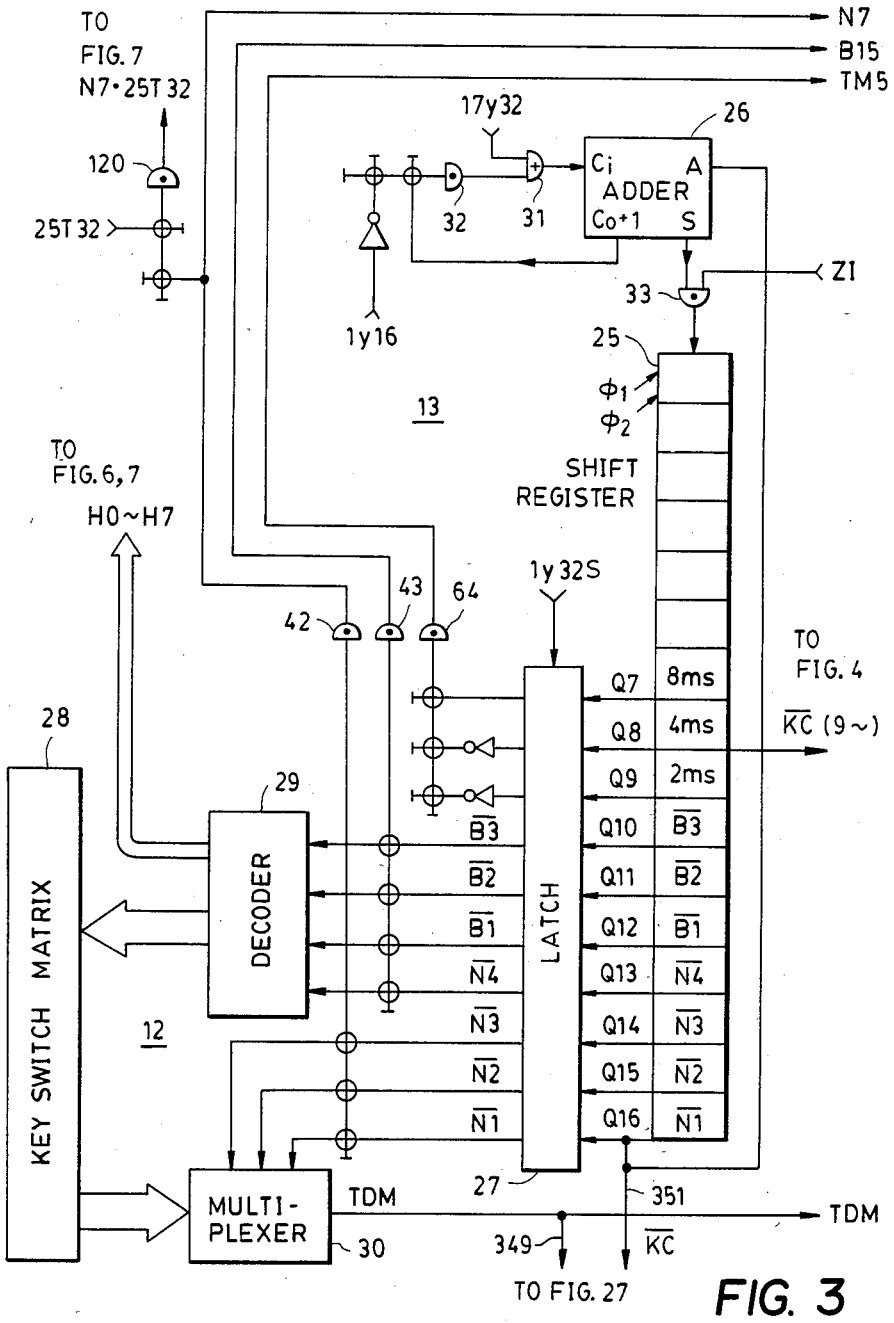
FIG. 3 is a circuit diagram showing in detail examples of the depressed key detector and a counter illustrated in FIG. 2.

FIG. 2 is a block diagram of an entire construction of the electronic musical instrument generally showing relations between respective component parts which are illustrated separately in FIG. 3 and subsequent figures. A keyboard 10 includes a plurality of keys for selecting tone pitch (i.e., note name) of a tone. A touch sensor 11 detects key touch of a depressed key and produces an output signal corresponding to the key touch. A depressed key detector 12 detects a key depressed in the keyboard 10 and output data TDM representing the depressed key. In this depressed key detector 12, key switches corresponding respective keys are scanned. For this scanning, an output of a counter 13 is used. A key assigner 14 is provided for assigning generation of tones corresponding to depressed keys to any of limited number of tone generation channels. The present embodiment includes a monophonic key assigner 14A and a polyphonic key assigner 14B so that the electronic musical instrument can be selectively operated in either a monophonic mode or a polyphonic mode. For this purpose, a monophonic mode selection switch MONO-SW is provided in connection with the key assigner 14. When this switch MONO-SW is ON, a signal "1" is supplied to the key assigner 14 and other necessary circuits as a monophonic mode selection signal MONO so as to cause the electronic musical instrument to operate in the monophonic mode. A slur effect selection switch SL-SW selects a slur effect. When this switch is ON, a signal "1" is supplied to the key assigner 14 as a slur-on signal SLON thereby realizing the slur effect. The slur effect herein means a smooth change in the pitch of the generated tone from that of a previously depressed key to that of a newly depressed key in a case where the depressed key has been changed in a legato form (i.e., a new key is depressed before completely releasing an old key) when the electronic musical instrument is operating in the monophonic mode.

Tonal effects setting manual operators 15 includes variable manual operators for setting control amounts of control factors such as time, speed and level for various tonal effects including vibrato, an initial touch control and an after touch control etc. Among the manual operators 15, the manual operators for the control element for the touch control are adapted to adjust sensitivity of the output signal of the touch control sensor 11. By way of example of the various tonal effects, effects relating to a pitch control includes "vibrato", "delay vibrato", "attack pitch control", "after touch vibrato" and the above mentioned "slur". Effects relating to a level control includes "initial touch level control", "after touch level control" and "sustain time control for an envelope". The "delay vibrato" is an effect according to which vibrato is gradually imparted after lapse of a certain period of time from the start of sounding of a tone. The "attack pitch control" is an effect according to which vibrato is imparted during rising of the tone. The attack pitch control is controlled in response to the key touch (preferably an initial key touch). The "after touch vibrato" is an effect for controlling vibrato in response to the key touch, particularly the key touch in a state where the key is continuously being depressed. The "initial touch level control" is a tone level control in response to the key touch at the time when the key has been depressed i.e., the key touch in an initial state of key depression (hereinafter referred to as "initial touch"). The "after touch level control" is a tone level control in response to the key touch in a state where the key is continuously being depressed (hereinafter referred to as "after touch"). The controls in response to the initial touch and the after touch can be made not only for tone pitch and tone level but also for tone color and other tone elements.

In the present embodiment, setting data corresponding to the respective manual operators outputted by the operators 15 are represented by analog voltages and these analog voltages are time division multiplexed by an analog voltage multiplexer 16. An analog to digital conversion section 17 includes an analog to digital converter 18 and a control and memory circuit 19. The analog to digital conversion section 17 converts the multiplexed analog voltages to digital data and stores and demultiplexes the digitized setting data for the respective manual operators. The output of the counter 13 is utilized for the time division multiplexing in the multiplexer 16 and the control in the conversion section 17.

In this embodiment, detections of the initial touch and the after touch are made by a common touch sensor. More specifically, a sensor capable of detecting the after touch is used as the touch sensor 11 and the output of the touch sensor 11 is selected for detection of the initial touch during a certain period of time from the start of key depression so that the initial touch can be detected in accordance with the selected output signal of the touch sensor 11. For instance, a peak value of the selected touch sensor output signal is held for a certain period of time from the start of key depression and this peak value is used as the initial touch detection signal. For this purpose, the key assigner 14 outputs an initial sensing signal IS during a predetermined period of time from the start of key depression, e.g. 10 ms which is almost negligible for the human hearing, and the multiplexer 16 and the analog to digital conversion section 17 are controlled by this signal IS so that the initial touch detection is conducted during this period of time. Simultaneously, start of sounding of the tone is delayed in the key assigner 14 while the initial sensing signal IS is being outputted. This is for prohibiting start of sounding of the tone before the detection of the initial touch and implementing the initial touch control simultaneously with the start of sounding of the tone. As was described previously, the attack pitch control is conducted in accordance with the initial touch in the present embodiment.

A tonal effect imparting circuit 20 is a circuit provided for imparting various effects relating to the pitch control. The tonal effect imparting circuit 20 outputs a modulating signal VAL for modulating a tone frequency with respect to the vibrato, delay vibrato, attack pitch control and after touch vibrato whereas the circuit 20 outputs tone frequency data SKC imparted with the slur effect with respect to the slur effect. Among the setting data for the respective effect setting manual operators outputted by the analog to digital conversion section 17, the setting data relating to the pitch control is supplied to the tonal effect imparting circuit 20 and the setting data relating to the level control is supplied to a tone signal generation section 21. From the key assigner 14, an attack pitch start signal AS, a slur start signal SS and a key code MKC representing the depressed key in the monophonic mode are applied to the tonal effect imparting circuit 20. In the monophonic key assigner 14A, a single key (e.g. the highest or lowest key) among the depressed keys is selected and the key code of the single key is outputted as the key code MKC in the monophonic mode.

An attack pitch data ROM (read-only memory) 22 prestores attack pitch control data APS, APR and APER corresponding respectively to tone colors to which the attack pitch control is to be imparted. The attack pitch control is effected in a manner suitable for the respective tone colors. Since the attack pitch control can express deformation in the pitch which occurs at the beginning of playing of a wind instrument, it is an effect particularly suited to the wind instrument tone colors. For this reason, the control data APS, APR and APER having values which can realize the attack pitch control suited to the tone color selected by a tone color selection switch 23 are read from the ROM 22. Factors which determine the manner of the attack pitch control are initial depth of the pitch deviation (at the beginning of sounding of the tone), an envelope representing timewise change in depth of the pitch deviation and a frequency of repetition in the pitch deviation. The depth of the initial pitch deviation, i.e., the initial value of the attack pitch, is set in accordance with the above described initial touch detection data. More specifically, the initial value of the attack pitch corresponding to the initial touch and the tone color is set by scaling the initial touch detection data by the attack pitch initial value coefficient data APS corresponding to the tone color. The envelope showing the timewise change in the pitch deviation is set by the attack pitch envelope rate data APER. The repetition frequency of the pitch deviation is set by the attack pitch rate data APR.

The tonal effect imparting circuit 20 starts generation of the modulating signal VAL for the pitch control in response to the above described data upon receipt of the attack start signal AS and thereafter generates the modulating signal VAL for the delay vibrato or the after touch vibrato. As will be described later, an arrangement is made in the tonal effect imparting circuit 20 for generating the modulating signal VAL such that controls of the modulation frequency and the depth of modulation will be facilitated. The tonal effect imparting circuit 20 performs also a process for smoothly changing the tone frequency data SKC for a depressed key in the monophonic mode from a value corresponding to a previously depressed key to a value corresponding to a newly depressed key upon receipt of the slur start signal SS. The newly depressed key is represented by the key code MKC for the depressed key in the monophonic mode.

The tone signal generation section 21 generates a tone signal in response to the tone frequency data SKC for the monophonic mode provided by the tonal effect imparting circuit 20 during the monophonic mode and generates tone signals in a plurality of channels in response to the key codes PKC representing the depressed keys assigned to plural channels which key codes PKC are provided by the key assigner 14 (polyphonic key assigner 14B) during the polyphonic mode. These tone signals are modulated in their frequencies (i.e., tone pitches) in accordance with the modulating signal VAL and controlled in their tone levels by the level control data supplied by analog to digital conversion section 17. Further, these tone signals are provided with a tone color selected by the tone color selection switch 23 and thereafter are supplied to the sound system. Specific examples of the component parts in FIG. 2 will now be described.

Depressed Key Detector and Monophonic Key Assigner

Figure 4:
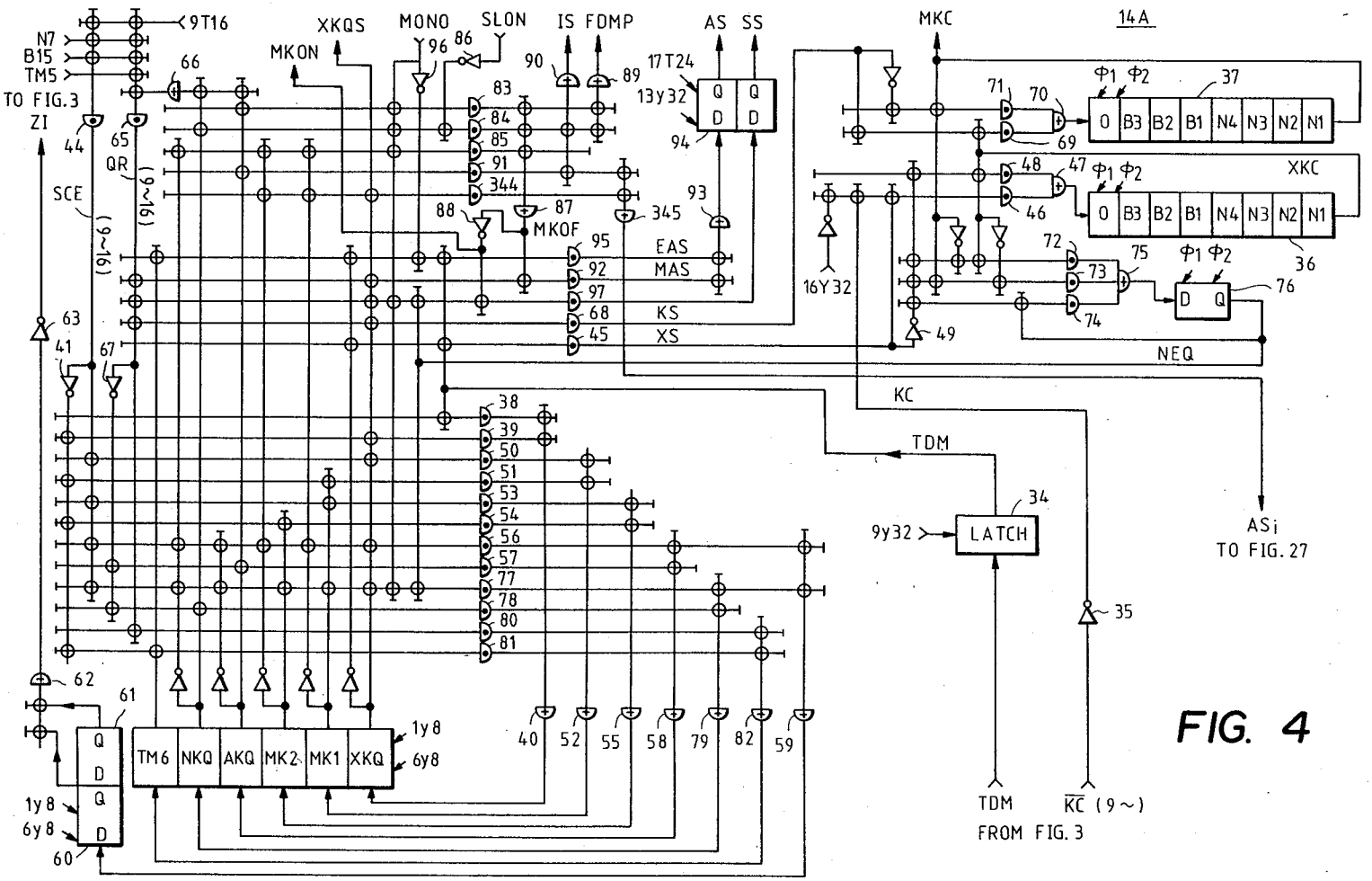
FIG. 4 is a circuit diagram showing in detail an example of the monophonic key assigner illustrated in FIG. 2.

FIG. 3 shows a specific example each of the depressed key detector 12 and the counter 13 and FIG. 4 shows a specific example of the monophonic key assigner 14A. The counter 13 includes a 16-stage/1-bit shift register 25 controlled by two-phase system clock pulses $\phi_1$ and $\phi_2$, a half-adder 26 for 1 bit and a latch circuit 27 which periodically latches contents of the shift register 25. The counter 13 performs counting by a serial operation. Serial operation is employed also in various parts of this specific example to be described later, contributing to simplification of the circuit design. The depressed key detector 12 includes a key switch matrix 28 in which key switches corresponding to the respective keys of the keyboard 10 are arranged in matrix, a decoder 29 supplying a scanning signal to input lines provided evenry half octave in the matrix 28 and a multiplexer 30 multiplexing signals on output lines corresponding to six notes within each half octave in the matrix 28. The key switch matrix 28 is so arranged that the key switches therein are sequentially scanned from the higher note side. The monophonic key assigner 14A is adapted to select the key of the highest note among the depressed keys as the depressed key in the monophonic mode.

Figure 5:
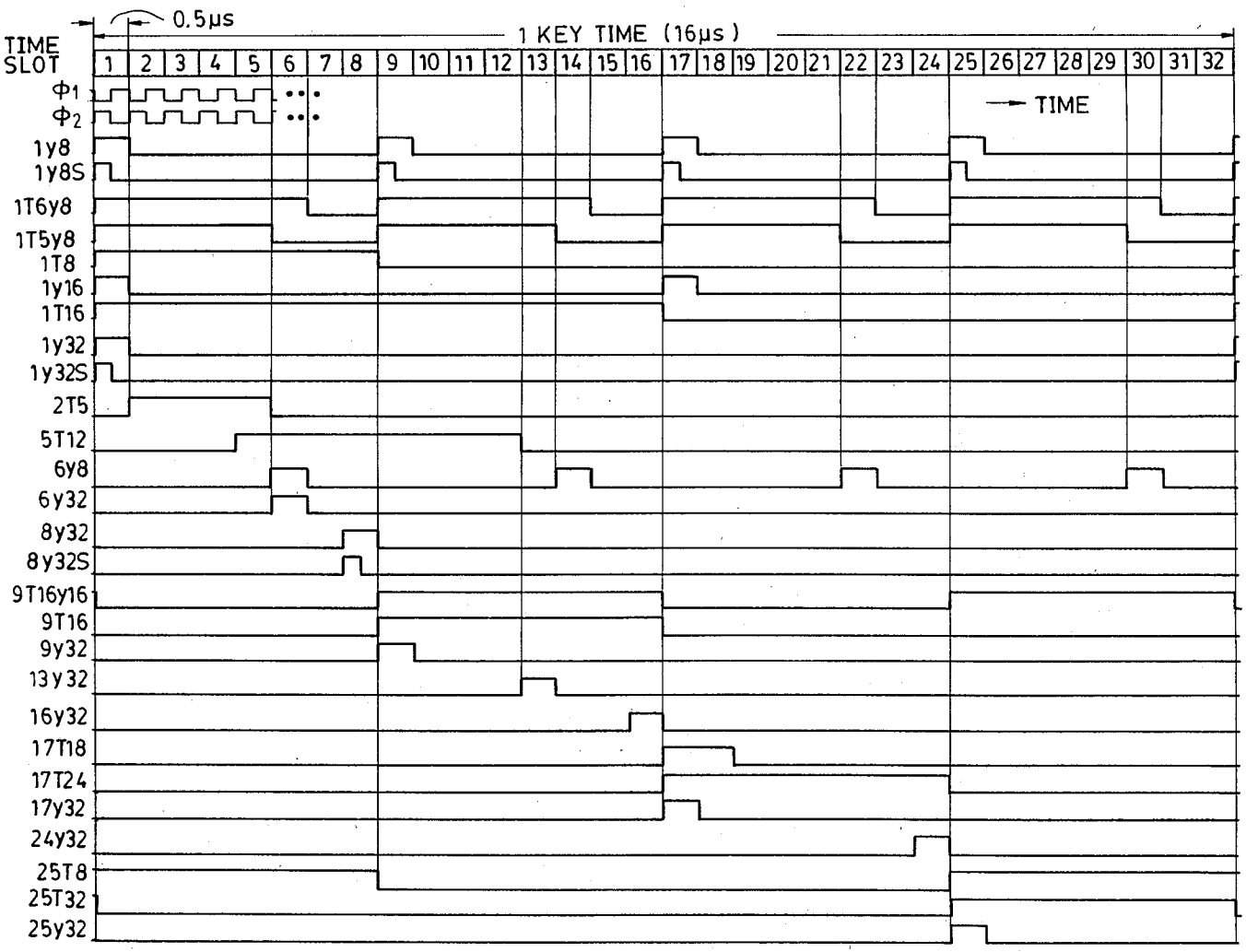
FIG. 5 is a time chart showing examples of the timing signals used various parts of the circuit shown in FIG. 2.

A scanning time for one key in the key switch matrix 28, i.e., a processing time for one key in the monophonic key assigner 14A (hereinafter referred to as one key time), consists of 32 time slots as shown in FIG. 5. The length of one time slot corresponds to one cycle of the system clock pulses $\phi_1$ and $\phi_2$, e.g., 0.5 microseconds. Consequently, the length of one key time is 16 microseconds. In synchronization with each time slot or section in this one key time, various processings are controlled. For this purpose, various timing signals as shown in FIG. 5 are generated in a timing signal generation circuit (not shown) and supplied to various circuits. Each of the 32 time slots appears repeatedly at a period of 16 microseconds. For distinguishing individual time slots in one key time, these time slots are referred to as the first through thirty-second time slots according to the order of appearance. The various timing signals are designated by reference characters according to the following rule for clearly showing the timing and period of generation of the respective timing signals and the pulse width. If figures are written on both sides of the letter "y", e.g., "1y8", the former figure represents the order of the time slot in one key time at which the pulse appears first and the latter figure represents, in the number of time slots, the period with which the pulse is generated repeatedly. For example, the signal 1y8 signifies that, as shown in FIG. 5, the pulse "1" is first generated at the first time slot and subsequently generated every eight time slots, i.e., the ninth, seventeenth and twenty-fifth time slots. The letter "S" added at the end as in "1y8s" signifies that the pulse "1" is generated not in synchronism with the pulse width of whole one time slot but with the pulse width of the former half of one time slot, i.e., the pulse width of the clock pulse $\phi_2$. If figures are written on both sides of the letter "T", this signifies that the pulse "1" is continuously generated from the time slot order represented by the former figure to the time slot order represented by the latter figure and its period is 32 time slots. For example, a signal 1T8 has a pulse width of continuous eight time slots from the first time slot to the eighth time slot and is repeatedly generated with a period of 32 time slots. If the letter "y" and a figure are added to the designation of the pulse width such as "1T6", as in "1T6y8", the period of repetition is represented in the number of time slots by the figure following the letter "y". For example, the signal 1T6y8 signifies that the pulse which is first generated with a time slot width of six time slots from the first time slot to the sixth time slot is subsequently generated with a period of repetition of eight time slots, i.e., in sections from the ninth to the fourteenth time slots, from the seventeenth to the twenty-second time slots and from the twenty-fifth to the thirtieth time slots.

In FIG. 3, the adder 26 receives at the input A an output Q16 of the last stage of the shift register 25 and, at the input Ci, a signal 17y32 through an OR gate 31.

Accordingly, at the seventeenth time slot at which the signal 17y32 goes to "1", a signal "1" is added to the last stage of the shift register 25. When the inputs A and Ci are both "1" and therefore a carry out signal is produced, the carry out signal Co+1 is adapted to go to "1" with a delay of one time slot to the operation timing. The reference characters "+1" added to Co represents the delay of one time slot. It is to be assumed that all carry out signals Co+1 of the adder are delayed by one time slot from the operation timing whereas an addition output S has no delay. The carry out output Co+1 is fed back to the input Ci through an AND gate 32 and an OR gate 31. The carry out signal can therefore be added to a more significant bit.

The signal from the output S of the adder 26 is applied through an AND gate 33 to the shift register 25 and fed back to the input A after delay of 16 time slots. A signal Z1 applied to another input of the AND gate 33 normally is "1". By this arrangement, a serial operation using the signal 17y32 as a count clock and counting up by one every one key time (32 time slots) is implemented. Accordingly, the signal outputted from the last stage of the shift register 25 at the seventeenth time slot constitutes the least significant bit of the count. At this time, the respective stages of the shift register 25 hold count values of sequentially more significant bits from the last stage toward the first stage. At the first time slot which is 16 time slots after the seventeenth time slot, count values from the least significant bit to the most significant bit are likewise arranged from the last stage to the first stage of the shift register 25. Accordingly, a 10-bit parallel binary count value can be obtained by latching the seventh stage output Q7 through the last stage output Q16 of the shift register 25 in a latch circuit 27 in response to the signal 1y32S which is generated at the former half of the first time slot. The AND gate 32 is disabled at the timing of the signal 1y16, i.e., at the first and the seventeenth time slots, so that a carry out signal of the most significant bit will not be added to the least significant bit.

Count values in seven bits counting from the least significant bit in the counter 13 are used for key scanning and multiplexing purposes. Among these seven bits, the lower 4 bits $\overline{N4}$, $\overline{N3}$, $\overline{N2}$ and $\overline{N1}$ designate the note name of a key and higher 3 bits $\overline{B3}$, $\overline{B2}$ and $\overline{B1}$ designate the octave to which this key belongs. Among the count values latched by the latch circuit 27, the bits $\overline{B3}$, $\overline{B2}$, $\overline{B1}$ and $\overline{N4}$ are decoded by a decoder 29 and thereupon give a scanning signal to the input lines provided every half octave in the key switch matrix 28. The lower bits $\overline{N3}$, $\overline{N2}$ and $\overline{N1}$ are supplied to a multiplexer 30 for time division multiplexing signals on six output lines in each half octave in the key switch matrix 28. Thus, time division multiplexed key data TDM representing depression or release of keys is outputted from the multiplexer 30 in response to the scanning of the respective keys. The time division multiplexed key data TDM is "1" if a key under scanning is being depressed and "0" if the key under scanning is not being depressed.

Since a key to be scanned is changed each time the count values $\overline{B3}$–$\overline{N1}$ latched by the latch circuit 27 change, a scanning time required for scanning of a single key is 32 time slots from the first time slot to the thirtysecond time slots as shown in FIG. 5. During this scanning time, the key data TDM for one key is continuously outputted. As was previously described, one key time required for scanning of one key is 16 microseconds and one scanning cycle, i.e., time required for the count values $\overline{B3}$–$\overline{N1}$ to make one cycle is about 2ms (=16 microseconds $\times 2^7$).

In the key switch matrix 28, the key scanning is performed from the highest note to the lower note side. In other words, the respective keys are sequentially assigned in correspondence to predetermined count values in such a manner that the smaller the count values $\overline{B3}$–$\overline{N1}$, the higher is the note name and vice versa. Thus, as the count value $\overline{B3}$–$\overline{N1}$ increase, the scanning is shifted from the higher notes to the lower notes. The count values $\overline{B3}$–N1 of the lower 7 bits in the counter 13 constitute a code signal, i.e., a key code $\overline{KC}$, representing a key under scanning, i.e., a key corresponding to the time division multiplexed key data TDM. The key code $\overline{KC}$ which directly uses the count values B3–N1 of the counter 13 becomes of a smaller value as the note name becomes higher and vice versa. In a case where the key code is converted to frequency data by repeatedly adding the lowest two bits of the key code to further lower order bit positions below the least significant bit of the key code, inconvenience will arise unless the value of the key code becomes larger as the note name becomes higher. Hence, a signal obtained by inverting the key code $\overline{KC}$ outputted from the counter 13 is used as a formal key code KC in the key assigners 14A and 14B. Relationship between the formal key code KC and the respective keys is as shown in the following Table 1. The key code KC consists of an octave code B3, B2, B1 of the higher 3 bits and a note code N4, N3, N2 and N1 of the lower 4 bits.

TABLE 1

KC

| Octave | B3 | B2 | B1 |
|---|---|---|---|
| C2 | 0 | 0 | 1 |
| C#2~C3 | 0 | 1 | 0 |
| C#3~C4 | 0 | 1 | 1 |
| C#4~C5 | 1 | 0 | 0 |
| C#5~C6 | 1 | 0 | 1 |
| C#6~C7 | 1 | 1 | 0 |

| Note | N4 | N3 | N2 | N1 |
|---|---|---|---|---|
| C# | 0 | 0 | 0 | 0 |
| D | 0 | 0 | 0 | 1 |
| D# | 0 | 0 | 1 | 0 |
| E | 0 | 1 | 0 | 0 |
| F | 0 | 1 | 0 | 1 |
| F# | 0 | 1 | 1 | 0 |
| G | 1 | 0 | 0 | 0 |
| G# | 1 | 0 | 0 | 1 |
| A | 1 | 0 | 1 | 0 |
| A# | 1 | 1 | 0 | 0 |
| B | 1 | 1 | 0 | 1 |
| C | 1 | 1 | 1 | 0 |

The reference characters in the seventh to last stages represent weights of the respective stages at the timings of the first and seventeenth time slots. At these timings, the lower seven bits $\overline{B3}$–$\overline{N1}$ of the count are loaded in the tenth to the last stages (Q10–Q16). Further, bits having weights of about 8 ms, 4 ms and 2 ms indicates in time are loaded in the seventh to last stages. These time indications represent time required from resetting of the counter 13 till turning of these bits to "1". As will be described later, these time indication bits are used when the counter 13 is used as a timer. These time indication bits are latched with the key codes $\overline{B3}$–$\overline{N1}$ by the latch circuit 27.

In FIG. 4, the monophonic key assigner 14A conducts processes concerning the time division multiplexed key data TDM of the respective keys with the ninth time slot being used as a starting point. For this purpose, the time division multiplexed key data TDM outputted from the multiplexer 30 in FIG. 3 is applied to a latch circuit 34 in FIG. 4 and latched therein by the signal 9y32 in synchronism with the ninth time slot. Accordingly, a signal produced by delaying the key data TDM by eight time slots is outputted from the latch circuit 34. On the other hand, the least significant bit $\overline{N1}$ of the key code $\overline{KC}$ outputted from the last stage Q16 of the shift register 25 (FIG. 3) at the first time slot has been shifted to the eighth stage (Q8) at the ninth time slot which is eight time slots later. Accordingly, for synchronization with the delay of the key data TDM in the latch circuit 34 (FIG. 4), the output of the eighth stage (Q8) of the shift register 25 (FIG. 3) is taken out as a serial key code $\overline{KC}$ (9-) and supplied to the key assigner 14A in FIG. 4. This key code $\overline{KC}$ (9-) consists of the bits $\overline{N1}$, $\overline{N2}$, $\overline{N3}$, $\overline{N4}$, $\overline{B1}$, $\overline{B2}$ and $\overline{B3}$ from the ninth time slot to the fifteenth time slots in the order from the lower bit to the higher bit. This key code $\overline{KC}$ (9-) is inverted by an inverter 35 in FIG. 4 and the formal key code KC as described above is outputted in a serial form from the inverter 35.

In FIG. 4, the monophonic key assigner 14A performs the following three functions. One is to select the key code KC of the highest depressed key, another function is to detect a newly depressed key and still another function is to prohibit processing concerning the newly depressed key for a certain period of time upon the detection of the newly depressed key for enabling detection of the initial touch. The detection of the newly depressed key is conducted in such a manner that a case where a certain key is depressed in a state in which all keys are released (hereinafter referred to as "any new key-on") is distinguished from a case where a depressed key is changed in a legato form in a state in which any key is being depressed (hereinafter refered to as "legato new key-on"). If the any new key-on has been detected, a flip-flop AKQ is set whereas if the legato new key-on has been detected, a flip-flop NKQ is set. When the flip-flop AKQ or NKQ is set by the new key-on detection, the counter 13 in FIG. 3 is operated as a timer to produce an initial sensing signal IS during a predetermined period of time (about 10 ms). During this period of time, processing concerning a newly depressed key is prohibited and upon lapse of this period, an attack pitch start signal AS or a slur start signal SS is produced to start the attack pitch or slur control. A highest note depressed key key code register 36 temporarily stores a key code XKC of the highest depressed key. A monophonic key code register 37 stores a key code MKC of a depressed key sounded in the monophonic mode. Upon lapse of the predetermined period of time, the key code XKC of the register 36 is loaded in the register 37. Accordingly, the key code MKC for a depressed key in the monophonic mode is changed not immediately upon depression of a new key but upon lapse of this predetermined period of time.

Flip-flops XKQ, MK1, MK2, AKQ, NKQ and TM6 have an input signal loaded therein in response to the timing signal 6y8 (FIG. 5) and change their outputs in synchronism with the signal 1y8 (FIG. 5). Accordingly, the loaded signals are outputted continuously for eight time slots from the time slot of generation of the signal 1y8, i.e., the first, ninth, seventeenth or twentyfifth time slot.

The flip-flop XKQ is provided for showing that any depressed key has been detected in one scanning cycle. When the key data TDM outputted from the latch circuit 34 is "1", a signal "1" is loaded in the flip-flop XKQ through an AND gate 38 and an OR gate 40. This signal "1" in the flip-flop XKQ is held through the AND gate 39 and the OR gate 40. Upon completion of one scanning cycle, the output of an inverter 41 goes to "0" whereby the AND gate 39 is disabled and the flip-flop XKQ is reset. The lower 3 bits $\overline{N3}$, $\overline{N2}$ and $\overline{N1}$ of the count value outputted from latch circuit 27 in FIG. 3 are applied to an AND gate 42 whereas the higher 4 bits $\overline{B3}$, $\overline{B2}$, $\overline{B1}$ and $\overline{N4}$ are applied to an AND gate 43. The output signal N7 of the AND gate 42 and the output signal B15 of the AND gate 43 are applied to an AND gate 44. When one scanning cycle has been completed, all bits of the count value $\overline{B3}$–$\overline{N1}$ have gone to "1" and the signals N7 and B15 have both gone to "1" thereby enabling the AND gate 44. The AND gate 44 receives at another input thereof the timing signal 9T16 (FIG. 5). Accordingly, the output of the AND gate 44 is "1" during a period of time from the ninth time slot at which one scanning has ended to the sixteenth time slot. This output signal "1" of the AND gate 44 is a scanning finish signal SCE. This signal SCE is inverted by an inverter 41. If, accordingly, any key is being depressed, the output of the flip-flop XKQ maintains "1" during a period of time from a key scanning timing in one scanning cycle at which the key data TDM first goes to "1", i.e., a scanning timing of the highest depressed key, to the end of the key scanning. When no key is being depressed, the flip-flop XKQ is always "0". An AND gate 45 which receives the signal produced by inverting the output of the flip-flop XKQ and the key data TDM outputted by the latch circuit 34 functions to detect the highest depressed key. When the key data TDM for the highest depressed key rises to "1" for the first time in one scanning cycle by the delay of eight time slots between the input and output of the flip-flop XKQ, the output of the flip-flop XKQ remains "0" during eight time slots at the rising of the key data TDM, i.e., from the ninth time slot to the sixteenth time slot and the inverted signal thereof remains "1". Accordingly, the AND gate 45 is enabled only during the eight time slots from the ninth time slot to the sixteenth time slot at the rising of the key data TDM for the highest depressed key and the output XS of the AND gate 45 goes to "1". An AND gate 46 is enabled by this signal XS which is "1" and the key code KC for the highest depressed key provided by the inverter 35 thereby is loaded in the register 36 through the AND gate 46 and an OR gate 47.

As described previously, the key code KC outputted from the inverter 35 and the key data TDM outputted from the latch circuit 34 are in synchronism with each other so that the key code KC for the highest depressed key is loaded in the register 36 sequentially from the lower bit during the period from the ninth time slot to the sixteenth time slot during which the signal XS is "1". All of the bits N1–B3 of the key code KC are loaded in the register 36 in the period from the ninth time slot to the fifteenth time slot and count data which is irrelevant to the key code KC appears at the sixteenth time slot. For preventing this, a signal obtained by inverting the timing signal 16y32 is applied to the AND gate 46 so as to load "0" compulsorily in the register 36 at the sixteenth time slot. The key code XKC for the highest depressed key loaded in the register 36 is self-held through an AND gate 48. The AND gate 48 receives at another input thereof a signal obtained by inverting the signal XS by an inverter 49 and the self-holding is cleared upon loading of the key code KC in the register 36 by enabling the AND gate 46.

The register 36 and the register 37 to which count XKC of the register 36 is transferred are composed of shift registers of 8-stage/1-bit which are shift-controlled by the system clock pulses $\phi 1$ and $\phi 2$. Accordingly, the contents of the shift registers 36 and 37 circulate with a cycle of eight time slots. In the figure, weights at the respective stages of the registers 36 and 37 at the ninth, seventeenth, twenty-fifth or first time slot are illustrated.

The flip-flop MK1 functions to show that some depressed key has been detected in the preceding scanning cycle. If a signal "1" is stored in the flip-flop XKQ when one cycle of scanning has been completed, i.e., the scanning finish signal SCE goes to "1", an AND gate 50 outputs a signal "1" and this signal "1" is loaded in the flip-flop MK1 through an OR gate 52. This signal "1" in the flip-flop MK1 is held during one scanning cycle through an AND gate 51 and an OR gate 52 and reset by the scanning finish signal SCE.

The flip-flop MK2 is provided for showing that some depressed keys were detected in the a scanning cycle two cycles before. At the timing of generation of the scanning finish signal SCE, the output of the flip-flop MK1 is loaded to the flip-flop MK2 through an AND gate 53 and an OR gate 55. An AND gate 54 holds the storage in the flip-flop MK2 for one scanning cycle. Upon generation of the scanning finish signal SCE, the AND gate 54 is disabled and consequently resets the flip-flop MK2. These three flip-flops XKQ, MK1 and MK2 serve to detect depression and release of keys in the monophonic mode while preventing occurrence of chattering.

The flip-flop AKQ is provided for showing that the above described any new key-on has been detected. To an AND gate 56 are applied the output of the flip-flop XKQ, the inverted outputs of the flip-flops MK1, MK2, AKQ and NKQ and the scanning finish signal SCE. The AND gate 56 is enabled at the any new key-on to produce a signal "1" at the timing of the scanning finish signal SCE. In the AND gate 56, the any new key-on is detected on conditions that no key has been depressed in the immediately preceding scanning cycle and the scanning cycle two cycles before (i.e., MK1 and MK2 are both "0") and key depression has been detected for the first time in the present scanning cycle (i.e., XKQ is "1"). The reason for applying the inverted outputs of flip-flops AKQ and NKQ to the AND gate 56 is that frequent resetting of a timer to be described later to a starting state should be prevented by disabling the AND gate 56 when the signal "1" is not stored in the flip-flop AKQ or NKQ. The output signal "1" of the AND gate 56 is loaded in the flip-flop AKQ through an OR gate 58. The signal "1" in the flip-flop AKQ is held for a certain period of time through an AND gate 57 and an OR gate 58.

The output signal "1" of the AND gate 56, i.e., any new key-on detection signal, is utilized also as a timer start signal. This output signal "1" is applied to two-stage flip-flops 60 and 61 through an OR gate 59. These flip-flops 60 and 61 are controlled, like the flip-flop XKQ, by the timing signals 6y8 and 1y8. Outputs of these flip-flops 60 and 61 are applied to an OR gate 62, inverted by an inverter 63 and thereafter are applied to the AND gate 33 in FIG. 3 as the signal Z1. The any new key-on detection signal outputted from the AND gate 56 maintains "1" during eight time slots from the ninth to the sixteenth time slots in synchronism with the scanning finish signal SCE. This signal is extended to a width of 16 time slots by flip-flops 60 and 61 and an OR gate 62 and the output signal Z1 of an inverter 63 maintains "0" during this period of 16 time slots. Otherwise the signal Z1 is always "1", enabling the counting operation of the counter 13 (FIG. 3). During the 16 time slots during which the signal Z1 is "0", the AND gate 33 (FIG. 3) is disabled so that the contents of the entire 16 stages of the shift register 25 are all cleared to "0". Thus, the counter 13 starts the counting operation from the count value all "0" thereby starting the timer function.

A bit having a weight of about 8 ms expressed in time in the count value latched by the latch circuit 27 in FIG. 3 is applied to an AND gate 64 whereas bits having weights of about 4 ms and 2 ms are respectively inverted and applied to other inputs of the AND gate 64. An output signal TM5 of the AND gate 64 is supplied to an AND gate 65 in FIG. 4. The AND gate 65 receive at other inputs thereof the signals N7 and B15 from the AND gates 42 and 43 and further the timing signal 9T16 and the output of the OR gate 66. The OR gate 66 receives outputs of the flip-flops AKQ and NKQ. The output of the AND gate 65 is utilized as a timer finish signal QR. The reason for applying the output of the flip-flop AKQ or NKQ is that the timer function needs to be performed only when the flip-flop AKQ or NKQ is set, i.e., at the new key-on.

When the count value of the lower 10 bits of the counter 13 has become "1001111111", i.e., about 10 ms has elapsed from clearing of the counter 13 by the signal Z1, the AND gates 42, 43 and 64 (FIG. 3) are all enabled so that the signals N7, B15 and TM5 applied to the AND gate 65 in FIG. 4 all go to "1". At this time, the output signal QR of the AND gate 65 goes to "1" during 16 time slots from the ninth to sixteenth time slots in response to the signal 9T16. In the figure, figures "9–16" indicated beside some signal lines signify that this signal is generated during 16 time slots from the ninth to sixteenth time slots.

This timer finish signal QR is inverted by an inverter 67 and thereafter is applied to the AND gate 57. Accordingly, the signal "1" of the flip-flop AKQ is held for about 10 ms until generation of the timer finish signal QR and cleared upon generation of the timer finish signal QR. Alternatively stated, when the timer finish signal QR falls at the seventeenth time slot, the output of the flip-flop AKQ also falls to "0".

The output signal KS of the AND gate 68 goes to "1" on condition that the signal "1" is set in the flip-flop XKQ (i.e., a key is being depressed) when the timer finish signal QR has been generated. An AND gate 69 is enabled by this signal KS and the key code XKC for the highest depressed key of the register 36 (representing a newly depressed key) is loaded in the register 37 through the AND gate 69 and an OR gate 70. The key code for the new highest depressed key loaded in the register 37 is outputted from the key assigner 14A as the key code MKC for the depressed key in the monophonic mode and also circulates in the register 37 through an AND gate 71. Upon loading of the new key code XKC in accordance with the signal KS, the AND gate 71 is disabled and the old key code MKC thereby is cleared.

The AND gates 72, 73 and 74, the OR gate 75 and the delay flip-flop 76 are provided for comparing the key codes XKC and MKC in the registers 36 and 37. An inverted signal of the key code MKC and the key code XKC are applied to the AND gate 73. The key codes XKC and MKC are respectively outputted from the registers 36 and 37 with the bits N1–B3 of the same weights of the two key codes being synchronized with each other. If the values of the two key codes MKC and XKC are different even by 1 bit, the AND gate 72 or 73 is enabled and a signal "1" is loaded in the flip-flop 76. This signal "1" of the flip-flop 76 is self-held through the AND gate 74. A signal obtained by inverting the highest depressed key detection signal XS is applied to the respective AND gates 72, 73 and 74 so that the storage in the flip-flop 76 is cleared each time a highest depressed key is detected in each scanning cycle.

The flip-flop NKQ is provided for showing that the above described legato new key-on has been detected. The AND gate 77 provided for detecting the legato new key-on receives the output signal NEQ of the flip-flop 76, the monophonic mode selection signal MONO, inverted signals of the output signals of the flip-flops AKQ and NKQ and the scanning finish signal SCE. The monophonic mode selection signal MONO is applied to enable detection of the legato new key-on only in the monophonic selection mode. As described previously, the output signal NEQ of the flip-flop 76 goes to "1" when the key codes XKC and MKC of the registers 36 and 37 are different from each other. The signal NEQ which is "1" represents that there has been a newly depressed key. If this newly depressed key is the any new key-on, the AND gate 56 is enabled as was previously described. This causes the flip-flop AKQ to be set and an inverted signal thereof goes to "0" so that the AND gate 77 is not enabled. If this newly depressed key is the legato new key-on, the flip-flop AKQ is not set and the outputs of the flip-flops XKQ, MK1 and MK2 are "1" representing that some keys are continuously being depressed. In the legato new key-on, therefore, the AND gate 77 is enabled at the timing of the scanning finish signal SCE and a signal "1" is loaded in the flip-flop NKQ through an OR gate 79. This signal "1" of the flip-flop NKQ is self-held through an AND gate 78.

In the meanwhile, the legato new key-on detection signal outputted from the AND gate 77 is supplied, like the any new key-on detection signal, to the delay flip-flop 60 through the OR gate 59 and utilized as the timer start signal. Accordingly, upon detection of the legato new key-on, the counter 13 in FIG. 3 functions as a timer in the same manner as was described previously whereby the timer finish signal QR is outputted from the AND gate 65 (FIG. 4) about 10 ms later. The AND gate 78 is disabled and the flip-flop NKQ is reset by this timer finish signal QR. Accordingly, the flip-flop NKQ holds a signal "1" during about 10 ms. In the same manner as was described above, the signal KS is outputted from the AND gate 68 in response to the timer finish signal QR and the key code XKC for the new highest depressed key stored in the register 36 is loaded in the register 37.

The flip-flop TM6 is provided for showing that the waiting time of about 10 ms in accordance with the any new key-on has finished for producing an attack pitch start signal in the polyphonic mode. The timer finish signal QR is applied to the flip-flop TM6 through an AND gate 80 and an OR gate 82. Upon lapse of the waiting time of about 10 ms in accordance with the any new key-on, a signal "1" is set in the flip-flop TM6 in response to this timer finish signal QR. The signal "1" in this flip-flop TM6 is self-held through an AND gate 81 and reset by the scanning finish signal SCE. Accordingly, the signal "1" in the flip-flop TM6 is held only during one scanning cycle. Since the detection of the legato new key-on is not made in the polyphonic mode, setting of the flip-flop TM6 by the timer finish signal QR in accordance with the legato new key-on in the monophonic mode does not affect the above described operation in any way.

AND gates 83, 84 and 85 are provided for forming a key-off signal MKOF for the monophonic mode. The monophonic mode selection signal MONO is supplied to the respective AND gates 83, 84 and 85 which are thereby enabled. Inverted signals of the flip-flops MK1, MK2 and NKQ are applied to the AND gate 85 which produces an output "1" if the fact that all keys are in an OFF state has been detected consecutively for two scanning cycles. The output "1" of this AND gate 85 represents a normal key-off. The arrangement of enabling the AND gate 85 on the condition that the signals from the flip-flops MK1 and MK2 are both "0" is for preventing chattering. The AND gate 83 receives the output of the flip-flop AKQ and outputs a signal "1" during the waiting time of about 10 ms at the time of the any new key-on detection. The AND gate 83 receives the output of the flip-flop NKQ and a signal obtained by inverting the slur-on signal SLON by an inverter 86 and outputs a signal "1" during the waiting time of about 10 ms at the time of the legato new key-on detection if the slur effect is not selected.

The outputs of the AND gates 83, 84 and 85 are applied to an OR gate 87 and utilized as a key-off signal MKOF for the monophonic mode. A signal obtained by inverting this key-off signal MKOF by an inverter 88 is a monophonic mode key-on signal MKON. In generating a tone signal corresponding to the key code MKC for the depressed key in the monophonic mode, the amplitude envelope can be controlled in accordance with this key-on signal MKON. If the any new key-on has been detected in the monophonic mode or if the legato new key-on has been detected when the slur effect is not selected, the attack pitch control is performed. During the waiting time (about 10 ms) for initial touch detection for carrying out the attack pitch control, a key-off state is compulsorily brought about in response to the output "1" of the AND gate 83 or 84. For removing sustain of a preceding tone in this compulsory key-off state in the waiting time, outputs of the AND gates 83 and 84 are provided from the key assigner 14A through an OR gate 89 as a forced damp signal FDMP and supplied to the tone signal generation section 21 (FIG. 2).

The output of the AND gate 84 is applied also to an OR gate 90. The output of the flip-flop AKQ also is applied to the OR gate 90 through an AND gate 91. And gates 38, 80 and 91 which have only one input simply pass input signals and are illustrated for convenience of illustration though they are not essential component parts. The output of the OR gate 90 is utilized as the initial sensing signal IS for the initial touch detection. This initial sensing signal IS goes to "1" for about 10 ms from the start of depression of a new key in response to the output of the flip-flop AKQ if the any new key-on has been detected regardless of the monophonic mode or the polyphonic mode. The initial sensing signal IS also goes to "1" for about 10 ms form the start of depression of a new key in response to the output of the flip-flop NKQ if the legato new key-on has been detected when the slur effect is not selected in the monophonic mode. When the slur effect is selected in the monophonic mode, the initial sensing signal IS is not generated even if the legato new key-on has been detected.

An AND gate 92 is provided for generating an attack pitch start signal MAS for the monophonic mode. The AND gate 92 receives the key-off signal MKOF, the output signal of the flip-flop XKQ and the timer finish signal QR. The key-off signal MKOF goes to "1" in response to the output signal of the AND gate 83 or 84 during the waiting time of about 10 ms in accordance with the new key-on detection thereby enabling the AND gate 92. Upon lapse of the waiting time, the output signal MAS of the AND gate 92 goes to "1" during the period from the ninth to sixteenth time slots corresponding to the timer finish signal QR if any key is being depressed (i.e., XKQ is "1"). This signal MAS is applied to a delay flip-flop 94 through an OR gate 93. This flip-flop 94 has an input signal loaded therein in accordance with the timing signal 13y32 and changes its output in synchronism with the signal 17T24. Accordingly, the signal MAS which is "1" generated at the ninth to sixteenth time slots is loaded in the flip-flop 94 at the thirteenth time slot and outputted as the attack pitch start signal AS during 1 key time (32 time slots) from the seventeenth time slot to a next sixteenth time slot.

An AND gate 95 is provided for generating an attack pitch start signal EAS for the polyphonic mode. The AND gate 95 receives the output of the flip-flop TM6, an inverted signal of the output of the flip-flop XKQ, a signal obtained by inverting the monophonic mode selection signal MONO by an inverter 96 and the key data TDM from the latch circuit 34. In the polyphonic mode, the AND gate 95 is enabled by the output "1" of the inverter 96. As was described previously, the output of the flip-flop TM6 goes to "1" during one scanning cycle immediately after lapse of the waiting time of about 10 ms in accordance with the any new key-on detection and the AND gate 95 is enabled during 16 time slots from the ninth to sixteenth time slots at the rising of the key data TDM for the highest depressed key in this cycle. The output signal EAS of the AND gate 95 which goes to "1" at the ninth to sixteenth time slots is applied to the flip-flop 94 through the OR gate 93 and, in the same manner as described above, is outputted as the attack pitch start signal AS during 1 key time from the seventeenth time slot to a next sixteenth time slot.

An AND gate 97 is provided for generating the slur start signal SS. The AND gate 97 receives the timer finish signal QR, the output of the flip-flop XKQ, the monophonic mode selection signal MONO, the monophonic mode key-on signal MKON and a signal NEQ representing non-coincidence of the key codes. When the key code XKC of the register 36 and the key code MKC of the register 37 do not coincide with each other (i.e., NEQ is "1"), if it is in the waiting time (i.e., AKQ or NKQ is "1") and the AND gates 83 and 84 are not enabled (i.e., MKON is "1"), it signifies that the slur effect has been selected and the legato new key-on has been made. Accordingly, when the slur effect has been selected and the legato new key-on has been made, the output of the AND gate 97 goes to "1" during 16 time slots from the ninth to sixteenth time slots in response to the timer finish signal QR generated upon the lapse of the waiting time in accordance with the legato new key-on on the condition that the key is being depressed (i.e., XKQ is "1"). This output "1" is applied to the flip-flop 94 and outputted as the slur start signal SS during 1 key time from the seventeenth time slot to a next sixteenth time slot in the same manner as described above.

As described above, the attack pitch start signal AS and the slur start signal SS are produced upon lapse of the waiting time of about 10 ms. The attack pitch start signal AS is generated in the monophonic mode at the any new key-on or at the legato new key-on when the slur effect is not selected and, in the polyphonic mode, at the any new key-on. The slur start signal SS is generated at the legato new key-on in the monophonic mode when the slur effect is selected.

Analog Voltage Multiplexer and Analog to Digital Conversion Section

Figure 6:
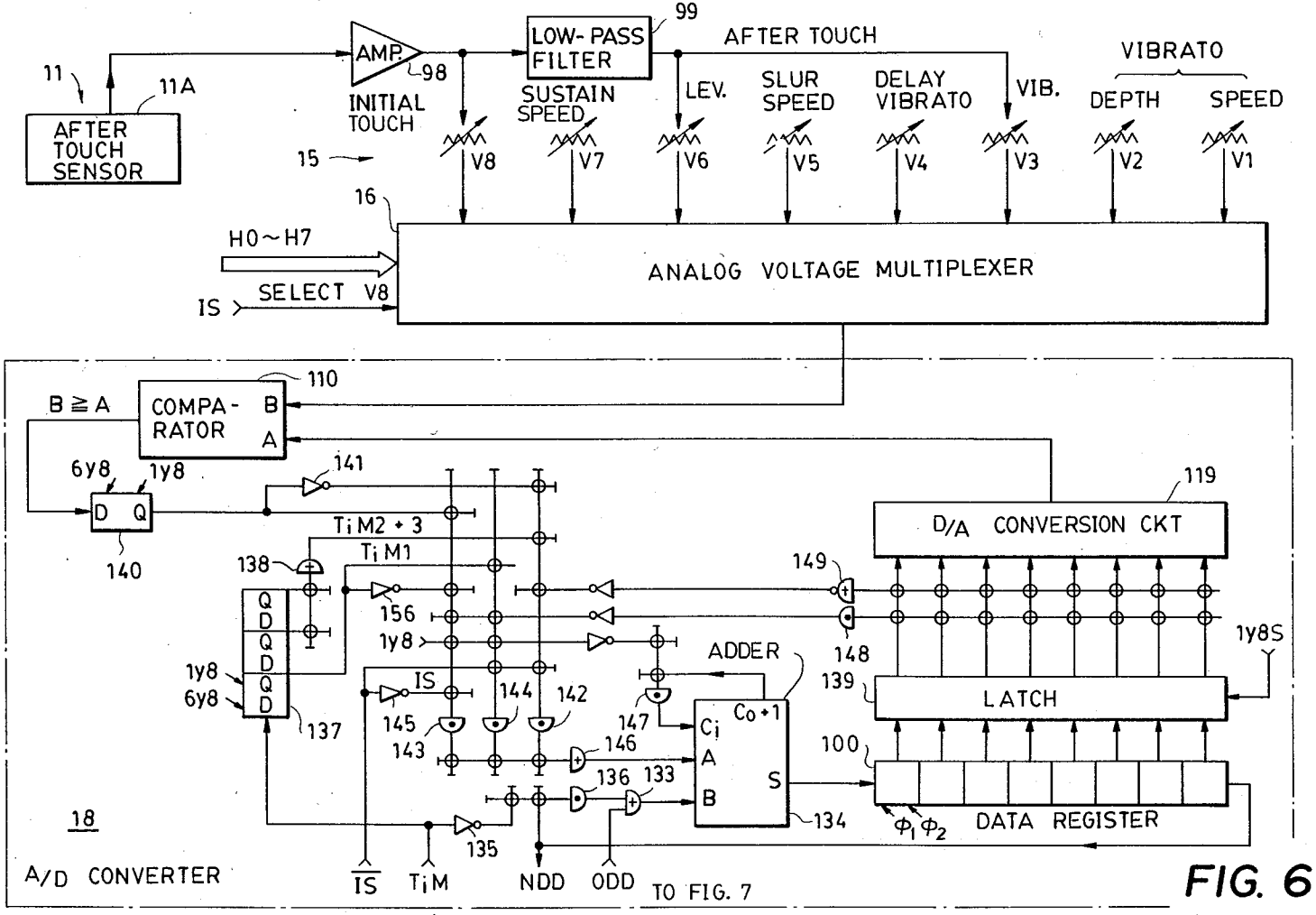
FIG. 6 is a circuit diagram showing in detail examples of the touch sensor, various tonal effect setting manual operators analog voltage multiplexer, and part of the analog to digital converter shown in FIG. 2.
Figure 7:
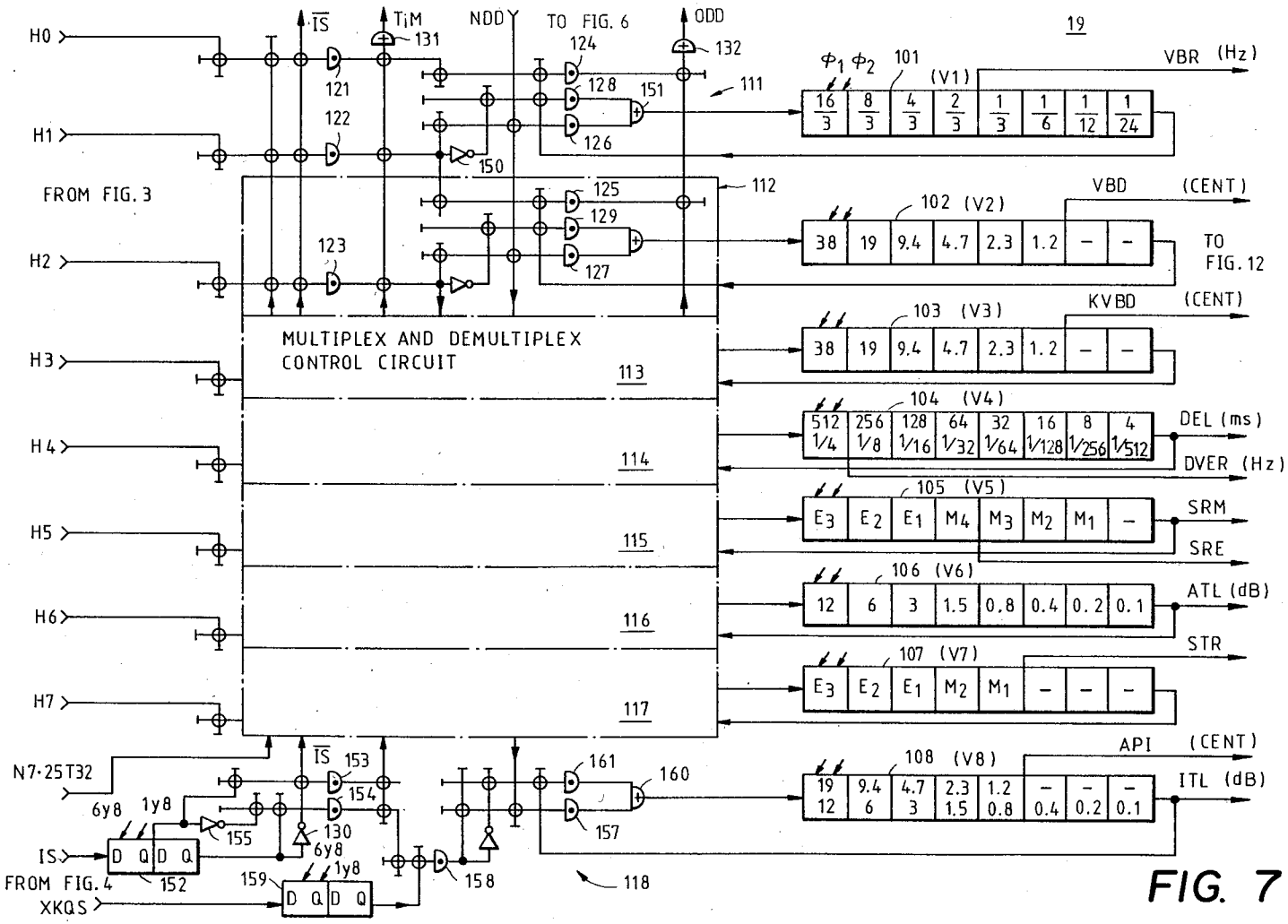
FIG. 7 is a circuit diagram showing in detail an example of the control and memory section of the analog to digital conversion section shown in FIG. 2.

A specific example of the tonal effect setting manual operators 15 is shown in FIG. 6. As to the analog to digital conversion section 17, the portion including the analog to digital convertor 18 is illustrated in FIG. 6 and the portion including the control and memory circuit 19 is illustrated in FIG. 7, for convenience of illustration.

In FIG. 6, the tonal effect setting manual operators 15 include potentiometers V1–V8 for setting, in analog voltages, control amounts corresponding to control elements for the respective tonal effects. The potentiometer V1 is provided for setting the vibrato speed (frequency), the potentiometer V2 for setting the vibrato depth, the potentiometer V4 for setting the delay vibrato time, the potentiometer V5 for setting a speed in the pitch variation in the slur effect (i.e., a slur speed) and the potentiometer V7 for setting a sustain speed in the sustain portion of the amplitude envelope, respectively. The potentiometers V3, V6 and V8 are provided for adjusting sensitivity of the output signal of the touch sensor 11. Among them, the potentiometer V3 is for adjusting sensitivity of a key touch detection signal for setting the depth of the after touch vibrato, the potentiometer V6 is for adjusting sensitivity of a key touch detection signal for setting the level of the after touch level control and the potentiometer V8 is for adjusting sensitivity of an initial touch detection signal. The initial touch detection signal which has been adjusted in sensitivity by the potentiometer V8 is utilized for two purposes. One is setting of an initial value in the attack pitch control and another is setting of a level in the initial touch level control.

For the touch sensor 11, the after-touch sensor 11A provided commonly for all keys is used. Any type of sensor that is capable of detecting a key touch during the continuous depression of a key can be used as the after touch sensor 11A. The key touch may be detected in response, for example, to the speed of depression, depth of depression, depressing force or strength. The output signal of the after touch sensor 11A is applied to the initial touch sensitivity adjusting potentiometer V8 through an amplifier 98 and also to a low-pass filter 99. The output of the low-pass filter 99 is applied to the after touch vibrato sensitivity adjusting potentiometer V3 and the after touch level sensitivity adjusting potentiometer V6. The low-pass filter 99 serves to prevent an abrupt variation in the touch detection signal employed for the after touch control.

The after touch sensor 11A is used for both the initial touch detection and the after touch detection. If, for example, the touch detection signal outputted from the after-touch sensor 11A assumes a form as shown in FIG. 8(*a*), a peak value of this touch detection signal is detected during about 10 ms during which the initial sensing signal IS (FIG. 8(*b*)) is provided from the key assigner 14A (FIG. 4) and this peak value is held as the initial touch detection signal. As described above, sounding of a tone is started from falling of the initial sensing signal IS (i.e., after finishing the peak value detection). The output signal of the after touch sensor during the peak value detection (i.e., during generation of the initial sensing signal IS) is not used as the after touch detection signal but otherwise the same output signal is used as the after touch detection signal. This arrangement obviates necessity for providing the initial touch sensor and the after touch sensor separately so that it saves cost and moreover the sensor device disposed under the keys is simplified.

The eight analog voltages set or adjusted by the potentiometers V1–V8 are converted to digital data by the single analog to digital converter 18. For this purpose, the analog voltage multiplexer 16 is provided to time division multiplex the analog voltages of the potentiometers V1–V8 and supply the multiplexed data to the analog to digital converter 18. The control and memory circuit 19 shown in FIG. 7 is provided in association with the analog-to-digital converter 18 to control the time division analog to digital conversion operation in the analog to digital converter 18 and demultiplexing of the digital data obtained by the analog to digital conversion. This analog to digital conversion contributes to simplification of the circuit design.

The control and memory circuit 19 shown in FIG. 7 includes registers 101–108 as memory means corresponding to the potentiometers V1–V8. Reference characters (V1)–(V8) affixed to the registers 101–108 represent the respective corresponding potentiometers V1–V8. Digital data obtained by converting each output voltage of the potentiometers V1–V8 is stored in corresponding one of the registers 101–108. The registers 101–108 consist of circulating type shift registers of 8-stage/1-bit which are shift-controlled by the system clock pulses $\phi_1$ and $\phi_2$. Figures in blocks representing respective stages of the registers 101–108 show, by way of example, weights of data in the respective stages at the first, ninth, seventeenth and twenty-fifth time slots. Different units, i.e., "Hz" (frequency), "cent" (a cent value representing depth of the pitch difference), "ms" (time) and "dB" (level), as described near the output data indications in FIG. 7, are used for representing weights in the respective registers 101–108 according to characteristics of the respective control elements. Such weight indications are only exemplary and are not so important in the operation of the circuitry but only serve to clarify relationship between the weights of the respective bits and the time slots when the data is sent out as serial data.

The control and memory circuit 19 in FIG. 7 includes multiplex and demultiplex control circuits 111–118 corresponding to the registers 101–108. Since the circuits 112–117 are of the same construction, the circuit 112 only is illustrated in detail and details of the other circuits 113–117 are omitted. These multiplex and demultiplex control circuits 111–117 multiplex the digital data in the registers 101–107 in accordance with the time division multiplexing operation in the analog voltage multiplexer 16 (FIG. 6) and supply the multiplexed data to the analog to digital converter 18 (FIG. 6) for utilization in the time division analog to digital conversion operation and, moreover, receive and demultiplex digital data obtained by the analog to digital conversion operation from the converter 18 for loading the demultiplexed data in the corresponding registers 101–107. It should be noted, however, that the control circuit 118 corresponding to the register 108 for storing the initial touch detection has no multiplexing function (i.e., the function of feeding the data in the register 108 to the analog to digital converter 18).

In FIG. 6, the analog voltage multiplexer 16 receives at its control input the output signals H0–H7 from the decoder 29 in FIG. 3 and the initial sensing signal IS from the OR gate 90 in FIG. 4. The decoder 29 outputs, as the signals H0–H7, signals produced by decoding the bits $\overline{B2}$, $\overline{B1}$ and $\overline{N4}$ of the count value of the counter 13 (FIG. 3). The signals H0–H7 go to "1" one by one in the order shown in FIG. 9(*a*). The time during which one of the signals H0–H7 maintains "1" is eight key times and, accordingly, the signals H0–H7 circulate twice during one scanning cycle.

The multiplexer 16 normally samples the analog voltages of the potentiometers V1–V7 one by one in response to the signals H1–H7 and outputs them upon multiplexing. When the initial sensing signal IS is "1", sampling of the voltages V1–V7 by the signals H1–H7 is prohibited and the analog voltage from the initial touch sensitivity adjusting potentiometer V8 is continuously selected and outputted. The output voltage of the multiplexer 16 is supplied to an input B of an analog comparator 110 in the analog to digital converter 18. A normal analog to digital conversion operation by the converter 18 will be described first and then an analog to digital conversion of the initial touch detection signal will be described.

The analog to digital converter 18 includes a data register 100 consisting of an 8-stage/1-bit circulating type shift register which is controlled by system clock pulses $\phi_1$ and $\phi_2$. The normal analog to digital conversion operation in the converter 18 is performed on a time shared basis in accordance with the time division sampling of each analog voltage by the multiplexer 16. Digital data provided as a result of a preceding analog to digital conversion is initially loaded in the data register 100. The analog to digital conversion is effected by converting this preceding data to an analog voltage by a digital to analog conversion circuit 119, applying this analog voltage to the input A of the comparator 110 for comparison with the analog voltage from the multiplexer 16, and counting up or down the contents of the data register 100 in accordance with a result of this comparison.

The digital data provided as a result of the preceding analog to digital conversion is loaded from one of the registers 101–107 shown in FIG. 7 to the data register 100 immediately before each sampling timing. As a result, a signal N7.25T32 is applied from an AND gate 120 in FIG. 3 to AND gates 121, 122 and 123 in the control circuits 111–117 in FIG. 3. In FIG. 3, the AND gate 120 receives the output of the AND gate 42 and the timing signal 25T32. The AND gate 42 is enabled when the lowest three bits $\overline{N3}$, $\overline{N2}$ and $\overline{N1}$ of the count value of the counter 13 are "111". This indicates a last one key time in the respective signals H0–H7 used for the sampling of the analog voltages. The signal 25T32 maintains "1" during eight time slots from the twenty-fifth time slot to the thirty-second time slot in one key time. Accordingly, the signal N7.25T32 is "1" during last eight time slots of the respective signals H0–H7.

In FIG. 7, control circuits 111–117 are provided with the output signals H0–H7 of the decoder 29 (FIG. 3). The control circuits 111–117 control both the multiplexing and demultiplexing operations in response to these signals H0–H7 and the signal N7.25T32. The control circuits 111–117 respectively include multiplexing AND gates 124, 125, demultiplexing AND gates 126, 127 and holding AND gates 128, 129. In the last eight time slots of a certain sampling timing, stored data of a register (one of 101–107) corresponding to a next sampling timing is selected through the multiplexing AND gates 124, 125 and supplied to a data register 100 (FIG. 6) of the analog to digital converter 18 while data converted from analog data to digital one at this sampling timing is loaded in a register (one of 101–107) corresponding to this sampling timing through the demultiplexing AND gates 126, 127. The demultiplexing and multiplexing controls for these registers 101–107 are implemented during time other than the waiting time of about 10 ms for the initial touch detection. For this purpose, an inverted signal $\overline{IS}$ of the initial sensing signal IS is supplied from an inverter 130 to the AND gates 121, 122 and 123 of the control circuits 111–117 so as to enable these AND gates when the signal IS is "0". The AND gates 121, 122 and 123 also receive commonly the signal N7.25T32. The signals H0, H1 and H2 are respectively applied to the corresponding AND gates 121, 122 and 123 and the signals H3–H7 are respectively applied to AND gates in the respective control circuits 113–117 equivalent to the AND gate 123.

Figure 9:
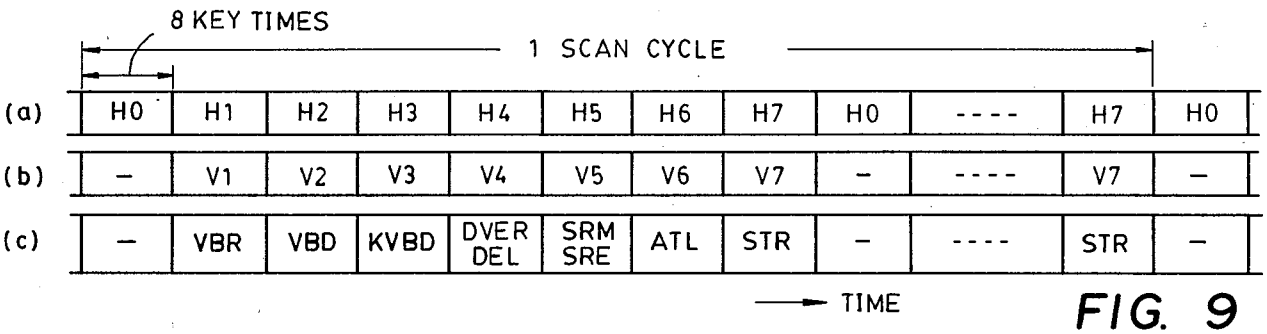
FIG. 9 is a time chart showing the time division state for analog to digital conversion by the circuitry shown in FIGS. 6 and 7.
Figure 10:
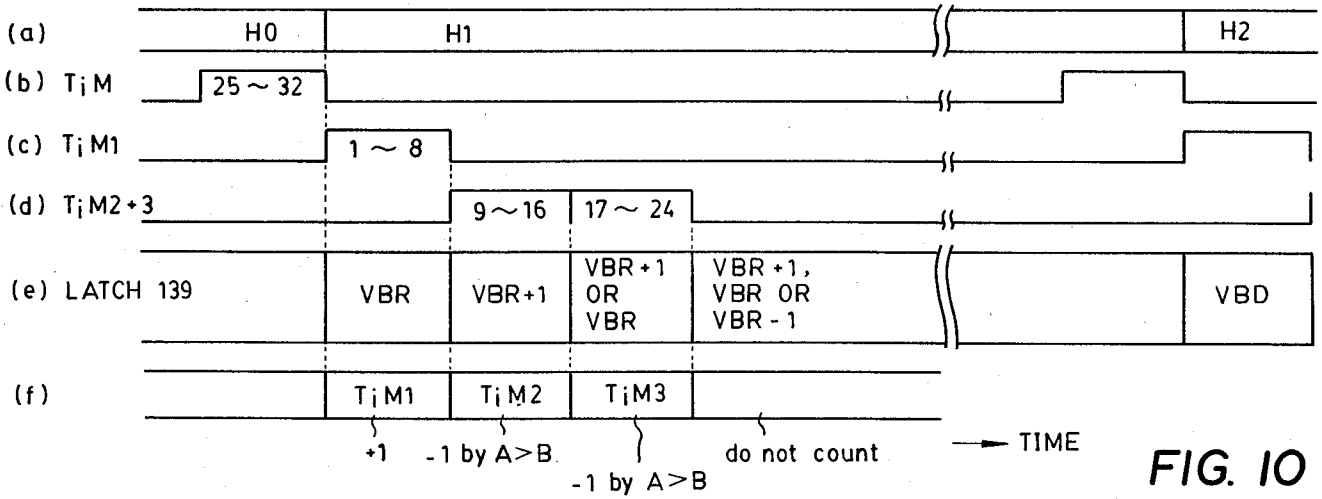
FIG. 10 is a time chart showing an example of the normal operation (other than when detecting the initial touch) of the analog to digital converter shown in FIG. 6.

When the signal H0 is "1", the analog voltage multiplexer 16 (FIG. 6) does not sample any of voltages of the potentiometers V1–V8 as shown in FIG. 9. Accordingly, the analog to digital converter 18 at this time does not perform the analog to digital conversion. Upon turning of the signal N7.25T32 to "1" in the last eight time slots of the signal H0, the AND gate 121 (FIG. 7) is enabled and a signal is supplied from this AND gate 121 to the AND gate 124 and an OR gate 131. An output signal TiM of the OR gate 131 therefore is generated as shown in FIG. 10(*b*). FIG. 10(*a*) shows the timing changing from the signal H0 to the signal HI in an enlarged scale. The OR gate 131 receives at another input thereof outputs of the AND gates 122 and 123 of the control circuits 111–117 equivalent to the AND gate 121. Figures such as "25–32" in the pulses appearing in the time chart of FIG. 10 and other time charts indicate the order of the time slot.

The AND gate 124 receives at another input thereof serial eight-bit digital data outputted from the last stage of the register 101. This serial digital data is arranged in the order of the least significant bit (LSB) to the most significant bit (MSB) in the twentyfifth to the thirtysecond time slots. By enabling of the AND gate 124 during eight time slots which are the same duration as the signal TiM shown in FIG. 10(*b*), the eight-bit digital data stored in the register 101 is sampled by the AND gate 124 in synchronism with this signal TiM and thereafter is supplied to an OR gate 132. An output ODD (old digital data) of the OR gate 132 is supplied to the analog to digital converter 18 shown in FIG. 6 and is loaded to the data register 100 through an OR gate 133 and an adder 134. Accordingly, when the next sampling signal H1 rises to "1", data (indicated by VBR) of the register 101 has been transferred to the data register 100. To the OR gate 132 (FIG. 7) are applied the outputs of the multiplexing AND gates 124 and 125 of the control circuits 111–117. If data of the respective registers 101–107 are indicated by VBR, VBD, KVBD, DVER (or DEL), SRM, SRE, ATL and STR, data outputted from the data register 100 at the beginning of each sampling timing is as shown in FIG. 9(*c*). That is, a digital conversion result at the preceding sampling timing of analog voltages of the respective potentiometers V1–V7 sampled as shown in FIG. 9(*b*) is outputted from the data register 100 in synchronism with the present sampling timing of the same potentiometers V1–V7.

On the other hand, the signal TiM outputted from the OR gate 131 in FIG. 7 is supplied to the analog to digital converter 18 in FIG. 6. This signal TiM is inverted by an inverter 135 and thereby disables an AND gate 136. The AND gate 136 is provided for holding the data of the data register 100. If the old data ODD is loaded, the holding of the register 100 is prohibited by the signal TiM. The signal TiM is applied to a three-stage delay flip-flop (shift register) 137. This flip-flop 137 has an input signal loaded at the timing signal 6y8 and changes its output in synchronism with the signal 1y8. Accordingly, the output signal TiM1 of the first stage goes to "1" during the first through eighth time slots at the rising of the signal H1 as shown in FIG. 10(*c*) . A signal TiM2+3 produced by combining outputs of the second and third stages is "1" as shown in FIG. 10(*d*) during the ninth to twentyfourth time slots immediately after rising of the signal TiM1.

In FIG. 6, the data register 100, together with a full adder 134 for one bit, constitutes an eight bit serial counter. A latch circuit 139 is provided for latching outputs (i.e., count values) of respective stages of the register 100 in parallel at a timing of the signal 1y8S. At the first, ninth, seventeenth and twentyfifth time slots at which the signal 1y8S is generated, the data from MSB to LSB is arranged in the first through eight stages of the register 100 and this data is latched in the latch circuit 139. As shown in FIG. 10(*e*), the contents of the latch circuit 139 indicate data VBR of the register 101 (FIG. 7) during eight time slots at the rising of the signal H1. The contents of this latch circuit 139 change every eight time slots in accordance with the count value (contents of the register 100).

The output of the latch circuit 139 is supplied to the digital to analog conversion circuit 119 converted to an analog voltage therein. The comparator 110 compares the input A with the input B and, when $B \geqq A$, i.e., value of the analog voltage applied from the multiplexer 16 to the input B is equal to or larger than the value of the data of the data register 100, outputs a signal "1". This output of the comparator 110 is supplied to a delay flip-flop 140 and outputted therefrom after being delayed by eight time slots in synchronism with the signal 1y8. The output of the flip-flop 140 is inverted by an inverter 141 and thereafter is applied to an AND gate 142 for downcounting. The output of the flip-flop 140 is applied to an AND gate 143 for upcounting during the initial touch detection. An AND gate 144 is provided for upcounting during the normal analog to digital conversion.

The inverted signal $\overline{IS}$ of the initial sensing signal IS is supplied from the inverter 130 in FIG. 7 to the analog to digital converter 18 in FIG. 6. This signal $\overline{IS}$ is applied to the AND gates 142 and 144 to enable these AND gates 142 and 144 during a period of time other than the initial touch detection, i.e., during the normal analog to digital conversion operation. A signal IS which is produced by inverting the signal $\overline{IS}$ by an inverter 145 is applied to the AND gate 143, enabling the AND gate 143 during the initial touch detection.

During the normal analog to digital conversion operation, the contents of the data register 100 are counted up by one at the timing of the signal TiM1 regardless of a result of comparison performed in the comparator 110. In other words, the signals TiM1 and 1y8 are applied to the AND gate 144 and the output of the AND gate 144 goes to "1" at the first time slot at which the signal TiM1 rises. The output "1" of the AND gate 144 is applied to the input A of the adder 134 through an OR gate 146. When the signal TiM1 is "1", the signal TiM is "0" and the output of the data register 100 is applied to the input B of the adder B4 through the AND gate 136 and the OR gate 133. At the timing of the signal 1y8, the least significant bit of the data VBR loaded in the register 100 is applied to the input B of the adder B4. Accordingly, "1" is added to the least significant bit. If there is a carry out signal, a signal "1" is outputted from the carry out output Co+1 with a delay of one time slot and applied to an input Ci through an AND gate 147. For preventing addition of the carry out signal at the timing of the least significant bit, the AND gate 147 is disabled by the signal 1y8. In the foregoing manner, "1" is added to the preceding data VBR in the section of the signal TiM1 shown in FIG. 10(*f*). The result of the addition "VBR+1" is latched by the latch circuit 139 during a section of a next signal TiM2 (FIG. 10(*e*)).

In the section of TiM2 shown in FIG. 10(*f*), an analog voltage (A) of the data VBR+1 is compared with a present analog voltage (B) of the potentiometer 1 in the comparator 110. If the result of the comparison is "B≧A", "VBR+1" is held in the register 100 without conducting addition or subtraction. If the result is now "B≧A", i.e., "A>B", 1 is subtracted from the data "VBR+1". In the case of "A>B", the output of the delay flip-flop 140 is "0" and a signal "1" is supplied to the AND gate 142 from the inverter 141. The AND gate 142 also receives a signal TiM2+3 from the OR gate 138 so that it is enabled in the sections TiM2 and TiM3 (FIG. 10(*f*)). When the AND gate 142 is enabled in the section TiM2, the output of the AND gate 142 is "1" during the section TiM2 (eight time slots). This output "1" of the AND gate 142 is applied to the input A of the adder 134 through the OR gate 146. Accordingly, "1" is added to all bits of the data "VBR+1" of the register 100 with a result that a substantial count down of 1 is effected. Accordingly, the value of the data produced in the register 100 by the operation during the section TiM2 is either "VBR+1" or "VBR (=VBR+1-1)". This data is latched by the latch circuit 139 in the section TiM3 (FIG. 10(*e*)).

In the section TiM3, the data "VBR+1" or "VBR" of the latch circuit 139 is compared with the present analog voltage of the potentiometer V1 in the comparator 110. If the result of the comparison is "B≧A", the present value "VBR+1" or "VBR" of the register 100 is held without addition or subtraction. If the result is "A>B", a signal "1" is outputted from the AND gate 142 and 1 is subtracted from the data of the register 100 in the same manner as was described above. By this second subtraction, the data of the register 100 becomes "VBR-1 (=VBR+1-1-1)".

Upon ending of the section TiM3, the signal TiM2+3 falls and the AND gate 142 is disabled. A subsequent counting operation therefore is stopped. Thus, the analog to digital conversion is made only during three sections of TiM1–TiM3 (24 time slots).

If the value (A) of the data VBR which was obtained by the preceding analog to digital conversion coincides with the set value (B) of the potentiometer V1 which has been sampled this time, the result of the comparison becomes A>B in the section TiM2 by increase of the contents of the register 100 to "VBR+1" by the addition of 1 in the section TiM1 and thereupon the contents of the register 100 become VBR by the subtraction of 1. In the comparison in the section TiM3, A=B is obtained so that no subtraction of 1 is made. Consequently, the data "VBR" which is the same as the preceding data is finally held in the register 100.

If the set value (B) of the potentiometer V1 which has been sampled this time is larger than the value (B) of the data VBR which was obtained by the preceding analog to digital conversion, only B=A or B>A is obtained in the comparator 110 even if the contents of the register 100 become "VBR+1" by the addition of 1 in the section TiM1. Accordingly, subtraction is not made in the sections TiM2 and TiM3 and "VBR+1" is finally held in the register 100.

If the set value (B) of the potentiometer V1 which has been sampled this time is smaller than the value (A) of the data VBR which was obtained in the preceding analog to digital conversion, A>B is always obtained in the sections TiM2 and TiM3. Accordingly, the subtraction of 1 is made twice after the addition of 1 and "VBR-1" is finally held in the register 100.

As described above, the maximum amount of change of the digital data in one sampling period (about 1 ms) is limited to ±1. This limitation is posed for preventing an abrupt and sharp change in the analog set values by the potentiometers V1–V7 because a direct response to such abrupt change will cause an unpleasant noise such as clicking. The limitation is also posed for preventing reaction to a temporary abrupt change in the analog set valves caused by noise or other factors. The maximum amount of change of the digital data in one sampling period has not necessarily to be ±1 but may be a suitable amount which will enable a smooth analog to digital conversion.

In this embodiment, the addition and subtraction are performed in the three sections of TiM1, TiM2 and TiM3 in one analog to digital conversion. This serves to prevent a random variation in the digital data when the output of the comparator 110 is unstable due to noise or other factors. If, for example, the result B≧A has been obtained in the section TiM2 whereas the same result is not obtained in the section TiM3, the final digital data does not change owing to +1 in the section TiM1 and −1 in the section TiM3.

An AND gate 148 and a NOR gate 149 (FIG. 6) to which all outputs of the latch circuit 139 are applied are provided for detecting a maximum count and a minimum count.

Upon reaching of the maximum count, the AND gates 143 and 144 are disabled by the output of the AND gate 148 thereby prohibiting upcounting. Upon reaching of the minimum count, the AND gate 142 is disabled by the output of the NOR gate 149 thereby prohibiting downcounting.

Reverting to the description of the state in which the sampling signal H1 is generated, after ending of the section TiM3, digital data resulting from the analog to digital conversion is held circulatingly by the data register 100 through the input B of the AND gate 136, the OR gate 133 and the input B of the adder 134. The data of this register 100 is supplied to the demultiplexing AND gates 126 and 127 of the control circuits 111–117 in FIG. 7 as new digital data NDD. When the signal H1 is "1", the AND gate 122 of the control circuit 111 is still not enabled while the signal N7.25T32 is "0" and the output of the AND gate 122 is "0". This output "0" of the AND gate 122 is inverted by an inverter 150 and thereafter is supplied to the AND gate 128 provided for the holding purpose. The data VBR of the register 101 is circulatingly held through the AND gate 128 and the OR gate 151.

Upon turning of the signal N7.25T32 to "1" at the last eight time slots of the signal H1, the AND gate 122 is enabled and the output "1" is supplied from the AND gate 122 to the AND gate 126. Simultaneously, the output "1" of the AND gate 122 is applied to the multiplexing AND gate 125 of the control circuit 112 corresponding to the next sampling signal H2 and also applied to the OR gate 131. In the control circuit 111, the holding AND gate 128 is disabled and the AND gate 126 is enabled by the output "1" of the AND gate 122. Accordingly, the new digital data NDD representing the set value of the potentiometer V1 which data has been digital-to-analog converted at a timing of the signal H1 is selected by the AND gate 126 and is loaded in the register 101 through the OR gate 151. The AND gate 122 outputs "1" during the twentyfifth through thirtysecond time slots. The data NDD outputted from the data register 100 (FIG. 6) during this period of time consists of serially arranged eight bits from lower bits to the most significant bit and, accordingly, the new digital data NDD is sequentially loaded in the register 101 during the twentyfifth through the thirtysecond time slots. Weights of the respective stages of the register 101 at the first time slot are such that the bit goes to a lower bit as the stage progresses, with the most significant bit (16/3 Hz) being for the first stage and the least significant bit (1/24 Hz) being for the eighth stage.

In response to the output "1" of the AND gate 122, the signal TiM is outputted from the OR gate 131 and the data VBD of the register 102 is supplied to the analog to digital converter 18 (FIG. 6) through the AND gate 125 and the OR gate 132 as the old digital data ODD. As the sampling signal is changed to H2, the analog to digital conversion concerning the potentiometer V2 is made in the same manner as described before. The control circuits 112–117 operate in the same manner in response to the signals H2–H7 and the analog to digital conversion relating to the potentiometers V1–V7 is made one by one. Thus, digital data corresponding to each of the outputs of the potentiometers V1–V7 is stored in each of the registers 101–107.

There are two data indications DVER and DEL of the register 104 corresponding to the delay vibrate (the potentiometer V4) for the reason that the potentiometer V4 is used concurrently for setting of the starting time of delay vibrato and setting the inclination of the envelope of the delay vibrato depth variation. The reference characters DVER denotes delay vibrato envelope rate data for setting a speed of timewise variation of the delay vibrato depth with its weight being indicated in the lower line of blocks representing respective stages of the register 104. The unit of the weight is Hz, for the rate of the envelope variation is shown in a speed expressed in frequency. In other words, time from starting of the envelope to ending thereof corresponds to a quarter period of the frequency indication. The reference characters DEL denotes delay vibrato starting time data with its weight being indicated in the upper line of blocks representing respective stages of the register 104. The two data DVER and DEL do not differ in their truth-values but differ only in weighting on the user's side.

There are two data indications SRM and SRE of the register 105 corresponding to the slur speed (the potentiometer V5) for utilizing the eight bit data by dividing it into mantissa and exponent for obtaining a broadest possible dynamic range. More specifically, the least significant bit is not used, the second through fifth bits counting from the least significant bit constitute mantissa M1, M2, M3 and M4 and the three highest bits constitute exponent E1, E2 and E3. The reference characters SRM denotes data indication of the slur rate mantissa whereas the reference characters SRE denote data indication of the slur rate exponent.

Figure 11:
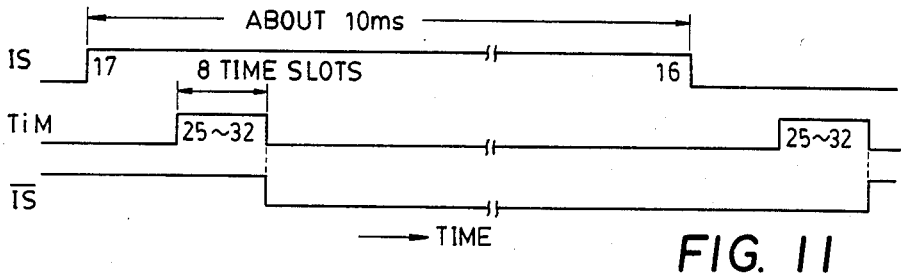
FIG. 11 is a time chart depicting the generations of the main signals at the time of initial touch detection by the circuitry shown in FIGS. 6 and 7.

The initial sensing signal IS outputted from the OR gate 90 in FIG. 4 is applied to a delay flip-flop 152 in FIG. 7. The two-stage delay flip-flop 152 has an input signal loaded therein by the signal 6y8 and changes its output state in synchronism with the signal 1y8. The output of the first stage of the delay flip-flop 152 is applied to an AND gate 153 and also to an AND gate 154 after being inverted by the inverter 130. This output of the inverter 130 is supplied to the analog to digital converter 18 in FIG. 6 as the signal $\overline{IS}$. The AND gate 153 outputs a pulse having a width of eight time slots in response to the rising of the signal IS whereas the AND gate 154 outputs a pulse having a width of eight time slots in response to the falling of the signal IS. The outputs of the AND gates 153 and 154 are applied to the OR gate 131 and thereafter supplied to the analog to digital converter 18 in FIG. 6 as the signal TiM. The signals TiM and $\overline{IS}$ which are generated in response to the signal IS are shown in FIG. 11.

Referring to FIG. 6, the AND gate 136 is disabled during eight time slots during which the signal TiM goes to "1" in response to the rising of the signal IS and all bits of the data register 100 thereby are cleared to "0". Further, by turning of the signal $\overline{IS}$ to "0", the control circuits 111–117 in FIG. 7 are disabled and the registers 101–107 circulatingly hold their stored data. Simultaneously, the AND gates 142 and 144 in FIG. 6 are disabled and the AND gate 143 is enabled. During the first eight time slots after the enabling of the AND gate 143, the signal TiM which is produced by delaying the signal TiM by eight time slots is "1" so that the operation of the AND gate 143 is prohibited by the output "0" of an inverter 156. This is for waiting for stabilization of states of the respective signals at the rising of the signal IS but this arrangement is not indispensable. The AND gate 143 receives at other inputs thereof the signal 1y8 and the output of the delay flip-flop 140. Accordingly, upon satisfaction of "B≧A" in the comparator 110, a signal "1" is outputted from the AND gate 143 at the timing of the signal 1y8 and supplied to the input A of the adder 134 through the OR gate 146. As described above, the timing of the signal 1y8 is the timing of the least significant bit of the data of the register 100. Accordingly, the contents of the data register 100 are counted up by one each time one pulse is provided from the AND gate 143 at the timing of the signal 1y8 (every 4 microseconds).

As was previously described, the analog voltage of the potentiometer V8 is continuously selected by the multiplexer 16 when the initial sensing signal IS is being generated. A touch detection signal which has been adjusted in sensitivity by the potentiometer V8 therefore is exclusively supplied to the input B of the comparator 110. Since the data register 100 is cleared to all "0", "B≧A" is initially satisfied in the comparator 110. The contents of the register 100 are counted up rapidly each time the signal ly8 is generated until the value in the data register 100 coincides with the value of the touch detection signal. Upon coincidence of the count of the data register 100 with the value of the touch detection signal, "B=A" is satisfied in the comparator 110. The contents of the register 100 are further counted up and thereafter "B<A" is satisfied in the comparator 110 resulting in disabling of the AND gate 143 and stopping of counting. Since no downcounting of the data register 100 is made even if the level of the touch detection signal drops thereafter, the peak value is maintained. In a case where the touch detection signal has become further larger than the value of the data register 100, "B≧A" is satisfied in the comparator 110 and an additional upcounting is performed. In the foregoing manner, digital data corresponding to the peak value of the touch detection signal during the generation of the initial sensing signal IS is held in the data register 100. The data of the peak value held in the data register 100 is supplied to an AND gate 157 in the control circuit 118 in FIG. 7.

As the initial sensing signal IS falls upon lapse of about 10 ms from the start of key depression, the output of the AND gate 154 goes to "1" during eight time slots in synchronism with the twentyfifth to thirtysecond time slots. This output "1" of the AND gate 154 is applied to an AND gate 158. The AND gate 158 receives at another input thereof an output XKQS of the flip-flop XKQ in FIG. 4 through a two-stage delay flip-flop 159. This delay flip-flop 159 is provided for synchronizing its output with the output timing of the delay flip-flop 152. The AND gate 158 outputs a signal "1" during eight time slots on condition that some key is being depressed at the ending of the initial touch detection time, i.e., the signal XKQS is "1".

The AND gate 157 is enabled by the output "1" of the AND gate 158 to gate out the peak value data (NDD) of the touch detection signal held in the data register 100 (FIG. 6) and, causing the peak value data to be loaded in the register 108 through an OR gate 160. The peak value data held in the data register 100 is cleared by the signal TiM supplied from the OR gate 131 to the inverter 135 in FIG. 6. Within eight time slots during which the output of the AND gate 154 is "1", loading of the peak value data corresponding to the register 108 (FIG. 7) is completed. Upon falling of the output of the AND gate 154 to "0", an AND gate 161 is enabled in lieu of the AND gate 157. The peak value data of the touch detection signal loaded in the register 108 is held thereafter through this AND gate 161. In this manner, the initial touch detection data is held in the register 108.

There are two data indications API and ITL of the register 108 for utilizing the same initial touch detection data for the attack pitch control and the initial touch level control. The reference characters API denote the attack pitch initial value setting data with its weight being indicated on the upper line of blocks representing the respective stages. The lowest three bits are discarded and the remaining five bits correspond to pitch deviations of 1.2 cent to 19 cents. The reference characters ITL denotes the initial touch level control data.

Figure 12:
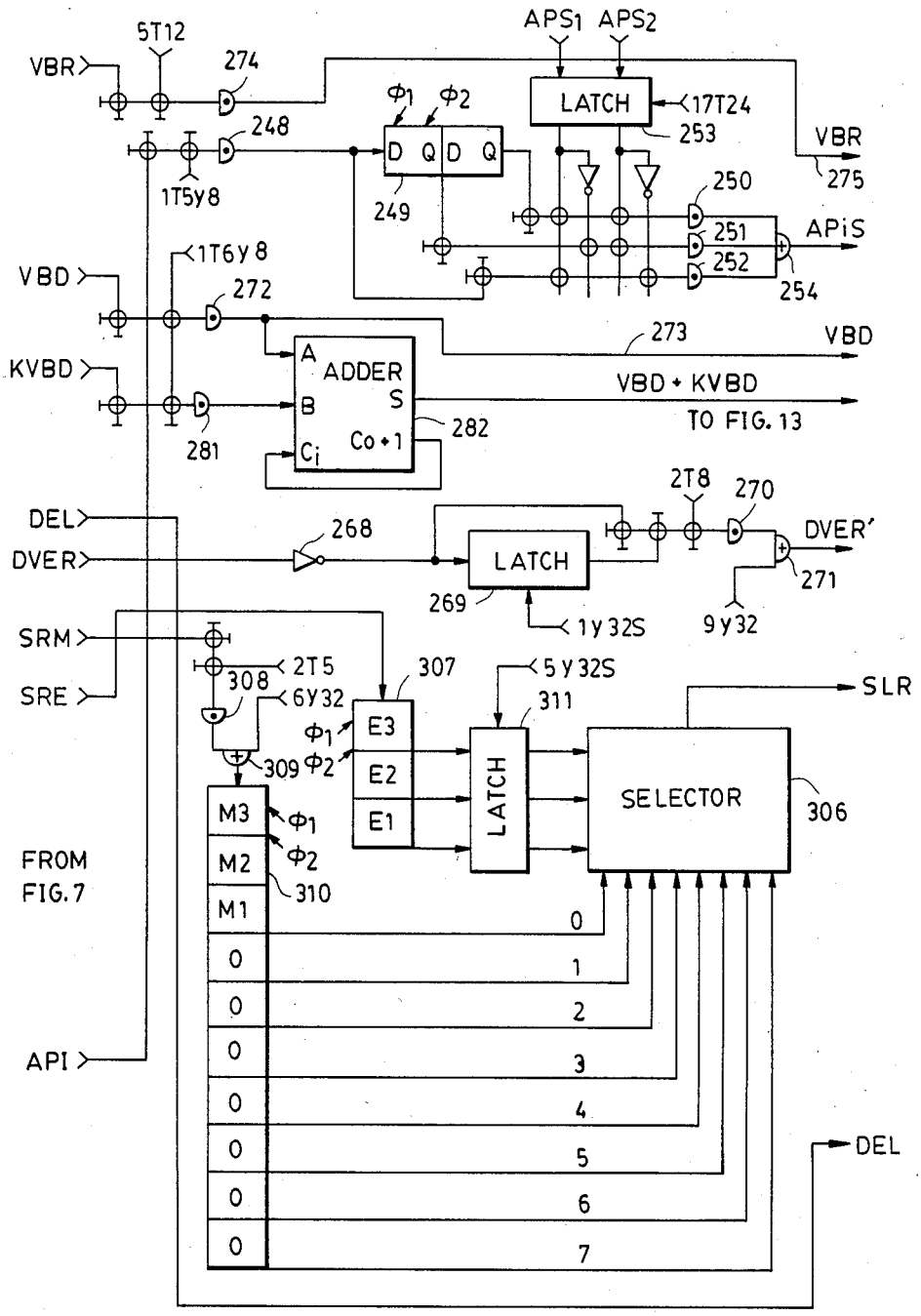
FIGS. 12, 13 and 14 are circuit diagrams, each showing one of the three portions into which an example given in detail of the tonal effect imparting circuit is divided.

Among data stored in the registers 101–108 in FIG. 7, data for the pitch control, i.e., vibrato rate data VBR, vibrato depth data VBD, after touch vibrato depth data KVBD, delay vibrato envelope rate data DVER, delay vibrato start time data DEL, slur rate mantissa data SRM, slur rate exponent data SRE and attack pitch initial value setting data API are supplied to the tonal effect imparting circuit 20 (FIG. 12). Data for the level control, i.e., after touch level , control data ATL, sustain level data STR and initial touch level control data ITL are supplied to the tone signal generation section 21 (FIG. 2).

Description of the Tonal Effect Imparting Circuit

Figure 13:
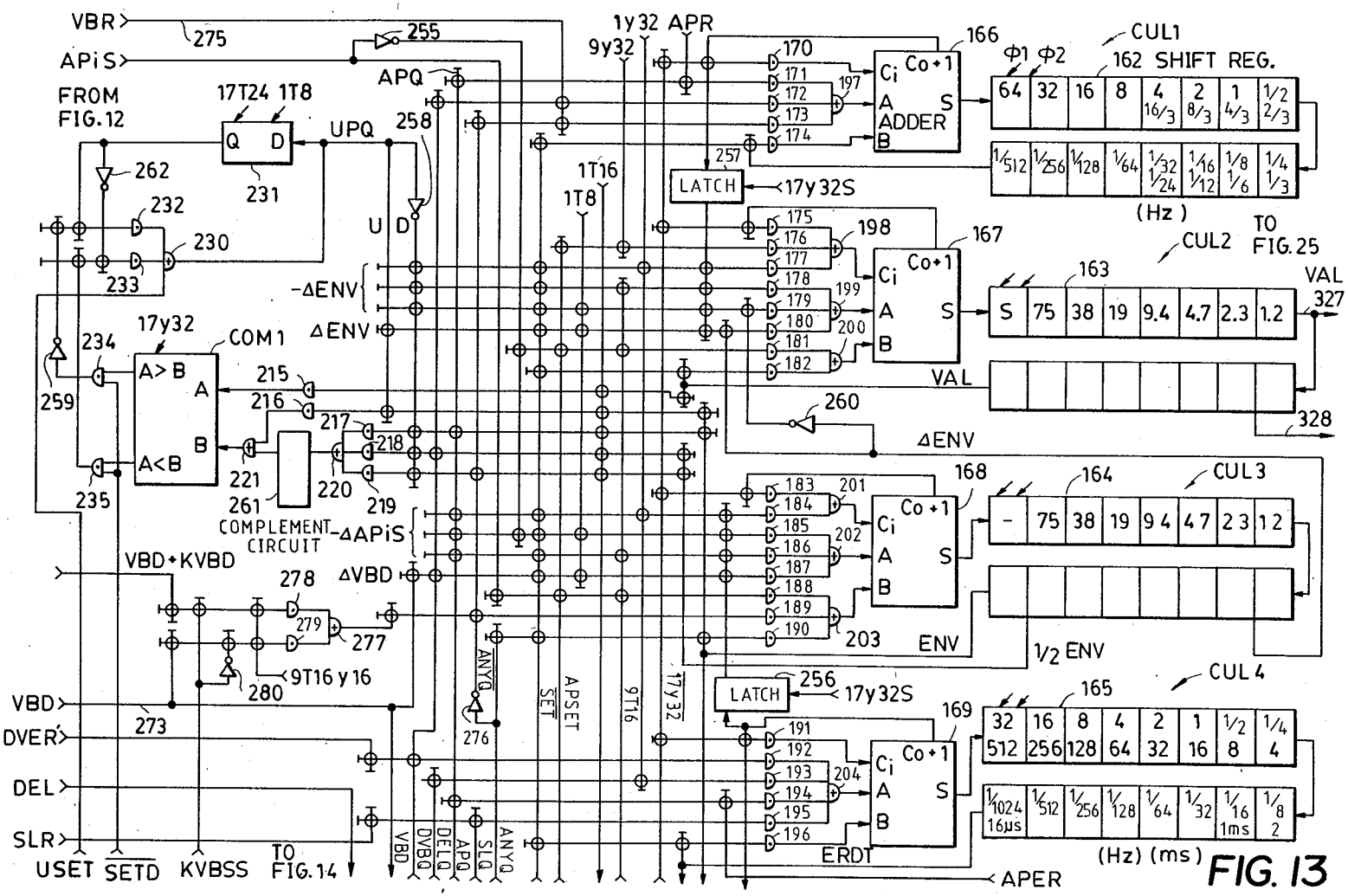
Figure 14:
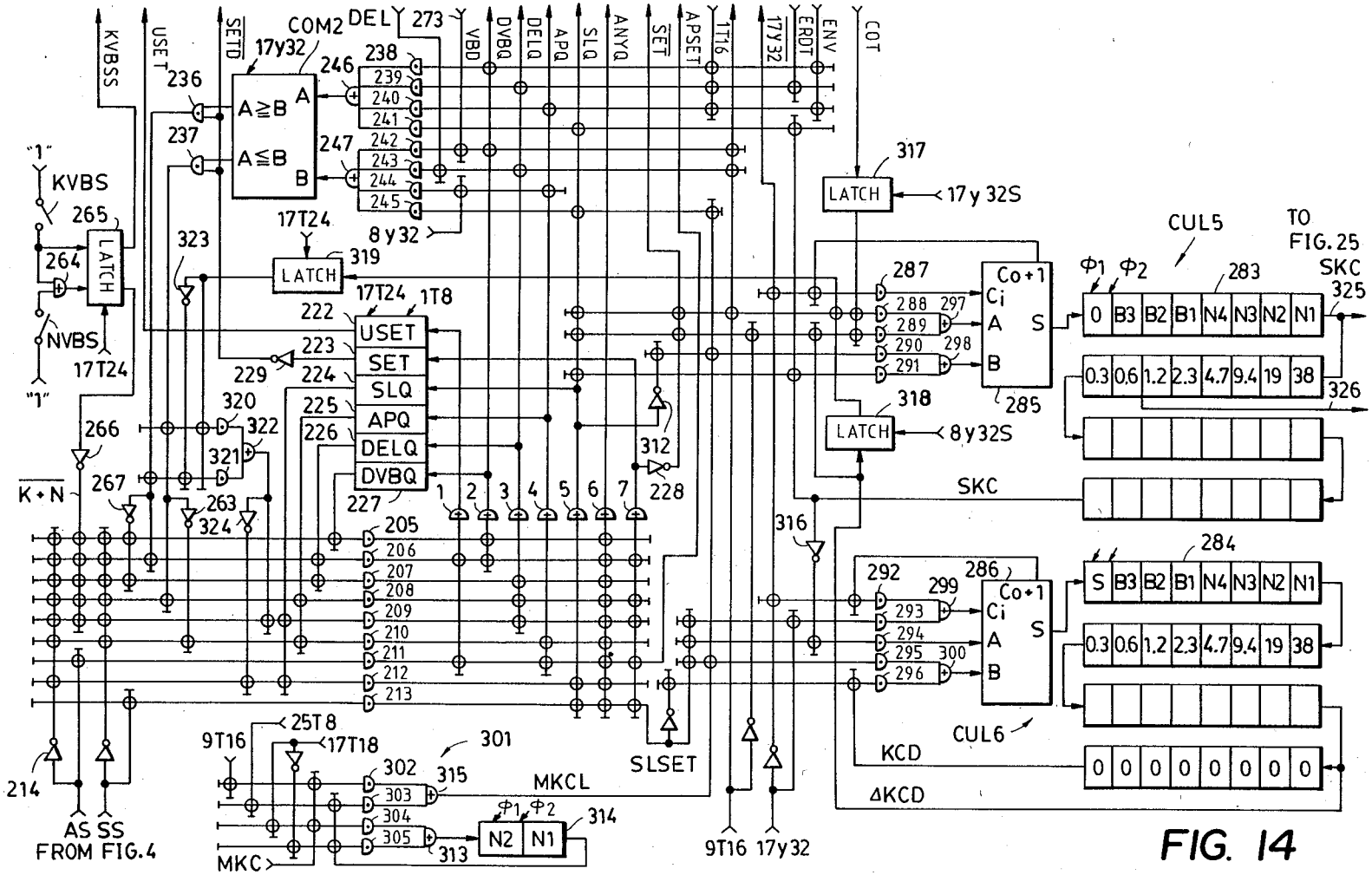

For convenience of illustration, a specific example of the tonal effect imparting circuit 20 is illustrated in three portions in FIGS. 12, 13 and 14. The respective figures are combined together as shown in the block of the circuit 20 in FIG. 2.

In the tonal effect imparting circuit 20, processings for forming modulating signals for the attack pitch control, delay vibrato, after touch vibrato and normal vibrato and processing for modulating key code MKC of a depressed key in the monophonic mode are implemented. The portion of the circuit 20 for forming the modulating signals for attack pitch and vibrato will be described first.

The tonal effect imparting circuit 20 includes four calculators CUL1, CUL2, CUL3 and CUL4 shown in FIG. 13. The calculators CUL1–CUL4 include 16-stage/1-bit serial shift registers 162, 163, 164 and 165 which are shift-controlled by the system clock pulses $\phi_1$ and $\phi_2$, full adders 166, 167, 168 and 169 for one bit, and logics 170–196 (AND gates) and 197–204 (OR gates) for controlling computation and storing operations and performs serial operation. The calculator CUL2 obtains data VAL representing an instantaneous value of the modulating signals. The calculator CUL1 repeatedly calculates data representing frequency of the modulating signal and generate a signal representing a calculation timing in the calculator CUL2. The calculator CUL3 obtains data ENV representing an instantaneous value of the envelope (depth) of the modulating signals. This data ENV is shifted by a predetermined number of bits and utilized as a small value ΔENV representing an increment value of the modulating signals. In the calculator CUL2, the data VAL representing the instantaneous value of the modulating signals is obtained by repeatedly calculating this increment value ΔENV in response to the timing signal from the calculator CUL1. The calculator CUL4 is used for various purposes as well be described later.

Figures 15A, 15B:
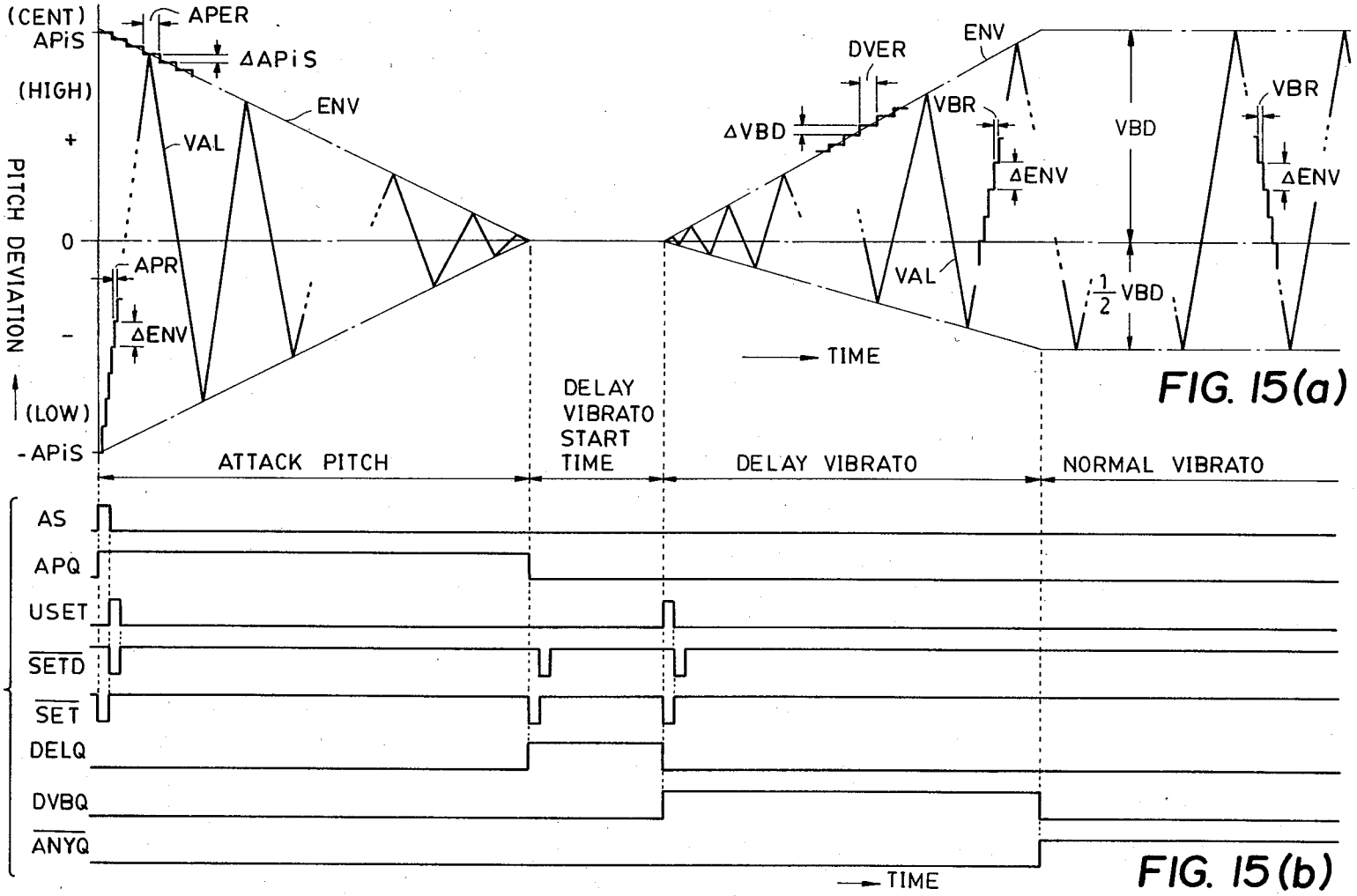
FIG. 15 (*a*) is a diagram showing examples of the modulating signal and its envelope in the attack pitch control, delay vibrato control, and normal vibrato control.

FIG. 15(*a*) shows an example of modulating signals and an envelope (depth) of the attack pitch, delay vibrato and normal vibrato. With reference to this figure, an outline of forming of these modulating signals will be described. In FIG. 15(*a*), the horizontal axis indicates time and the vertical axis the pitch deviation from a nominal frequency (0 cent) in cents.

An initial value of the attack pitch is "−APiS" which is a negative value (i.e., pitch deviation of the nominal frequency on the lower tone side). An absolute value "APiS" of this attack pitch initial value is obtained by multiplying the attack pitch initial value setting data API provided from the register 108 (FIG. 7) with an attack pitch initial value coefficient APS provided from the ROM 22 (FIG. 2). As was described previously, the data API corresponds to the initial touch of a key and, accordingly, the attack pitch initial value APiS is controlled in accordance with the initial touch. An initial value of the envelope in the attack pitch is the same as the attack pitch initial value APiS. The value APiS is preset in the calculator 3 (FIG. 13) as an initial value of the envelope instantaneous value ENV. Thereafter, the instantaneous value ENV of the gradually decaying envelope is obtained by repeatedly subtracting thereafter a small value ΔAPiS obtained by shifting this initial value APiS to a lower digit side by n bits (i.e., multiplied by $2^{-n}$) at a time interval according to the attack pitch envelope rate data APER which corresponds to the tone color provided by the ROM 22 (FIG. 2). The envelope rate data APER is regularly accumulated in the calculator CUL4 and the time interval of repetition in the subtraction in the calculator CUL3 is determined in accordance with the timing of generation of a carry out signal from the most significant bit of the calculator CUL4. Since the small value ΔAPiS corresponds to the initial touch, the envelope of the attack pitch is controlled in accordance with the initial touch. On the other hand, the value "−APiS" is preset in the calculator CUL2 as an initial value of the instantaneous value VAL of the modulating signal and the instantaneous value VAL of the modulating signal is obtained by repeatedly adding or subtracting a small value ΔENV obtained by shifting the envelope instantaneous value ENV to a lower digit side by n bits (i.e., multiplied by $2^{-n}$) at a time interval according to the attack pitch rate data APR which corresponds to the tone color provided by the ROM 22 (FIG. 2). Since the initial value of the instantaneous value VAL is the negative value −APiS, addition is initially made to increase the value VAL gradually. Upon reaching of the value VAL to the envelope value ENV, the addition is replaced by subtraction. Addition and subtraction thereafter are made alternately so that the value VAL is repeatedly folded within the range of the envelope value ENV. The rate data APR is regularly accumulated in the calculator CUL1 and the time interval of the addition or subtraction in the calculator CUL2 is determined in accordance with the timing of generation of a carry out signal from the most significant bit of the calculator CUL1. The attack pitch control is completed upon reaching of the envelope value ENV to 0 cent.

Upon completion of the attack pitch or slur, the calculator CUL4 counts time until starting of the delay vibrato. When the counted time coincides with the delay vibrato start time DEL stored in the register 104 (FIG. 7), the delay vibrato is started.

The envelope (depth) in the delay vibrato starts from 0 cent and increases gradually to a cent value corresponding to the vibrato depth data VBR provided by the register 102 (FIG. 7). In the calculator 3, the gradually increasing envelope instantaneous value ENV is obtained by repeatedly adding a small value ΔVBD obtained by shifting the depth data VBD to a lower digit side by n bits at a time interval according to the delay vibrato envelope rate data DVER provided by the register 104 (FIG. 7). A value corresponding to the envelope rate data DVER is accumulated in the calculator CUL4 and the calculation time interval in the calculator CUL3 is set by a carry out signal from the calculator CUL4. In the calculator CUL2, the instantaneous value VAL of the modulating signal is obtained by repeatedly adding or subtracting a small value ΔENV obtained by shifting the envelope instantaneous value ENV at a time interval according to the vibrato rate data VBR provided by the register 101 (FIG. 7). The vibrato rate data VBR is accumulated in the calculator CUL1 and the calculation time interval in the calculator CUL2 is set by a carry out signal of the calculator CUL1.

Upon reaching of the envelope instantaneous value ENV of the calculator CUL3 to a cent value corresponding to the depth data VBD, the delay vibrato is completed and the normal vibrato is started. In the normal vibrato, a constant envelope value ENV corresponding to the depth data VBD is held in the calculator CUL3 while the calculators CUL1 and CUL2 perform the same operation as in the above described delay vibrato. Although not shown in FIG. 15(*a*), in the after touch vibrato, the envelope value ENV of the calculator CUL3 is made to be a value corresponding to the after touch vibrato depth data KVBD provided by the register 103 (FIG. 7) and the calculators CUL1 and CUL2 are operated in the same manner as in the delay vibrato or normal vibrato. In the present embodiment, if the normal vibrato or the after touch vibrato is selected by a player, the delay vibrato is not applied. Further, in the present embodiment, the depth of the pitch deviation in the delay vibrato, normal vibrato and after touch vibrato is asymmetrical if a higher tone side is compared with a lower tone side. More specifically, the depth on the lower tone side is ½VBD relative to the depth VBD on the higher tone side. Such asymmetrical depth setting has been found to bring about a desirable vibrato effect closely resembling vibrato in a natural musical instrument.

In the calculators CUL1–CUL4 in FIG. 13, a serial calculation is performed in the section from the first through sixteenth time slots. The 16-bit data in the registers 162–165 is outputted bit by bit from the least significant bit in the section from the first through sixteenth time slots. Results of the serial calculation of the respective bits are outputted from the adders 166–169 during the first through sixteenth time slots and loaded in the registers 162–165. The data in the registers 162–165 therefore circulate every 16 time slots. For preventing addition of a resulting from calculation of the most significant bit at the sixteenth time slot to the least significant bit data appearing at the seventeenth time slot, a signal $\overline{17y32}$ is applied to AND gates 170, 175, 183 and 191 provided for supplying carry out outputs Co+1 from the adders 166–169. This signal $\overline{17y32}$ which is an inverted signal of a signal 17y32 is "0" at the seventeenth time slot and "1" at other time slots.

In FIG. 13, numerals in respective stages of the shift registers 162–165 indicate weights of data in the respective stages at the first and seventeenth time slots. Units of weights are "Hz" in the register 162, "cent" in the registers 163 and 164, "Hz" in the upper line in the register 165 and "ms" in the lower line therein. The weight indication in the upper line in the register 162 indicates weight in the case of using the calculator CUL1 for accumulating the attack pitch rate data APR. For example, "1" in the seventh stage indicates weight of 1 Hz. The weight indication in the lower line in the register 162 indicates weight in the case of using the calculator CUL1 for accumulating the vibrato rate data VBR. For example, "4/3" in the seventh stage indicates 4/3 Hz. The weight in the attack pitch is made different from the weight in the vibrato for setting the above described asymmetrical depth. The weight indication in the upper line in the register 165 indicates weight in the case of using the calculator CUL4 for accumulating the envelope rate data APER and DVER (further SLR). The weight indication in the lower line indicates weight in the case of using the calculator CUL4 for counting the delay vibrato start time. The reference character "S" in the first stage of the register 163 indicates a sign bit. The sign bit S exists for distinguishing a positive value from a negative value, for the instantaneous value of the modulating signal becomes a negative value also. The negative value is expressed by two's complement. The respective controls will be described in detail hereunder.

(1) Attack pitch control

For controlling the operations of the respective calculators CUL1–CUL4 shown in FIG. 13, delay flip-flops 222–227 are provided as shown in FIG. 14. These flip-flops 222–227 receive input signals at a timing of a signal 1T8 (FIG. 5) and change output states thereof at a timing of a signal 17T24 (FIG. 5). The flip-flops 222, 223 and 225 among these flip-flops are operated in the attack pitch control operation.

Figure 16:
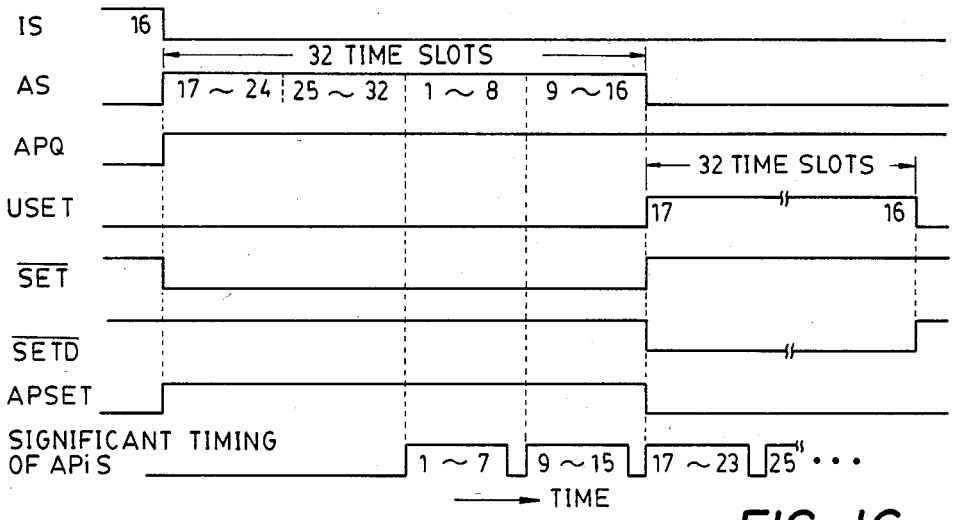
FIG. 16 is a time chart illustrating various signals shown in FIGS. 12 through 14 at the start of the attack pitch control.

As described previously, upon satisfaction of the conditions for effecting the attack pitch control, an attack pitch start signal AS is outputted from a monophonic key assigner 14A (FIG. 4) in response to rising of the initial sensing signal IS. This attack pitch start signal AS is applied to an AND gate 211 and also is inverted by an inverter 214 shown in FIG. 14. The output of the inverter 214 is applied to AND gates 205–209 and 212. As shown in FIG. 16, the initial sensing signal IS falls at the 16th time slot and the attack pitch start signal AS maintains "1" during 32 time slots from the immediately following 17th time slot to the next 16th time slot. In response to the signal AS, the output of the AND gate 211 goes to "1" which output is applied to the OR gates 1, 4, 6 and 7. The output of the OR gate 4 is supplied to a flip-flop 225. When 32 time slots have elapsed from the rising of the signal AS, the output of the flip-flop 225 rises to "1" and this signal is self-held through the AND gate 210 and the OR gate 4. The state of the flip-flop 225 is designated by APQ. The output of the OR gate 4 corresponds to the signal APQ. When the signal APQ is "1", the respective circuits in the tonal effect imparting circuit 20 (FIGS. 12–14) are commanded to execute the attack pitch control.

The output of the OR gate 1 is delayed by 32 time slots by the flip-flop 222 and outputted as an upset signal USET. The output of the OR gate 7 is inverted by an inverter 228 and utilized as a signal $\overline{\text{SET}}$ and also is delayed by 32 time slots by the delay flip-flop 223. The output of the delay flip-flop 223 is inverted by an inverter 229 and is utilized as a signal $\overline{\text{SETD}}$. The otuput of the AND gate 211 is utilized as a signal APSET.

Accordingly, the respective signals APQ, USET, $\overline{\text{SET}}$, $\overline{\text{SETD}}$ and APSET which are generated in accordance with the attack pitch start signal AS assume states as shown in FIG. 16. FIG. 15(*b*) illustrates the states of these signals in the same time scale of FIG. 15(*a*).

The signal $\overline{\text{SET}}$ is applied to AND gates 174, 177–180, 182, 184–187, 190 and 196 to clear old data in the respective calculators CUL1–CUL4. The signal USET is applied to a delay flip-flop 231 through an OR gate 230 in FIG. 13. This flip-flop 231 is controlled by the signals 1T8 and 17T24 in the same manner as the flip-flops 222–227 in FIG. 14. The contents of the flip-flop 231 are self-held through AND gate 232 or 233. The AND gate 232 initially is in an enabled state and the signal "1" received by the flip-flop 231 by the signal USET is self-held in the flip-flop 231. The signal UPQ held by the flip-flop 231 indicates the direction of addition or subtraction of the calculator CUL2, i.e., upcounting when the signal UPQ is "1" and downcounting when it is "0".

The signal $\overline{\text{SETD}}$ is applied to AND gates 234 and 235 provided for outputting of the comparator output of a comparator COM1 shown in FIG. 13 as well as to AND gates 236 and 237 provided for outputting of the comparator output of a comparator COM2 shown in FIG. 14, so that, at the time when "1" has just been set in the flip-flops 224–227 shown in FIG. 14, the comparison output may be inhibited as the change of states of each of these flip-flops 224–227 is controlled by the comparators COM1 and COM2.

The signal APQ is supplied to AND gates 240 and 244 shown in FIG. 14 as well as to the AND gates 171, 184, 185, 186, 194 and 217. In the case of attack pitch, these AND gates, to which the signal APQ has been applied, control the calculators CUL1–CUL4 and the comparators COM1 and COM2.

The signal APSET is applied to the AND gates 176, 181, and 188 shown in FIG. 13. The signal APSET is used to load the initial value of attack pitch into the calculators CUL2 and CUL3. The outputs of the AND gates 205–213 are all applied to an OR gate 6 shown in FIG. 14 which outputs "1" all the time it is processing attack pitch, delay vibrato or slur. The output signal ANYQ of the OR gate 6 is applied to the AND gate 190 shown in FIG. 13 to enable the calculator CUL3 to calculate the data ENV which changes with time.

As mentioned before, the register 108 shown in FIG. 7 is loaded with the initial key touch detection data from the twentyfifth to the thirtysecond time slots immediately after falling of the initial sensing signal IS. An attack pitch initial value setting data is taken out from the fifth stage of the register 108 and supplied to an AND gate 248 shown in FIG. 12. By enabling the AND gate 248 at a timing of the signal 1T5y8, only 5 bits having weights of 1.2 cent to 19 cent (see 108 in FIG. 7) are selected. The data API delayed by 2 time slots by a 2-stage delay flip-flop 249 is applied to an AND gate 250 and the data API delayed by 1 time slot is applied to an AND gate 251 whereas the data API which is not delayed is applied to an AND gate 252. The coefficient data APS supplied by the ROM22 (see FIG. 2) is of 2-bits, i.e., $APS_1$ and $APS_2$, which is latched by a latch circuit 253 in synchronism with the seventeenth time slot. The 2-bit output of the latch circuit 253 is supplied, with its decoded value "11", "10" or "01", to each of the AND gates 250–252 whereby the data API in one of its three states is selected. The data API is thus shifted in accordance with the coefficient data $APS_1$ and $APS_2$ to obtain an attack pitch initial value data APiS through an OR gate 254. From the first to the eighth time slots, for example, the effective value of the data APiS appears in 7 time slots from the first to the seventh time slots, as shown in FIG. 16. As previously stated, the coefficient data APS ($APS_1$, $APS_2$) corresponds to the tone color. By scaling the data API by APS, therefore, the effect of the attack pitch control is regulated in accordance with the tone selected. When a tone not to be affected by attack pitch is selected, $APS_1$ and $APS_2$ are "00", the AND gates 250, 251 and 252 are all disabled and the initial value data APiS is all "0", thus inhibiting attack pitch.

The initial value data APiS is supplied to the AND gate 188 shown in FIG. 13 on one hand while it is inverted by an inverter 255 and applied to the AND gates 181 and 185 on the other. The AND gate 188 allows the data APiS to pass at a timing of the signal 9T16 (FIG. 5) at the time the signal APSET is generated and loads the data APiS into the shift register 164 through the OR gate 203 and the input B of the adder 168. Accordingly, the weight of each stage of the register 164 at the seventeenth time slot is as shown. When the signal APSET falls, the signal $\overline{SET}$ rises and the initial value APiS of the register 164 is held. Thus, the attack pitch initial value APiS is preset in the calculator CUL3 (the register 164) as an envelope instantaneous value data ENV.

The AND gate 181 allows the inverted data $\overline{APiS}$ to pass at a timing of the signal 9T16 at the time the signal APSET is generated and supplies the data to the input B of the adder 167 through the OR gate 200. At the time the signal APSET is generated, "1" is outputted from the AND gate 176 at a timing of the signal 9y32 and supplied to the input $C_i$ of the adder 167 through the OR gate 198. The signal 9y32 shows the timing of the least significant bit of the inverted data $\overline{APiS}$ which is selected at a timing of the signal 9T16. The adder 167 performs a calculation to obtain the two's complement of the initial value data APiS by adding "1" to the inverted data PiS/ . The negative initial value data "−APiS" expressed as the two's complement in this way is preset in the calculator CUL2 (register 163) as a modulating signal instantaneous value VAL.

In the calculator CUL4, an attack pitch envelope rate data APER supplied from the ROM22 (FIG. 2) is applied to the AND gate 194. This data APER is serially supplied in synchronism with one cycle of serial operation at the seventeenth to the sixteenth time slots. While the signal APQ is being generated, this data APER is repeatedly supplied to the input A of the adder 169 through the AND gate 194 and OR gate 204. While the signal $\overline{SET}$ is being generated, the output ERDT of the shift register 165, namely the output S of the adder 169 delayed by 16 time slots, is always supplied to the input B of the adder 169 through the AND gate 196 so that the data APER is repeatedly added in the calculator CUL4. The modulo number of the 16-bit calculator CUL4 is $2^{16}$ so that a carryout signal is generated from the most significant bit every time the addition operation is performed $2^{16}$/APER times. The carryout output Co+1 of the adder 169 is applied to a latch circuit 256 which is latch controlled by the signal 17y32S. As the operation timing of the most significant bit is the sixteenth time slot, the carryout signal of the most significant bit is outputted from the output Co+1 one time slot delayed, namely, at the seventeenth time slot. By effecting latch control, therefore, by the signal 17y32S which is generated at the seventeenth time slot, the carryout signal of the most significant bit of the calculator CUL4 remains held during 32 time slots in the latch circuit 256.

Figure 17:
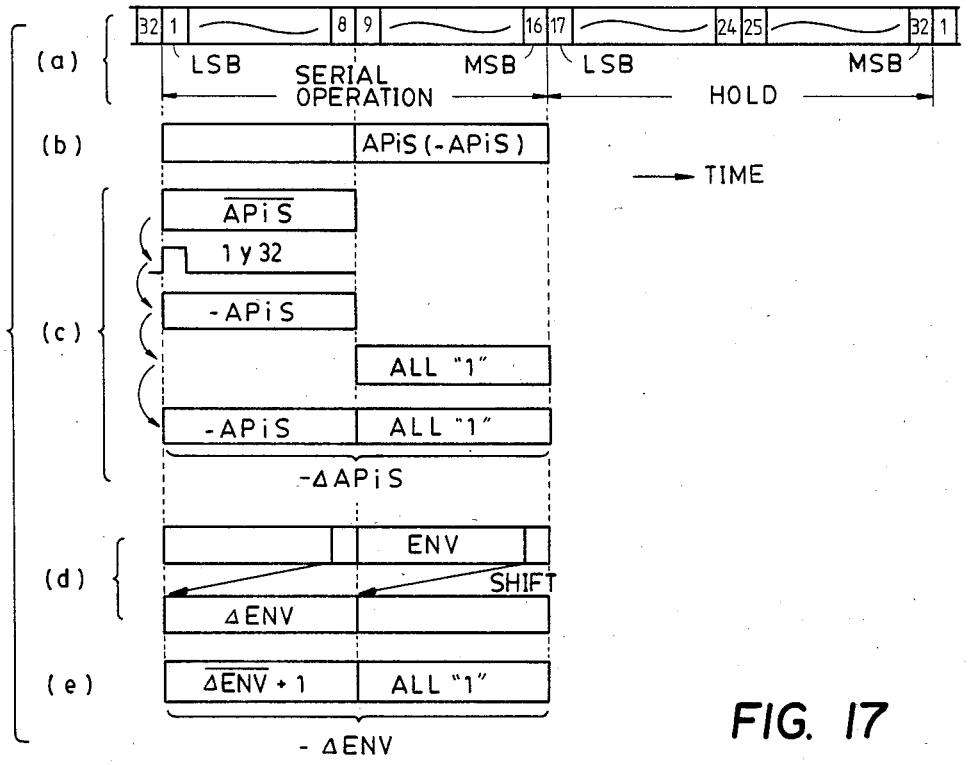
FIG. 17 is a time chart to help explain the serial operation by the calculator shown in FIG. 13.

The serial operation timing of the calculators CUL-1–CUL4 is as shown in FIG. 17(*a*). The serial operation involving the least significant bit (LSB) to the most significant bit (MSB) of the 16-bit data stored in each of the registers 162–165 is sequentially carried out at the first to sixteenth time slots. No operation is performed at the following seventeenth to thirtysecond time slots but the operation result is circulatingly held. It is noted from FIG. 17(*b*) that the most significant 8 bits of before-mentioned initial value "−APiS" selected at a timing of the signal 9T16 has been loaded into each of the calculators CUL2 and CUL5 at the ninth to sixteenth time slots.

The carryout signal, widened to a width of 32 time slots by the latch circuit 256, is applied to the AND gates 184, 185 and 186 of the calculator CUL3. These AND gates 184, 185 and 186 are enabled by the signals APQ and $\overline{SET}$. The inverted signal $\overline{APiS}$, supplied by the inverter 255, of the attack pitch initial value APiS is selected by the AND gate 185 at a timing of the signal 1T8 and then provided to the input A of the adder 168 through an OR gate 202 (see FIG. 17(*c*)). The AND gate 184 supplies "1" to the input Ci of the adder 168 through the OR gate 201 at a timing of the signal 1y32 (see FIG. 17(*c*)). As a result, "1" is added to the least significant bit (the timing of the 1st time slot) of the inverted data PiS/ selected at a timing of the signal 1T8 to obtain the two's complement of APiS, namely, "−APiS" (see FIG. 17(*c*)). The AND gate 186 supplies "1" to the input A of the adder 168 through the OR gate 202 at a timing of the signal 9T16 (see FIG. 17(*c*)). As a result, from the 9th to the 16th time slots, all "1" is added to "−APiS" which is selected at the first-eighth time slots thereby to obtain the two's complement "−ΔAPiS" of the small value ΔAPiS, namely APiS downwardly shifted by 8 bits (multiplied by $2^{-8}$). This small value "−ΔAPiS" is added to (or ΔAPiS is subtracted from) the data ENV of the shift register 164 which circulates through the AND gate 190, OR gate 203 and the input B of the adder 168. This addition operation is performed once in every one generation of the carryout signal from the most significant bit of the calculator CUL4. Initially, the attack pitch initial value APiS is preset as the data ENV. Therefore, the present value of the data ENV is obtained by sequentially subtracting ΔAPiS from APiS every time the carryout signal of the calculator CUL4 is generated. The time interval for once subtracting ΔAPiS is determined in accordance with the value of the APER which accumulates in the calculator CUL4. As mentioned before, since the carryout signal is latched to the latch circuit 256 every time the calculator CUL4 performs the addition operations $2^{16}$/APER times, the time interval for once subtracting ΔAPiS by the calculator CUL3 is 16 $\mu s \times 2^{16}$/APER. For example, since the modulo number $2^{16}$ of CUL4 can be expressed by Hz as 64 ($=2^{16} \times 1/1024$) Hz, and if the data APER is also expressed by Hz, the carryout signal is generated from the calculator CUL4 every time the addition operations are performed 64 (Hz)/APER (Hz) times, so that the calculation cycle of ΔAPiS may be expressed as 16 $\mu s \times 64$ (Hz)/APER (Hz). The calculator CUL3 thus finds the envelope data ENV which gradually decreases in the attack pitch section as shown in FIG. 15(*a*).

An attack pitch rate data APR is supplied from the ROM22 (FIG. 2) to the AND gate 171 of the calculator CUL1 and this data APR is added to the input A of the adder 166 all the time the signal APQ is being generated. This data APR, similarly to the data APER mentioned before, is supplied serially in synchronism with one cycle of serial operation at the seventeenth-sixteenth time slots. All the time the signal $\overline{SET}$ is being generated, the output of the shift register 162 or the output S of the adder 166 delayed by 16 time slots, is supplied to the input B of the adder 166 through the AND gate 174. Accordingly, the data APR is accumulated in the calculator CUL1 every 16 $\mu s$ (32 time slots). The carryout signal of the most significant bit generated by this accumulation is latched by the latch circuit 257 at a timing of the signal 17y32S and widened to the width of 32 time slots. The time interval of the generation of the carryout signal from the most significant bit of the calculator CUL1 is, as in the previously mentioned case, 16 $\mu s \times 2^{16}$/APR, which may be expressed as 16 $\mu s \times 128$(Hz)/APR (Hz) since the modulo number $2^{16}$ can be expressed by Hz as 128 ($=2^{16} \times 1/512$) Hz.

The output of the latch circuit 257 is supplied to the AND gates 177–180 of the calculator CUL2. These AND gates 177–180 are enabled by the signal $\overline{SET}$. The AND gates 177–179 179 are provided to perform downcounting operation (subtraction) and supplied with the signal obtained by inverting the signal UPQ by an inverter 258. The AND gate 180 is provided to perform upcounting operation and supplied with the signal UPQ. As mentioned before, the signal UPQ is initially set at "1" by the signal USET so that the AND gate 180 is in an enabled state. The AND gate 180 is supplied with ΔENV, namely the output of the ninth stage of the shift register 164. The output ΔENV is selected by the AND gate 180 at a timing of the signal 1T8 and supplied to the input A of the adder 167 through an OR gate 199.

Since, at the first time slot, each stage of the register 164 has a weight as shown, it is possible, by selecting the output ΔENV of the ninth stage of the register 164 from the first to the eighth time slots by the signal 1T8, to select the eighth to fifteenth bits of the date ENV as shifted down by 7 bits. In other words, the date ΔENV selected by the AND gate 180 from the first to the eighth time slots is the small value equivalent to the envelope data ENV of the calculator CUL3 as shifted down by 7 bits (multiplied by $2^{-7}$). The shifting is effected as shown in FIG. 17(*d*). More specifically, 8 bits counting from the most significant bit of the data ENV having weights to be serially operated at a timing of the eighth-fifteenth time slots in the calculator CUL3 is taken out 7 bits earlier so as to be shifted to the operation timing of the first to the eighth time slots which are lower by 7 time slots to become the small value ΔENV.

The data VAL of the calculator CUL2 circulates through the AND gate 182, the OR gate 200, the input B of the adder 167 and the shift register 163. Said small value ΔENV is added to this data VAL every time the carryout signal is generated from the most significant bit of the calculator CUL1. Initially, the negative attack pitch initial value "−APiS" is preset as the data VAL. Therefore, ΔENV is sequentially added to "−APiS" so that the value of the data VAL gradually increases as shown in the attack pitch section in FIG. 15(*a*). The time interval for repeatedly operating ΔENV is equal to the generation interval of the carryout signal of the calculator CUL1, namely, 16 $\mu s \times 2^{16}$/APR, which is determined by the rate data APR.

The data VAL is supplied at a timing of the signal 1T16 to the input A of the comparator COM1 through the AND gate 215. While upcounting is being carried out in the calculator CUL2, the AND gate 216 is enabled by "1" of the signal UPQ. The envelope data ENV is selected by the AND gate 216 at a timing of the signal 1T16 and supplied to the input B of the comparator COM1 through an OR gate 221. When, in the upcount mode, VAL is smaller than ENV, in other words, when the modulating signal instantaneous value VAL is increasing toward the envelope instantaneous value ENV, A<B in the comparator COM1 and the output "1" is supplied to the AND gate 235 whereas the output "0" is supplied to the AND gate 234. Accordingly, ΔENV is sequentially added to "−APiS" so that the value of the data VAL gradually increases as shown in the attack pitch section in FIG. 15(*a*). The signal $\overline{SETD}$ which is supplied to the other inputs of the AND gates 234 and 235 is normally "1". The output "0" of the AND gate 234 is inverted by the inverter 259 and "1" is supplied to the AND gage 232. In the upcount mode, the output of the delay flip-flop 231 is "1", which is held in the flip-flop 231 through the AND gate 232 and OR gate 230. When VAL reaches ENV and the relation A>B is established in the comparator COM1, "1" is outputted from the AND gate 234 and the AND gate 232 is disabled by the output "0" of the inverter 259 so that the flip-flop 231 is reset, the signal UPQ goes to "0" and the calculator CUL2 assumes the downcount mode. The comparator COM (as well as COM2 shown in FIG. 14) is adapted to change the state of its output in synchronism with the signal 17y32.

In the downcount mode, the inverted signal of the UPQ, namely the output "1" of the inverter 258, enables the AND gates 177, 178 and 179, which convert the addend ΔENV to be used in the calculator CUL2 into the two's complement. The data ΔEND inverted by the inverter 260 ($\overline{\Delta ENV}$) is supplied to the AND gate 179 and thence to the input A of the adder 167 at a timing of the signal 1T8. As earlier mentioned, the signal 1T8 serves to obtain the 7-bit shifted data ENV, namely the small value ΔENV. The AND gate 177 is provided to supply "1" to the input Ci of the adder 167 at a timing of the signal 1y32 and add "1" to the least significant bit of the inverted data $\overline{\Delta ENV}$. The AND gate 178 is provided to supply "1" during 8 time slots to the input A of the adder 167 at a timing of the signal 9T16. The two's complement "−ΔENV" of the small value ΔENV is thus obtained at the first-sixteenth time slots (see FIG. 17(*e*)).

In the downcount mode, ΔENV is virtually subtracted from VAL by adding "−ΔENV" to the data VAL in the calculator CUL2 every time the carryout signal of the most significant bit of the calculator CUL1 is generated. Therefore, the data VAL gradually decreases at the same rate as that at which it increases, after having reached the peak corresponding to the envelope data ENV as shown in FIG. 15(*a*).

In the downcount mode, the AND gate 216 is disabled whereas the AND gates 217, 218 and 219 are enabled. In the case of attack pitch, only the AND gate 217 out of the AND gates 217, 218 and 219 is enabled by thy signal APQ. The envelope data ENV outputted from the register 164 of the calculator CUL3 passes the AND gate 217 at a timing of the signal 1T16 and is supplied to a complement circuit 261 through the OR gate 220. This complement circuit 261 is provided to convert the envelope data ENV into a negative value as the decreasing modulating signal instantaneous value VAL is folded in the negative area. The complement circuit 261 finds the two's complement of the envelope data ENV supplied at a timing of the signal 1T16 (from the first to the sixteenth time slot) and provides it to the input B of the comparator COM1 through the OR gate 221. Since VAL>−ENV while the data VAL is decreasing, the relation A<B does not hold in the comparator COM1 so that the downcount mode is maintained. When the data VAL reaches the negative value of the ENV, namely, −ENV, the relation A<B is established and "1" is supplied to the AND gate 235. The output "1" of the AND gate 235 is supplied to the AND gate 233. In the downcount mode, the AND gate 233 is enabled by the output "1" of the inverter 262 obtained by inverting the output "0" of the delay flip-flop 231. Therefore, when the relation A<B is established in the comparator COM1, "1" is outputted from the AND gate 233 and loaded into the flip-flop 231 whereas the output "A>B" of the comparator COM1 goes to "0" and the inverter 259 supplies "1" to the AND gates 232. Accordingly, the output "1" of the flip-flop 231 is self-held through the AND gate 232. The signal UPQ thus goes to "1" and the calculator CUL2 assumes the upcount mode. The data VAL thus repeats increasing and decreasing within the envelope area defined by the data ENV so that the gradually attenuating modulating signal (VAL) is obtained as shown in the attack pitch section in FIG. 15(*a*).

The envelope data ENV of the calculator CUL3 is supplied to the AND gates 238 and 240 shown in FIG. 14. The signal APQ is supplied to the AND gates 240 and 244 provided, together with some other AND gates, to control the comparator COM2 whereas the data ENV is supplied to the input A of the comparator COM2 through the AND gate 240 and OR gate 246 so that "1" is supplied to the input B of the comparator COM2 at every eighth time slot. As is evident from the weight indication of the register 164 given in FIG. 13, the eighth time slot in the envelope data ENV has a weight of 0.6 cent. Accordingly, applying "1" is correspondence with the eighth time slot means applying data having a weight of 0.6 cent to the input B of the comparator COM2. Therefore, the comparator COM2 compares the data ENV (input A) showing the present value by cent of the envelope and 0.6 cent (input B). It is noted that 0.6 cent in this circuit is virtually equivalent to 0 cent since the least significant bit of the data APiS which is loaded initially into the register 164 (FIG. 13) has a weight of 1.2.

When the data ENV has not yet reached 0.6 cent, A>B is established in the comparator COM2 so that the output "A≦B" is "0". This output "0" is supplied from the AND gate 237 to the inverter 263, which supplies the output "1" to enable the AND gate 210 so as to hold the signal APQ.

When the data ENV becomes 0.6 cent (namely, 0 cent) or less, the relation A≦B is established in the comparator COM2 and the output of the AND gate 237 goes to "1". This means that the attack pitch depth setting envelope has become 0 cent, that is, attack pitch has ended. By the output "1" of the AND gate 237, the output of the inverter 263 goes to "0", disabling the AND gate 210. As a result, the signal APQ goes to "0" and the attack pitch control terminates. It is noted that, since the data ENV is such data as obtained by sequentially subtracting ΔAPiS, namely 8 bits downwardly shifted initial value APiS, from this initial value APiS, the data ENV becomes exactly 0 through $2^8$ subtractions.

(2) Delay vibrato

The output of the AND gate 237 is also supplied to the AND gate 208. The AND gate 208 is enabled by the output (APQ) of the flip-flop 225 while the attack pitch control is being effected. When the output of the AND gate 237 goes to "1" upon termination of attack pitch, the conditions are satisfied for the AND gate 208 to output "1". The output "1" of the AND gate 208 is applied to OR gates 3, 6 and 7. By the output "1" of the OR gate 3, the signal "1" is loaded into the flip-flop 226. Through the AND gate 207 and the OR gate 3, "1" of the flip-flop 226 is held. The state of the flip-flop 226 is designated by DELQ. The output of the OR gate 3 is the signal DELQ. The counting of the delay vibrato start time is carried out when the signal DELQ is "1". The signal DELQ is shown in FIG. 15(*b*) in the time scale corresponding to that shown in FIG. 15(*a*).

Since the output of the AND gate 208 is supplied to the OR gate 7, the signal $\overline{SET}$ maintains "0" during 32 time slots following the rise of the signal DELQ, as in the case of said signals APQ whereas the signal $\overline{SETD}$ maintains "0" during further 32 time slots following said 32 time slots.

The outputs of an after-touch vibrato selection switch KVBS and a normal vibrato selection switch NVBS are latched by a latch circuit 265 through the OR gate 264. A signal $\overline{K+N}$ obtained by inverting the output of the latch circuit 265 by an inverter 266 is supplied to the AND gates 205–209 used to create the delay vibrato effect. In case, therefore, after-touch vibrato or normal vibrato is selected, the signal $\overline{K+N}$ goes to "0" and the AND gates 205–209 are all disabled, thus inhibiting the delay vibrato.

Further, when the slur control to be described later has terminated, the conditions are satisfied in the AND gate 209 so that the signal DELQ is set in exactly the same manner as when the conditions in the AND gate 208 are satisfied. In short, the signal DELQ is set when attack pitch or slur terminates.

The signal DELQ is applied to the AND gate 193 of the calculator CUL4 shown in FIG. 13. The old data of the register 165 of the calculator CUL4 is cleared in advance by "0" of the signal $\overline{SET}$. While the signal DELQ is being generated, the calculator CUL4 serves as a timer. The weight of each stage of the register 165 corresponds to such times as 512 ms, 256 ms, etc. as indicated in the lower line of each block. Another output of the AND gate 193 is supplied with the signal ly32, on the basis of which "1" is added repeatedly (every 16 μs) in the first time slot. Therefore, the data outputted from the sixteenth stage of the register 165 at the first or the seventeenth time slot has a weight of 16 μs whereas the data located at the tenth stage has a weight of about 1 ms (precisely, 1924 μs). Thus, the contents ERDT of the calculator CUL4 sequentially increase as time elapses from the rise of the signal DELQ. The count data ERDT of the calculator CUL4 is applied to an AND gate 239 shown in FIG. 14. The data ERDT is selected by the AND gate 239 at a timing of the signal 1T16 produced while the signal DELQ is being generated, and supplied to the input A of the comparator COM2.

Meanwhile, the delay vibrato start time data DEL taken out from the 8th time slot of the register 104 shown in FIG. 7 is supplied to an AND gate 243 through the circuit shown in FIGS. 12 and 13. The data DEL is selected by the AND gate 243 at a timing of the signal 9T16 produced while the signal DELQ is being generated, and supplied to the input B of the comparator COM2. The data DEL has such a large weight as shown in the register 104 in FIG. 7, for the 8-bit data DEL is selected in higher ninth-sixteenth time slots among the 16-time-slot operation timing. When the value of the data ERDT is smaller than that of the data DEL, the condition A<B is satisfied in the comparator COM2 so that the output A≧B is "0". Therefore, the AND gate 236 supplies "0" to an inverter 267, which in turn supplies "1" to the AND gate 207. Accordingly, the signal DELQ of the flip-flop 226 is held through the AND gate 207.

When the start time set by the data DEL has arrived, the relation ERDT≧DEL is established and the condition A≧B is satisfied in the comparator COM2 so that the signal "1" is outputted from the AND gate 236. The output of the inverter 267, therefore, goes to "0" so that the AND gate 207 is disabled and the signal DELQ falls. Thus ends the waiting time lasting until delay vibrato starts.

The output of the AND gate 236 is supplied to the AND gate 206 which is in an enabled state by the output (DELQ) of the flip-flop 226 during said waiting time and outputs the signal "1" in response to the output "1" of the AND gate 236 upon termination of said waiting time. The output of the AND gate 206 is applied to the OR gates 1, 2, 6 and 7. Based on the output of the OR gate 2, the signal "1" is loaded into the flip-flop 227. The output "1" of the flip-flop 227 is held through the AND gate 205 and OR gate 2. The state of the flip-flop 227 is designated by DVBQ. The output of the OR gate 2 is the signal DVBQ. When the signal DVBQ is "1", it forms the modulating signal for delay vibrato. The signal DVBQ is shown in FIG. 15(*b*) in the time scale corresponding to that shown in FIG. 15(*a*).

Since the output of the AND gate 206 is added to OR gates 1 and 7, the signal $\overline{\text{SET}}$ maintains "0" while the signal $\overline{\text{USET}}$ maintains "1" during the 32 time slots following the rise of the signal DVBQ, as in the case of the rise previously mentioned of the signal APQ (see FIG. 16). By "1" of the signal USET, the flip-flop 231 (signal UPQ) shown in FIG. 13 is set at "1". Accordingly, the calculator CUL2 initially is set in the upcount mode. Each of the calculators CUL1–CUL4 shown in FIG. 13, on the other hand, is cleared by "0" of the signal $\overline{\text{SET}}$. The process of producing the modulating signal data VAL in delay vibrato is almost the same as in the case of attack pitch though the data used for the operation is different.

The calculator CUL4 provided to set the calculation time interval for calculating the envelope data (ENV) accumulates the delay vibrato envelope rate data DVER′ which is supplied to the AND gate 192. The data DVER′ is produced by the circuit shown in FIG. 12 based on the data DVER outputted from the first stage of the register 104 shown in FIG. 7.

Referring to FIG. 12, the data DVER is inverted by an inverter 268 and applied to a latch circuit 269 as well as to an AND gate 270. The output of the AND gate 270 and the signal 9y32 are combined by an OR gate 271 to obtain the data DVER′. These circuits 268–271 are provided to produce the data DVER′ of opposite characteristic to the data DVER. In this embodiment, the single potentiometer V4 (FIG. 6) for delay vibrato is adapted to set both the delay vibrato start time and delay vibrato envelope rate. Therefore, if the value set by the potentiometer 4 were used as it is, the longer the start time (DEL), the steeper the slope of the envelope, thus resulting in an unnatural delay vibrato because of its shortened period. Accordingly, while the value set by the potentiometer V4 is used as it is for the delay vibrato start time data, the value (DVER) set by the potentiometer V4 is converted into the value of opposite characteristic (DVER′) for the envelope rate data so that, the longer the start time (DEL) the less steep slope the envelope may have, thus securing delay vibrato which lasts long enough.

Figure 18:
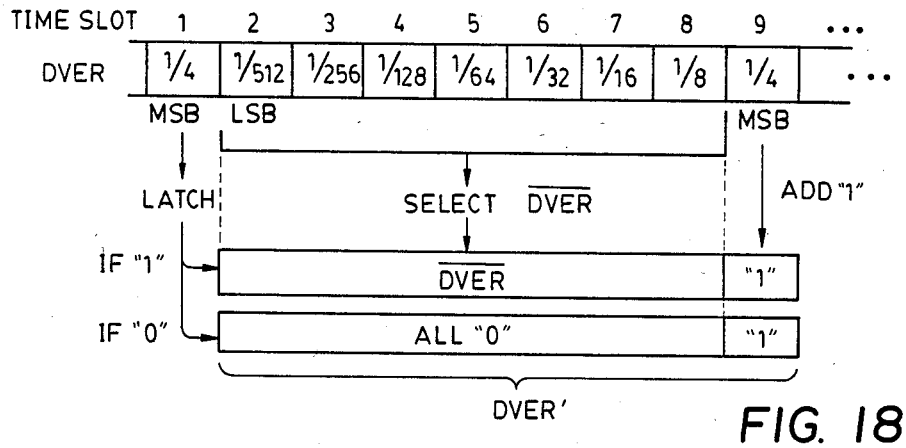
FIG. 18 is a time chart to help explain the delay vibrato envelope rate data conversion processing by the circuit shown in FIG. 12.

Since the data DVER is taken out from the first stage of the register 104 shown in FIG. 7, the data DVER at the first to eighth time slots have weights as shown in FIG. 18. The most significant bit ($\frac{1}{4}$ Hz by weight) comes at the first time slot while the least significant bit (1/512) up to the seventh bit ($\frac{1}{8}$) come at the second to eighth time slots, respectively. The weight indication given in FIG. 18 corresponds to the weight indication given in the lower line of each block in the register 104 shown in FIG. 7. The latch circuit 269 shown in FIG. 12 is latch controlled by the signal 1y32S and latches the inverted signal of the most significant bit MSB ($\frac{1}{4}$ Hz by weight) of the data DVER appearing at the first time slot. The output of the latch circuit 269 is supplied to the AND gate 270. The AND gate 270 is in an enabled state when "1" is latched in the latch circuit 269, i.e., when the most significant bit of the data DVER is "0", and selects the data of the least significant bit (1/512 Hz by weight) up to the 7th bit ($\frac{1}{8}$ Hz by weight) from among the inverted data DVER of the data DVER at a timing of the signal 2T8 (see FIG. 18). The data selected by the AND gate 270 is outputted through the OR gate 271. The OR gate 271 adds "1" at the ninth time slot which is next to (i.e., higher side of) the data selected by the AND gate 270 based on the signal 9y32 (see FIG. 18). Thus obtained is the data DVER′ wherein the least significant bit up to the most significant bit line up in this order at the second to ninth time slots.

When "0" is latched in the latch circuit 269, i.e., when the most significant bit of the data DVER is "1", the AND gate 270 is in an enabled state and the data DVER′ at the second to eighth time slots maintains all "0". In this case, the signal "1" is only supplied at a timing of the signal 9y32 so that the data DVER′ maintains "10000000" all the time regardless of the value of the data DVER (see FIG. 18).

In the table below are given the states of the highest three bits of the data DVER and DVER′, responding to the change of the state of the data DVER (DEL).

TABLE 2

| DVER (DEL) MSB | $\overline{\text{DVER}}$ MSB | DVER′ MSB | Value |
|---|---|---|---|
| 0 0 0 . . . | 1 1 1 . . . | 1 1 1 . . . | $\frac{1}{4}$ Hz (0.5 sec) |
| 0 0 1 | 1 1 0 | 1 1 0 | |
| 0 1 0 | 1 0 1 | 1 0 1 | |
| 0 1 1 | 1 0 0 | 1 0 0 | |
| 1 0 0 . . . | 0 1 1 . . . | 1 0 0 . . . | $\frac{1}{2}$ Hz (0.5 sec) |
| 1 0 1 | 0 1 0 | 1 0 0 | |
| 1 1 0 | 0 0 1 | 1 0 0 | |
| 1 1 1 | 0 0 0 | 1 0 0 | |

As will be seen, when the most significant bit of the data DVER is "0", the data DVER′ assumes the opposite characteristic with regard to the data DVER. When, on the other hand, the most significant bit of the data DVER is "1" (i.e., greater than a certain value), the data DVER′ maintains a fixed value (minimum). The values of the data DVER′ are indicated in the column for value in Table 2 by way of example. When DVER′ is all "1", the envelope rate of delay vibrato is about $\frac{1}{2}$ Hz while, when DVER′ is "10000000", said rate is $\frac{1}{4}$ Hz. That is, the envelope rate of delay vibrato can be controlled (can be set) in the range of about $\frac{1}{2}$ Hz to $\frac{1}{4}$ Hz. The delay vibrato period at the envelope rate of about $\frac{1}{2}$ Hz is about 0.5 seconds while the delay vibrato period at the envelope rate of $\frac{1}{4}$ Hz is 1 second.

Figure 19:
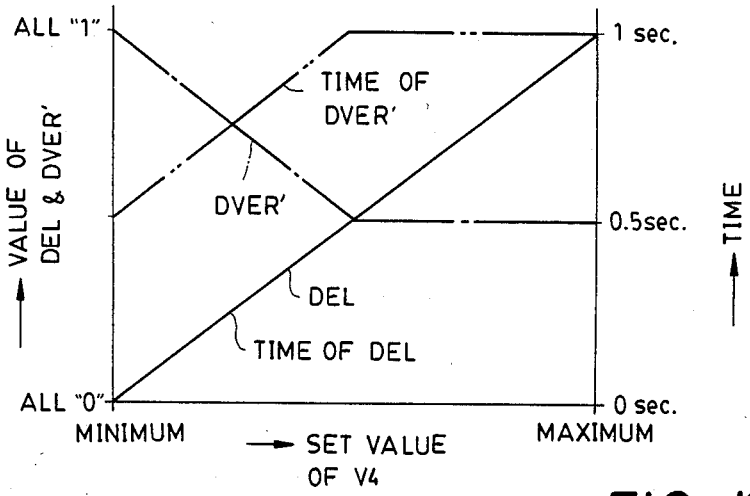
FIG. 19 is a graph showing the relation between the control data setting potentiometers for the delay vibrato control, the delay vibrato start time data, and the delay vibrato envelope rate data as well as the relation between the delay vibrato start time determined by these data and the delay vibrato period.

FIG. 19 shows the relation between the value set by the potentiometer V4 on one hand and the delay vibrato start time data DEL and the delay vibrato envelope data DVER′ on the other as well as the relation between the value set by the potentiometer V4 on one hand and the real start time based on the data DEL and the real delay vibrato period based on the data DVER′ on the other as obtained by the control mentioned above. In FIG. 19, the horizontal axis indicates the value set by the potentiometer V4, the left vertical axis indicates the values of the data DEL and DVER' and the right vertical axis indicates the length of time. The curve DEL shows the relation between the value set by the potentiometer V4 and value of the data DEL while the curve "DEL time" shows the value set by the potentiometer V4 and the real start time based on the data DEL, both curves being of the same characteristic. The curve "DVER'" shows the relation between the value set by the potentiometer V4 and the data DVER' while the curve "DVER' time" shows the relation between the value set by the potentiometer V4 and the real delay vibrato period based on the data DVER'.

The vibrato depth data VBD outputted from the 6th stage of the register 102 shown in FIG. 7 is added to an AND gate 272 shown in FIG. 12 and thereby selected at a timing of the signal 1T6y8 (see FIG. 5) so as to be added to the AND gate 187 shown in FIG. 13 through a line 273. The AND gate 272 is provided to select only the effective value of the data VBD, namely the 6-bit data having weights of 1.2 cent to 38 cent (see the register 102 shown in FIG. 7) and inhibit the unnecessary 2 bits. The AND gate 187 shown in FIG. 13 is enabled by the signals DVBQ and $\overline{\text{SET}}$ and, when the carryout signal of the calculator CUL4 is latched by the latch circuit 256, selects the data VBD at a timing of the signal 1T8 and supplies it to the input A of the adder 168. The data VBD is selected at the first-eighth time slots, namely the operation timing in lower bits and used to carry out the operation. Therefore, a small value ΔVBD virtually corresponding to the weights of the lower 6 bits is added in the calculator CUL3. That is, the small value ΔVBD, 8 bits shifted down (multiplied by $2^{-8}$) as compared with the weights (1.2 cent to 38 cent) of the data VBD in the register 102 shown in FIG. 12, is used in the calculator CUL3. The data VBD is repeatedly added every time the carryout signal is generated from the most significant bit of the calculator CUL4.

As stated before, the data DVER' is supplied to the adder 169 of the calculator CUL4 through the AND gate 192 at the second to ninth time slots. Accordingly, the 8-bit data DVER' corresponding to the weights of $\frac{1}{4}$ Hz to 1/512 Hz is accumulated every 32 time slots (16 μs) in the calculator CUL4. Incidentally, the most significant bit of the calculator CUL4 has a weight of 32 Hz as will be seen from the upper weight indication given in each block in the register 165. Based on the carryout signal of the calculator CUL4, the data ΔVBD is accumulated by the calculator CUL3 in the cycle corresponding to the data DVER' or DVER. The envelope data ENV thus increases gradually as shown in the delay vibrato section in FIG. 15(*a*).

The vibrato rate data VBR introduced from the fourth stage of the register 101 shown in FIG. 7 is supplied to the AND gate 274 shown in FIG. 12. The data VBR is selected by the AND gate 274 at the fifth to twelfth time slots based on the signal 5T12 (see FIG. 5) and supplied to the AND gate 172 shown in FIG. 13 through a line 275. The weights indicated in the register 101 shown in FIG. 7 are those assumed at the first time slot. At the fifth time slot, the data having a weight of 1/24 Hz, namely the least significant bit, is outputted from the fourth stage. Consequently, the line 275 is provided with the data VBR having 8 bits with the least significant bit followed by the other bits in order at the fifth to twelfth time slots.

The AND gate 172 is enabled by the signal DVBQ while the delay vibrato effect is being produced and the data VBR is supplied to the input A of the adder 166 through the AND gate 172 and OR gate 197. The bit having a weight of 1/24 Hz supplied from the adder 166 to the shift register 162 at the fifth time slot is shifted to the twelfth stage of the register 162 at the seventeenth (the first) time slot. Therefore, when the vibrato rate data VBR is accumulated, the data of the shift register 162 has the weights as indicated in the lower line of its stage blocks. In the calculator CUL1, the data VBR is accumulated every 32 time slots (16 μs) and the carryout signal of the most significant bit is latched by the latch circuit 257. Indicating the data VBR is Hz, the cycle in which the carryout signal is generated from the most significant bit of the calculator CUL1 may be expressed as 16 μs×512/3 (Hz)×1/VBR (Hz), wherein 512/3(=$2^{16}$×1/384) Hz is the indication by Hz corresponding to the modulo number $2^{16}$ of CUL1.

When the signal "1" is latched by the latch circuit 257, the AND gates 177–180 are enabled as in the case of attack pitch. In the upcount mode, the data ΔENV is selected by the AND gate 180 and added to the contents VAL of the calculator CUL2. In the case of delay vibrato, the calculator CUL2 initially is set in the upcount mode and its content VAL is reset so that the data VAL increases from 0 cent in the positive direction. The variation range by which the data VAL varies at a time corresponds to the data ΔENV or the envelope data ENV shifted by 7 bits while the time interval of variation thereof, namely, the cycle at which the data ΔENV is repeatedly added in the calculator CUL2, corresponds to the vibrato rate data VBR.

The control over the change from the upcount mode to the downcount mode of the calculator CUL2 during the increase of the data VAL is exercised in the same manner as in the case of attack pitch. Specifically, while the data VAL and ENV are respectively applied to the inputs A and B of the comparator COM1 through the AND gates 215 and 216, the signal UPQ of the flip-flop 231 is reset when the relation A>B is established, namely, when VAL has reached ENV.

When the signal UPQ goes to "0", the AND gates 177, 178 and 179 of the calculator CUL2 are enabled, and ΔENV is subtracted (the two's complement of ΔENV is added) every time the carryout signal of the calculator CUL1 is latched by a latch circuit 257 as in the case of attack pitch. The data VAL gradually decreases accordingly. The range and time interval of variation of the data VAL as it decreases are both determined by ΔENV and VBR in the same manner as those as it increases.

In the downcount mode in delay vibrato, an AND gate 218 is enabled by the signal DVBQ and the output of an inverter 258. An output $\frac{1}{2}$ ENV of the fifteenth stage of the shift register 164 is supplied to the AND gate 218 and thereby selected at a timing of the signal 1T16. The value of the data $\frac{1}{2}$ ENV is a half of that of the envelope data ENV outputted from the sixteenth stage of the register 164 at a timing of the same signal 1T16 (at the first to sixteenth time slot). Thus, the data $\frac{1}{2}$ ENV, a half of the data ENV belonging to the high value region (positive value by cent), is used as the envelope data (i.e., vibrato depth) belonging to the low value region (negative cent value). As a result, it is possible to obtain the vibrato depth in the high value region and the vibrato depth in the low value region, one asymmetrical with regard to the other (ratio 2:1) as shown in the section of delay vibrato in FIG. 15(*a*).

The data $\frac{1}{2}$ ENV selected by the AND gate 218 is converted to the two's complement thereof by a complement circuit 261 to become a negative value. The comparator COM1 compares the decreasing data VAL (input A) and the data $-\frac{1}{2}$ ENV (input B) and, when the relation A<B is established, changes the state UPQ of the flip-flop 231 to the upcount mode.

The data VAL thus repeats increasing and decreasing within the envelope area defined by the data ENV and $-\frac{1}{2}$ ENV. As a result, a modulating signal (VAL) is obtained, which gradually increases in depth as shown in the delay vibrato section in FIG. 15(*a*).

Meanwhile, the envelope data ENV is supplied to the input A of the comparator COM2 shown in FIG. 14 at a timing of the signal 1T16 through the AND gate 238 enabled by the signal DVBQ. The vibrato depth data of the line 273 (FIGS. 12, 13) is on the other hand supplied to the input B at a timing of the signal 9T16 through the AND gate 242 enabled by the signal DVBQ. In this case, the data ENV and VBD are compared by the comparator COM2 such that the bits compared with each other have the same weight. Since the data ENV is obtained, as mentioned before, by repeatedly adding the data ΔVBD, i.e., the data VBD shifted down by 8 bits, ENV coincides with VBD by $2^8$ additions.

When the data ENV has not yet reached the value of the data VBD, the relation A<B holds in the comparator COM2 so that the output A≧B is "0". The signal "0" of the output A≧B is supplied to the inverter 267 through the AND gate 236. The AND gate 205 is enabled by the output "1" of the inverter 267 so the signal DVBQ is held.

When the data ENV coincides with the value of the data VBD, the relation A≧B is established in the comparator COM2 and the output of the AND gate 236 goes to "1". Accordingly, the output of the inverter 267 goes to "0" and the signal DVBQ is reset. Delay vibrato terminates in this way.

The termination of delay vibrato is automatically followed by normal vibrato.

(3) Normal vibrato

The normal vibrato starts in either of the following two ways. The normal vibrato automatically follows the termination of the delay vibrato in one way whereas the normal vibrato is positively selected by a switch NVBS (FIG. 14) without effecting delay vibrato in the other.

The normal vibrato and the after-touch vibrato to be later described are effected when the output signal ANYQ of the OR gate 6 to which all the outputs of the AND gates 205–213 shown in FIG. 14 are applied is "0". The signal ANYQ is added to the AND gate 190 shown in FIG. 13 on one hand while it is inverted by the inverter 276 and applied as the signal $\overline{\text{ANYQ}}$ to the AND gates 173, 189 and 219 on the other.

The signal "1" outputted, as mentioned above, from the AND gate 236 shown in FIG. 14 upon termination of delay vibrato serves only to reset the signal DVBQ. When the signal DVBQ falls to "0", therefore, the signal $\overline{\text{ANYQ}}$ rises as shown in FIG. 15(*b*). Termination of the delay vibrato is thus followed by the normal vibrato automatically. In case where the normal vibrato (or after-touch vibrato) is positively selected by the switch NVBS (or KVBS), the AND gates 205–209 provided for the delay vibrato are disabled all the time by "0" of the signal $\overline{\text{K+N}}$. Therefore, the AND gate 208 (or 209) does not operate upon termination of the attack pitch (or slur) and the signal ANYQ rises when the signal APQ (or signal SLQ to be described later) falls. Accordingly, termination of the attack pitch (or slur) is followed immediately by the normal vibrato. In case where neither the attack pitch nor the slur is effected, the signal ANYQ is "0" and the signal $\overline{\text{ANYQ}}$ is "1" all the time so that the normal vibrato is effected from the output. The calculators CUL1, CUL2 and CUL3 shown in FIG. 13 are used for processing for normal vibrato. When the signal $\overline{\text{ANYQ}}$ rises, the signal $\overline{\text{SET}}$ does not go to "0" so that the calculators CUL1 and CUL2 are not cleared and the modulating signal instantaneous value VAL maintains its value. Nor is the signal USET generated so that the state UPQ remains the same. Accordingly, the modulating signal is shifted smoothly as the delay vibrato is followed by the normal vibrato.

In the calculator CUL1, the vibrato rate data VBR is received by the adder 166 through the line 275 and the AND gate 173 enabled by the signal $\overline{\text{ANYQ}}$, and is accumulated every 32 time slots (16 μs) as in the case of delay vibrato. In the calculator CUL2, the AND gates 177–180 are enabled by the signal $\overline{\text{SET}}$ and the data ΔENV supplied from the calculator CUL3 is either added or subtracted every time the carryout signal is generated from the most significant bit of the calculator CUL1.

In the calculator CUL3, the AND gate 190 is disabled by "0" of the signal ANYQ and the circulation of the data ENV through the register 164 is inhibited whereas a given vibrato depth data supplied from an OR gate 277 is selected by the AND gate 189 enabled by the signal $\overline{\text{ANYQ}}$ and applied all the time to the register 164 through the adder 168. The output of an after-touch vibrato selection switch KVBS shown in FIG. 14 is periodically latched by a latch circuit 265, whose output signal KVBSS is applied to an AND gate 278 on one hand while it is inverted by an inverter 280 and applied to an AND gate 279 on the other. When the after-touch vibrato is not selected, namely, in the case of the normal vibrato, the signal KVBSS is "0" all the time so that the AND gate 278 is disabled while the AND gate 279 is enabled. The vibrato depth data VBD provided through the line 273 is selected by the AND gate 279 at a timing of the signal 9T16y16 (see FIG. 5) and supplied to the AND gate 189 through the OR gate 277.

The AND gate 272 shown in FIG. 12 repeatedly selects and provides to the line 273, the significant bits (6 bits having weights of 1.2 cent to 38 cent) of the vibrato depth data VBD supplied from the register 102 (FIG. 7) in each of the sections of the first to sixth, ninth to fourteenth, seventeenth to twentysecond, and twentyfifth to thirtiety time slots. The AND gate 279 shown in FIG. 13 selects the data VBD supplied through the line 273 in each of the sections of the ninth-sixteenth and twentyfifth to thirtysecond time slots (i.e., the 8 time slots for the 8 higher bits among the 16-time-slot synchronizing operation timing shown in FIG. 17(*a*)). Accordingly, the data VBD of the register 102 shown in FIG. 7 is repeatedly loaded into the shift register 164 of the calculator CUL3 at the timing exactly corresponding to the weights of said data. As a result, the envelope data ENV in the calculator CUL3 virtually assumes such a state as if it was retaining a given depth data VBD. Hence, the data ΔENV supplied from the calculator CUL3 to the calculator CUL2 corresponds to the data ΔVBD, namely the depth data VBD shifted down by 7 bits (multiplied by $2^{-7}$).

Thus, in the normal vibrato, the envelope data ENV is a constant VBD and, therefore, ΔENV or the variation in one calculation time interval is ΔVBD so that the modulating signal (VAL) of a certain depth is obtained as shown in the normal vibrato section in FIG. 15(*a*). It is noted that the envelope data in the low value region is the data ½ ENV, i.e., ½ VBD as in the case of the delay vibrato so that the depths in the high and low value regions are asymmetric with respect to each other. Accordingly, the signal $\overline{ANYQ}$ enables the AND gate 219, which selects the output ½ ENV of the fifteenth stage of the register 164, at a timing of the signal 1T16 in the downcount mode and supplies it to the comparator COM1 through the complement circuit 261. Therefore, the increasing data VAL is folded downwardly (assumes the downcount mode) when it reaches the depth data VBD (or ENV) whereas the decreasing data VAL is folded upwardly (assumes the upcount mode) when it reaches the value −½ ENV.

(4) After-touch vibrato

The after-touch vibrato is processed in almost the same manner as the normal vibrato except that the envelope data ENV results from a given depth data VBD added with an after-touch vibrato depth data KVBD. Referring to FIG. 7, the data KVBD is taken out from the sixth stage of the register 103 similarly to the data VBD. The data KVBD is supplied to an AND gate 281, by which the significant bits (the 6 bits having weights of 1.2 cent to 38 cent) are selected at a timing of the signal 1T6y8 and supplied to the input B of an adder 282. The input A of the adder 282 is provided with the data VBD from the AND gate 272 while the input Ci is provided with the carryout signal Co+1 one time slot behind the date VBD. Accordingly, the adder 282 serially adds the vibrato depth data VBD and the after-touch vibrato depth data KVBD. The added output "VBD+KVBD" is supplied to the AND gate 278 shown in FIG. 13.

As described before, in case where the after-touch vibrato is selected, the signal KVBSS is "1" so that the AND gate 278 is enabled whereas the AND gate 279 is disabled. The depth data "VBD+VBD", affected by the after-touch is selected by the AND gate 278 at a timing of the signal 9T16y16 (the operation timing of the 8 higher bits) and repeatedly loaded to the shift register 164 through the OR gate 277, AND gate 189 and adder 168. Accordingly, the envelope data ENV is the sum of a given vibrato depth data VBD and the after-touch vibrato depth data KVBD so that the vibrato depth is controlled according to the key touch.

(5) Supplemental Description of Attack Pitch and Vibrato

Figure 20A:
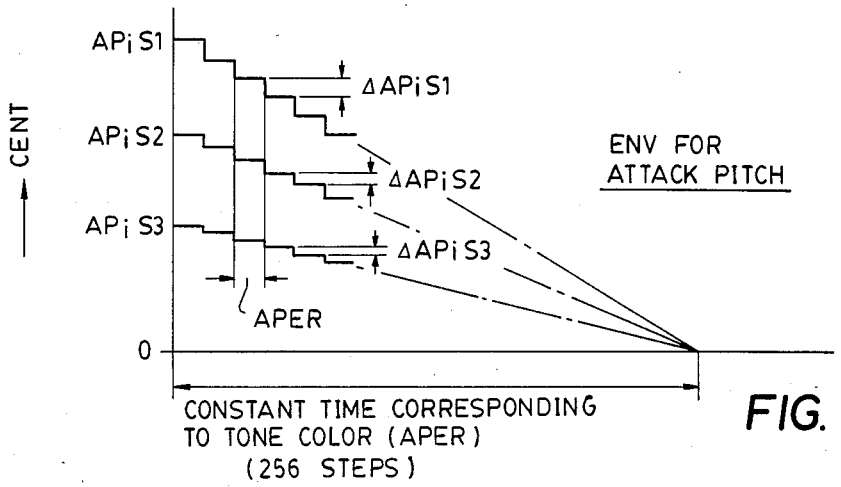
FIG. 20 (*a*) is a diagram showing the change of the envelope data of modulating signals in the attack pitch control, said data corresponding to three different initial values, respectively.
Figure 20B:
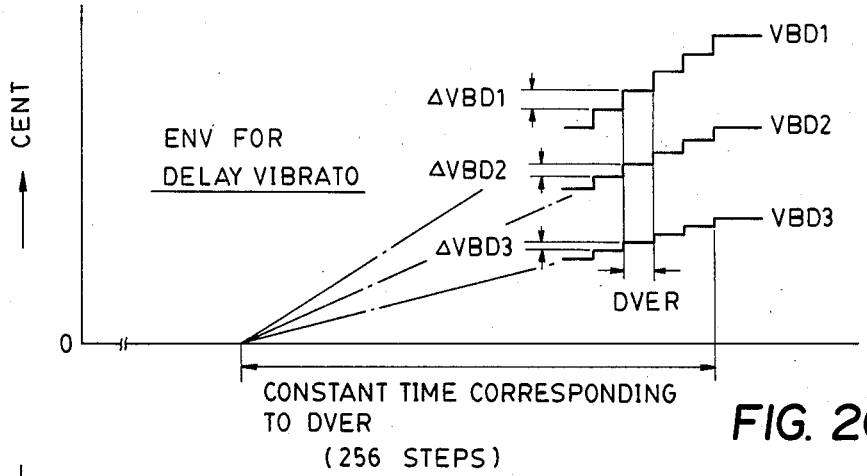
Figure 20C:
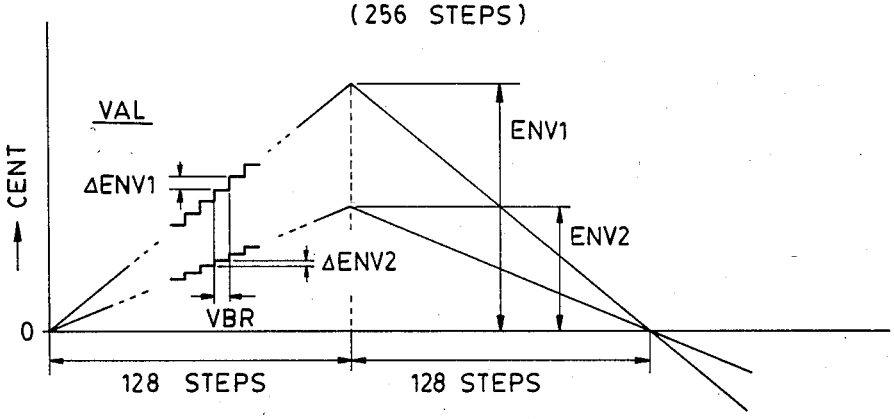

As previously mentioned, the envelope data ENV which changes with time in the attack pitch is such data as obtained by sequentially subtracting the value ΔAPiS, or the initial value APiS shifted down by 8 bits, from the initial value APiS. Hence, the value of the data ENV becomes exactly 0 by subtracting ΔAPiS by the calculator CUL3 $2^8=256$ times whatever the initial value APiS may be. Accordingly, the time it takes the envelope data ENV to change from the initial value APiS to 0, namely, the time during which the attack pitch is effected, is determined, regardless of the initial value APiS, by the attack pitch envelope rate data APER which is in synchronism with the carryout signal of the most significant bit of the calculator CUL4. In other words, the attack pitch is effected for a certain period of time regardless of the initial touch so long as the data APER (a given value corresponding to the selected tone color) is constant. Moreover, the attack pitch depth (initial value) is controlled in accordance with the initial touch and the effect (depth) of the attack pitch is controlled in accordance with the selected tone color. Since the like phenomenon is observed in the frequency variation at the start of tone generation by a natural musical instrument, the attack pitch control of a type as described above provides tonal effects close to the tones produced by a natural musical instrument. The envelope data ENV corresponding to three different initial values APiS1, APiS2, and APiS3 with the same data APER are schematically shown in FIG. 20(*a*).

The same as stated above is true of the change in the envelope data ENV in the delay vibrato. In this case, a target value to be reached by the data ENV is the vibrato depth data VBD. The data ENV is equivalent to such data as obtained by sequentially adding ΔVBD or the target data ENV shifted down by 8 bits. Therefore, whatever the target value VBD may be, the data ENV reaches the target value VBD by $2^8=256$ additions of ΔVBD by the calculator CUL3. Accordingly, the time during which the delay vibrato is effected is determined by the cycle of the carryout signal from the most significant bit of the calculator CUL4, namely by the delay vibrato envelope rate data DVER (DVER'), regardless of the target value VBD. The envelope data ENV corresponding to three different target data each having the same data DVER are schematically shown in FIG. 20(*b*). Thus it is not necessary to make operation adjustments expressly in accordance with the change in the vibrato depth in order to keep the delay vibrato time constant and it is possible to actually effect the delay vibrato for the period of time exactly as set by the potentiometer V4 (FIG. 6), thereby simplifying the control over the tonal effects. The following features are observed in the process of forming the normal vibrato (as well as the after-touch vibrato, delay vibrato, and attack pitch). Firstly, the accumulation of digital data in the calculator CUL1 makes it possible to variably set the frequency of the modulating signal (VAL) without using analog circuits such as voltage-controlled type oscillators. More specifically, a carryout signal (operation timing control signal) is generated at the cycle corresponding to the value of the data (APR, VBR) accumulated in the calculator CUL1, whereas the modulating signal data VAL of the frequency corresponding to the data (APR, VBR) accumulated in the calculator CUL1 is obtained in the calculator CUL2 by repeatedly adding or subtracting a given variation range data ΔENV at the time interval corresponding to said carryout signal while changing the direction of addition and subtraction every time the target value is reached. Secondly, easy control of the frequency and depth is possible. Since the variation rate data ΔENV is obtained by shifting down the target value (the turning point of VAL) or the envelope data ENV by 7 bits, the data VAL changes from 0 to the target value ENV by $2^7=128$ additions of ΔENV, and from ENV to 0 by 128 subtractions of ΔENV, then from 0 to −½ ENV by 64 subtractions of ΔENV and further from −½ ENV to 0 by 64 additions of ΔENV, whatever the target value namely, the envelope data ENV (or the depth data VBD) may be. Thus, the repeating cycle of the modulating signal VAL is determined, regardless of the vibrato depth VBD (envelope ENV), by the period of the carryout signal generated from the calculator CUL1, namely the rate data VBR. The modulating signal VAL corresponding to two different depth data (VBD), i.e., envelope instanteneous data ENV1 and ENV2 for the same rate data VBR is schematically shown in FIG. 20(*c*). It can be seen from this figure also that the frequency is constant regardless of the depth (envelope) so long as the rate data VBR is constant. The frequency and the depth, therefore, need not be adjusted with respect to each other but may be controlled independently of each other, thus simplifying the control thereof.

(6) Slur

The tonal effect imparting circuit 20 comprises two calculators CUL5 and CUL6 as shown in FIG. 14 for providing the slur effect. The calculators CUL5 and CUL6 each comprise 32-stage/1-bit serial shift registers 283 and 284 shift controlled by system clock pulses $\phi_1$ and $\phi_2$, full adders 285 and 286, and logic circuits 287–296 (AND gates), 297–300 (OR gates) provided for operation as well as for controlling the storage operation, respectively. The calculators CUL5 and CUL6 perform serial operation as well as storing operation. The calculator CUL5 stores the frequency data SKC of the tone to be generated in the monophonic mode and, when the slur control is effected, performs the operation to smoothly change the data SKC from its value corresponding to the last depressed key to the value corresponding to the newly depressed key. The key code MKC of the depressed key in the monophonic mode is supplied from the register 37 of the monophonic key assigner shown in FIG. 4 to AND gates 302 and 304 in a frequency data conversion section 301 shown in FIG. 14. The frequency data conversion section 301 outputs the frequency data MKCL expressing the frequency corresponding to the key code MKC in a logarithmic form. The calculator CUL6 finds the difference SKC between the frequency data SKC of the last depressed key and the frequency data MKCL of the newly depressed key when the slur control is started and outputs the small value ΔKCD corresponding to the difference KCD. The calculator CUL5 repeatedly adds or subtracts said ΔKCD to or from the frequency data SKC of the last depressed key thereby gradually approximating SKC to the frequency data MKCL until SKC becomes equal to MKCL when the slur control is completed. The timing of the repeated operation with ΔKCD in the calculator CUL5 is set by the carryout signal COT supplied from the calculator CUL4 shown in FIG. 13.

The calculator CUL4 accumulates the slur rate data SLR supplied from a selector 306 shown in FIG. 12. The slur rate data SLR is obtained on the basis of the slur rate exponent data SRE outputted from the fourth stage of the register 105 shown in FIG. 7 and the mantissa data SRM outputted from the eighth stage of same register. Referring to FIG. 12, the exponent data SRE is applied to the 3-stage shift register 307 and thereby shifted in accordance with the system clock pulses $\phi_1$ and $\phi_2$. The mantissa data SRM is selected by the AND gate 308 at a timing of the signal 2T5 and applied to a shift register 310 through an OR gate 309. As can be seen from the weight indication of each stage in the register 105 shown in FIG. 7, the bits E3, E2 and E1 of the exponent data SRE are each located in the first to third stages of the register 105, respectively, while the bits M4, M3, M2 and M1 of the mantissa data SRM are each located in the fourth to seventh stages, respectively, at the first time slot. Accordingly, the bits M1, M2, M3 and M4 sequentially appear as the data SRM at the second to fifth time slots when the signal 2T5 is generated and these bits only are selected by an AND gate 308 and applied to the shift register 310. The data M1, M2, M3 and M4 applied to the shift register 310 are thereby sequentially shifted in accordance with the clock pulses $\phi_1$ and $\phi_2$. At the sixth time slot, the signal 6y32 is applied to the shift register 310 through the OR gate 309. Accordingly, the data M1, M2, M3, M4 and "1" are sequentially loaded into the shift register 310 and shifted therein sequentially with the progress of time slots. The weight at the fifth time slot is indicated in each stage of the register 310. As will be seen, the bit M1 outputted as the data SRM at the second time slot is located in the third stage of the register 310 three time slots later, or at the fifth time slot as a result of shifting, followed by the bits M2 and M3 in the second and first stages, respectively.

The bits E1, E2 and E3, meanwhile, appear as the exponent data SRE at the second to fourth time slots and are shifted by the shift register 307. As a result, E3, E2 and E1 are each located in the first, second and third stages of the register 307, respectively, at the fifth time slot. The 3-stage output of the register 307 is latched in parallel by a latch circuit 311. The latch circuit 311 latches the output of each stage of the register 307 at the fifth time slot, i.e., the exponent data SRE, or, "E3, E2, E1", on the basis of the signal 5y32s. The data "E3, E2, E1" latched by the latch circuit 311 is supplied to the control input of the selector 306.

The selector 306 decodes the 3-bit data E3, E2, E1 of the latch circuit 311 and selects the input line given a number (one of the decimal numbers 0–7) corresponding to the decoded value (one of the decimal numbers 0–7). The input lines of the selector 306 are each provided, in order of their numbers, with the outputs of the third-tenth stages of the shift register 310. It is noted that the data M1, M2, M3, M4, "1" appear at an earlier timing at a stage of the register 310 assigned an identification number than they appear at another stage thereof assigned a larger identification number. For example, the data M1, M2, M3, M4, "1" appears in order in the output of the third stage corresponding to the number 0 at the fifth to ninth time slots whereas said data appears in order in the output of the tenth stage corresponding to the number 7 at the twelfth to sixteenth time slots. As shown in FIG. 17(*a*), the first time slot corresponds to the least significant bit while the sixteenth time slot corresponds to the most significant bit in the serial operation. Therefore, the data outputted from the third stage (number 0) of the register 310 has the smallest weight and the weights of the data grow doubled, quadrupled, octupled, . . . , i.e., $2^n$-fold as the stages advance.

Thus, the output of one of the third to tenth stages of the shift register 310 is selected in accordance with the output of the latch circuit 311 and outputted as the slur rate data SLR by the selector 306. The slur rate data SLR is the result of the operation $m.2^e$ where e designates the decimal value of the 3-bit binary data E3, E2, E1 and m designates the decimal value of the 5-bit binary data "1", M4, M3, M2, M1. The slur rate data SLR has 12 effective time slots in all, from the fifth time slot, which is the time slot of the least significant bit M1 where the output of the third stage of the register 310, having the smallest weight, is selected, up to the sixteenth time slot, which is the time slot of the most significant bit "1" where the output of the tenth stage of the register 310, having the largest weight, is selected. The slur speed data set by the potentiometer V5 (FIG. 6) has 7 bits, namely, SRM(M1–M4) and SRE (E1–E3). It is thus possible to widen the dynamic range of the slur speed setting amount by way of the processing described above.

Figure 21:
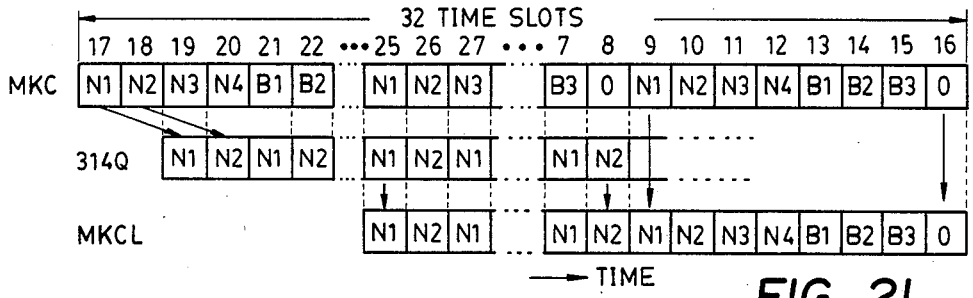
FIG. 21 is a time chart showing the operation whereby the frequency data conversion section illustrated in FIG. 24 converts the key code of the depressed key in the monophonic mode into frequency data in logarithm representation.

As previously mentioned, the key code XKC of the newly depressed key is loaded into the register 37 shown in FIG. 4 at the ninth to sixteenth time slots when the timer finish signal QR is generated. Therefore, the output of the register 37 is switched in synchronism with the seventeenth time slot. The state in each time slot of the key code MKC outputted from the register 37 is as shown in FIG. 21. As will be seen, the bits N1–B3 successively occur in 8 time slots, recurring four times in 32 time slots from the seventeenth time slot to the next sixteenth time slot. The key code MKC is added to the AND gates 302 and 304. The lowest 2 bits N1, N2 are selected by the AND gates 304 enabled by the signal 17T18 (see FIG. 5) at the seventeenth and eighteenth time slots and is applied to a 2-stage flip-flop 314. The 2 bits N1, N2, each delayed by 2 time slots by the flip-flop 314, circulate in the flip-flop 314 through the AND gate 305 which is enabled from the nineteenth time slot to the next sixteenth time slot (see 314Q in FIG. 21). The output of the flip-flop 314 is selected at the twentyfifth to eighth time slots by the AND gate 303 enabled by the signal 25T8 (see FIG. 5) and outputted as MKCL through an OR gate. At the following ninth to sixteenth time slots, all of the 8 bits of the key code MKC are selected by the AND gate 302 enabled by the signal 9T16 and outputted as MKCL by the OR gate 315. Thus the frequency data MKCL comprises, as shown in FIG. 21, 24 bits starting with the twentyfifth time slot and ending by the next sixteenth time slot, of which the higher 8 bits (the sixteenth-ninth time slots) consist of "0" and the octave code B3, B2, B1 of the key code MKC and the note code N4, N3, N2, N1 while the lower 16 bits consist of N2, N1, or, lowest 2 bits of the note code repeatedly added. The frequency data thus composed, as known from the Japanese Patent Preliminary Publication No. 74298-1981 for example, expresses the frequency of the tone corresponding to the key code MKC in a logarithm to the base 2 (i.e., cent value).

Figure 22:
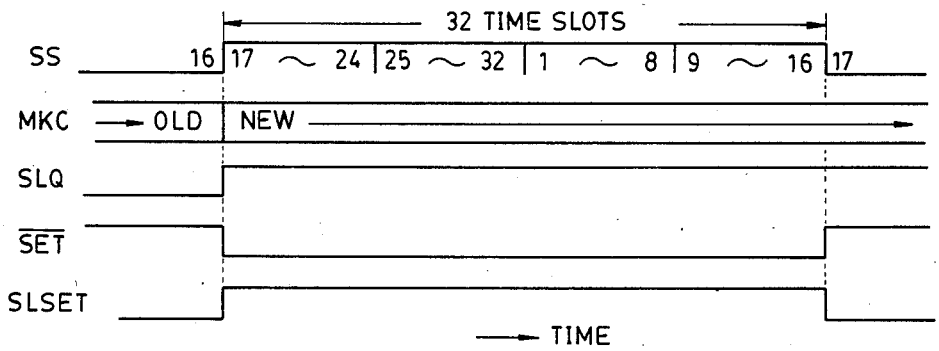
FIG. 22 is a time chart illustrating various signals shown in FIG. 14, at the start of the slur control.

As described before, the slur start signal SS is outputted, upon satisfaction of the conditions for effecting the slur control, from the monophonic key assigner 14A (FIG. 4) during 32 time slots from the seventeenth to the sixteenth time slots immediately following the termination of the waiting time lasting for about 10 ms. The slur start signal SS is supplied to the AND gate 213 shown in FIG. 14. In the monophonic key assigner 14A, moreover, the timer finish signal QR is generated from the ninth to the sixteenth time slots and, based on this signal, the key code MKC of the newly depressed key is loaded into the register 37. Accordingly, the key code MKC outputted from the register 37 shifts from the last depressed key to the newly depressed key in response to the rise of the slur start signal SS as shown in FIG. 22.

Referring to FIG. 14, the AND gate 213 goes to "1" in response to the slur start signal SS and the output "1" of the AND gate 213 is supplied to the OR gates 5, 6 and 7. The output of the OR gate 5 is supplied to the flip-flop 224 whose output rises to "1" 32 time slots after the rise of the signal SS and is thereafter self-held through the AND gate 212 and OR gate 5. The state of the flip-flop 224 is designated by SLQ. The output of the OR gate 5 corresponds to the signal SLQ. The signal SLQ is held all the time while the slur control is effected. The signals $\overline{\text{SET}}$ and $\overline{\text{SETD}}$ maintain "0" during 32 time slots on the basis of the output of the OR gate 7 as in the before-mentioned case (see FIG. 16). Further, the output of the AND gate 213 is supplied as signal SLSET to the AND gates 293 to 295 on one hand and to the AND gate 296 after being inverted by an inverter on the other.

The signal SLQ outputted from the OR gate 5 is supplied to the AND gates 288, 289 and 291 on one hand and to the AND gate 290 after being inverted by the inverter 312 on the other. Before the generation of the slur start signal SS, the signal SLQ is "0" so that the AND gate 290 is enabled whereas the AND gates 288, 289 and 290 are disabled in the calculator CUL5. The AND tate 291 is provided with the frequency data MKCL corresponding to the key code MKC of the depressed key. The frequency data MKCL is applied to the shift register 283 through the AND gate 290, OR gate 298 and adder 285. Therefore, the frequency data MKCL corresponding to the key code MKC is itself the frequency data SKC of the tone to be generated. MKCL is generated from the twentyfifth to the sixteenth time slots as shown in FIG. 21 so that the weight in each stage of the register 283 is as shown. The weights of the repeated bits N2, N1, or the lowest 2 bits of the note code are indicated by cent. Where the key code is converted to the frequency data expressed in logarithm to the base 2, the least significant bit N1 of the original note code has a weight of 75 cent. Hence, for example, the bit less significant than the bit N1 by one bit (i.e., the ninth stage of the register 283 at the seventeenth time slot) has a weight of about 38 cent and the bit still less significant by one bit has a weight of about 19 cent.

When the signal SLQ rises to "1", the AND gate 291 is enabled and the AND gate 290 is disabled. Accordingly, the frequency data MKCL corresponding to the newly depressed key is inhibited while the frequency data SKC corresponding to the last depressed key and loaded to the register 283 immediately before the inhibition is held so as to circulate through the register 283 and the AND gate 291.

The AND gates 293 to 295 of the calculator CUL6 are enabled by the signal SLSET corresponding to the slur start signal SS during 32 time slots from the seventeenth to the next sixteenth time slots. As will be seen from FIGS. 21 and 22, the frequency data MKCL corresponding to the newly depressed key is outputted from the twentyfifth to the sixteenth time slots out of the 32 time slots during which the signal SLSET is generated and is supplied to the input B of the adder 286 through the AND gate 295 and OR gate 300. On the other hand, the frequency data SKC of the last depressed key outputted from the last stage of the register 283 is inverted by the inverter 316 and supplied (as $\overline{\text{SKC}}$) to the input A of the adder 286 through the AND gate 294. Further, at the seventeenth time slot corresponding to the least significant bit of SKC, "1" is outputted from the AND gate 293 based on the signal 17y32 and supplied to the input Ci of the adder 286. The AND gate 293, 294 and an inverter 316 are provided to convert SKC to the two's complement thereof, namely a negative value −SKC. Therefore, the adder 286 performs the serial operation "MKCL-SKC" of subtracting the frequency data SKC of the last depressed key from the frequency data MKCL of the newly depressed key, thereby obtaining the difference between the two data. The difference thus obtained, or the data KCD, is loaded into the register 284, so as to circulate therein through the register 284 which is enabled after the fall of the signal SLSET. The adder 286 does not perform its operation while the difference data KCD is held as the AND gates 293 to 295 are disabled.

While, on the other hand, the calculator CUL6 is performing the operation with the difference data KCD on the basis of the signal SLSET, the calculator CUL5 just holds the frequency data SKC of the last depressed key through the AND gate 291 without performing operation as the AND gates 288 and 289 are disabled by the signal $\overline{\text{SET}}$. In the meantime, the calculator CUL4 shown in FIG. 13 clears the old content of the register 165 as well as receives the slur rate data SLR mentioned before through the AND gate 195 enabled by the signal SLQ. As previously described, the slur rate data SLR outputted from the selector 306 is effective from the fifth through the sixteenth time slots and is repeatedly supplied every 32 time slots. The slur rate data SLR is repeatedly added in the calculator CUL4 every 32 time slots (16 $\mu$s). When the carryout signal COT of the most significant bit is outputted from the calculator CUL4 at the seventeenth time slot, "1" is latched to the latch circuit 317 shown in FIG. 14 by the signal 17y32S and held during 32 time slots. The output of the latch circuit 317 is supplied to the AND gates 288 and 289 of the calculator CUL5.

The twentyfourth stage of the register 284 outputs data ΔKCD obtained by shifting down the difference data KCD by 8 bits (or multiplying the difference data by $2^{-8}$). The data ΔKCD is supplied to the AND gate 289 as well as applied to the latch circuit 318 which is provided to extend the sign bit (S). Since the difference data KCD can be of a negative value (two's complement), the sign bit (S) is located next to, and at a higher side of, the most significant bit (B3). As the data ΔKCD is obtained by shifting down the thus composed difference data by 8 bits, one sign bit (S) is not enough and, therefore, another sign bit needs to be added thereto. The sign bit (S) occurs at the eighth time slot in the data ΔKCD taken out from the twentyfourth stage of the register 284. That is, the sign bit (S) occurs at the sixteenth time slot in the data KCD so that the sign bit (S) occurs at the eighth time slot in the data ΔKCD which is obtained by shifting down the data KCD by 8 bits. Therefore the value of the sign bit (S) is latched to the latch circuit 318 by the signal 8y32S (FIG. 5) and converted into direct current.

Figure 23:
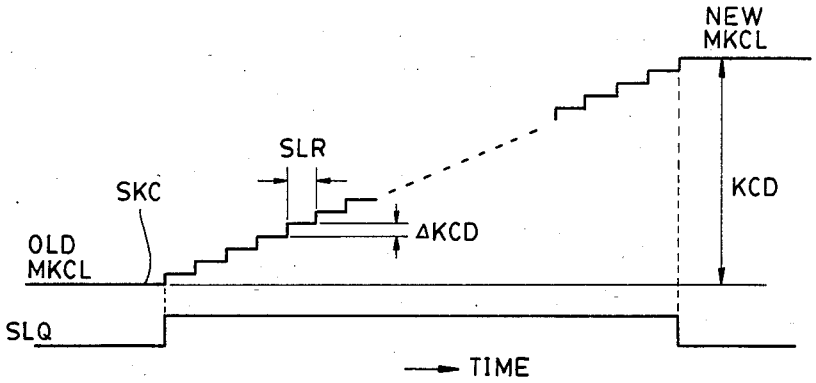
FIG. 23 is a diagram showing the change of the frequency data in the slur control.

When the difference data KCD (ΔKCD as well) is positive, namely, when the newly depressed key is for a higher note than the last depressed key, the sign bit (S) is "0" and the AND gate 288 remains disabled all the time. In this case, the AND gate 289 only is enabled in response to the carryout signal COT from the calculator CUL4. The data ΔKCD is supplied to the input A of the adder 285 through the AND gate 289 and OR gate 297 and added to SKC. Since the data ΔKCD is the data obtained by shifting down the data KCD by 8 bits, data of no use occurs at the operation timing of the higher 8 bits, namely, from the ninth to the sixteenth time slots. In order to inhibit such useless data, rendering those bits all "0", the AND gates 289 is provided with the inverse of the signal 9T16. In the calculator CUL5, the data ΔKCD is sequentially added to the frequency data SKC at the time interval corresponding to the slur rate data SLR (or corresponding to the carryout signal of the calculator CUL4), thereby gradually approximating SKC to the frequency data MKCL of the newly depressed key (see FIG. 23).

When, in the meantime, the difference data KCD (ΔKCD as well) is negative, namely, when the newly depressed key is for a lower note than the last depressed key, the sign bit (S) is "1" and the AND gate 288 remains enabled all the time. In this case, the AND gates 288 and 289 are both enabled in response to the carryout signal COT from the calculator CUL4. As mentioned before, the effective bits of the data ΔKCD are selected by the AND gate 289 from the seventeenth to the eighth time slots and added to the adder 285. In this case, the data ΔKCD is expressed as the two's complement. The AND gate 288 is provided with the signal 9T16 and supplies all "1" to the adder 285 at an operation timing of the higher 8 bits, i.e., from the ninth to the sixteenth time slots. Thus the sign bit (S), namely, "1" joins the higher 8 bits of the data KCD expressed as the two's complement. In this case, the data ΔKCD is serially subtracted from the frequency data SKC in the calculator CUL5 at the time interval corresponding to the slur rate data so that SKC gradually approaches MKCL of the newly depressed key.

When the slur control is effected, the signal SLQ enables the AND gates 241 and 245, through which the frequency data SKC is supplied to the input A of the comparator COM2 while MKCL is provided to the input B. The comparator COM2 detects whether the frequency data SKC of the calculator CUL5 has reached the target value or the frequency data MKCL of the newly depressed key. When the newly depressed key is for a higher note than the last depressed key, "0" is latched by the latch circuit 318 whereas when the newly depressed key is for a lower note than the last depressed key, "1" is latched by the latch circuit 318, as mentioned before. The output of the latch circuit 318 is supplied to the latch circuit 319 and thereby latched in synchronism with the seventeenth time slot by the signal 17T24. The output of the latch circuit 319 is added to an AND gate 320 on one hand and to an AND gate 321 after being inverted by the inverter 323 on the other.

When the newly depressed key is for a higher note than the last depressed key, the output of the latch circuit 319 is "0" and, by the output "1" of the inverter 323, the AND gate 321 is enabled. In this case, when SKC has not yet reached the target value MKCL, $A<B$ is satisfied in the comparator COM2 so that the output $A \geqq B$ is "0". Therefore, the signal "0" is supplied from the AND gate 236 to the AND gate 321. The output "0" of the AND gate 321 is supplied through an OR gate 322 to the inverter 324, where it is inverted so that "1" is supplied from the inverter 324 to the AND gate 212. Accordingly, the signal SLQ of the flip-flop 224 is held through the AND gate 212. When SKC reaches the target value MKCL, the output A B of the comparator COM2 goes to "1" so that "1" is supplied to the AND gate 321 through the AND gate 236 while the output of an inverter 324 goes to "0". Thus the signal SLQ is reset and the slur control terminates.

In case, on the other hand, the newly depressed key is for a lower note than the last depressed key, the output of the latch circuit 319 is "1" so that an AND gate 320 is enabled. When SKC has not yet reached the target value MKCL, $A>B$ is satisfied in the comparator COM2 and hence the output $A \leqq B$ is "0". Therefore, the signal "0" is supplied from the AND gate 237 to the AND gate 320 and hence to the inverter 324 through the OR gate 322, thus holding the signal SLQ as in the previously mentioned case. When SKC reaches the target value MKCL, the output A≦B of the comparator COM2 goes to "1" so that "1" is supplied from the AND gate 237 to the AND gate 320 and the AND gate 212 is disabled by the output "0" of the inverter 324, thus resetting the signal SLQ.

When the signal SLQ falls, the AND gates 288, 289 and 291 are disabled and the AND gate 290 is enabled. Accordingly, the frequency data MKCL of the depressed key itself is thereafter loaded into the register 283 as SKC. In the case of legato new key-on, the frequency data SKC of the tone to be generated thus changes smoothly at a certain rate from the value corresponding to the last depressed key to the value corresponding to the newly depressed key, thereby effecting the slur control. The period of time during which the frequency data SKC changes is determined by the slur rate data SLR set by the potentiometer V5 (FIG. 6) regardless of the difference in frequency between the last and newly depressed keys. This is because the slur control terminates by $2^8=256$ operations involving ΔKCD irrespective of the value of the difference data KCD since the data ΔKCD, which is obtained by shifting down the difference data KCD by 8 bits, is repeatedly added or subtracted at the time interval corresponding to the slur rate data SLR. It should also be noted that the AND gate 209 is enabled by the output "1" of the OR gate 322 at the termination of the slur control, so that the conditions for starting the delay vibrato control are satisfied.

(7) Summary of the tonal effects

Figure 24:
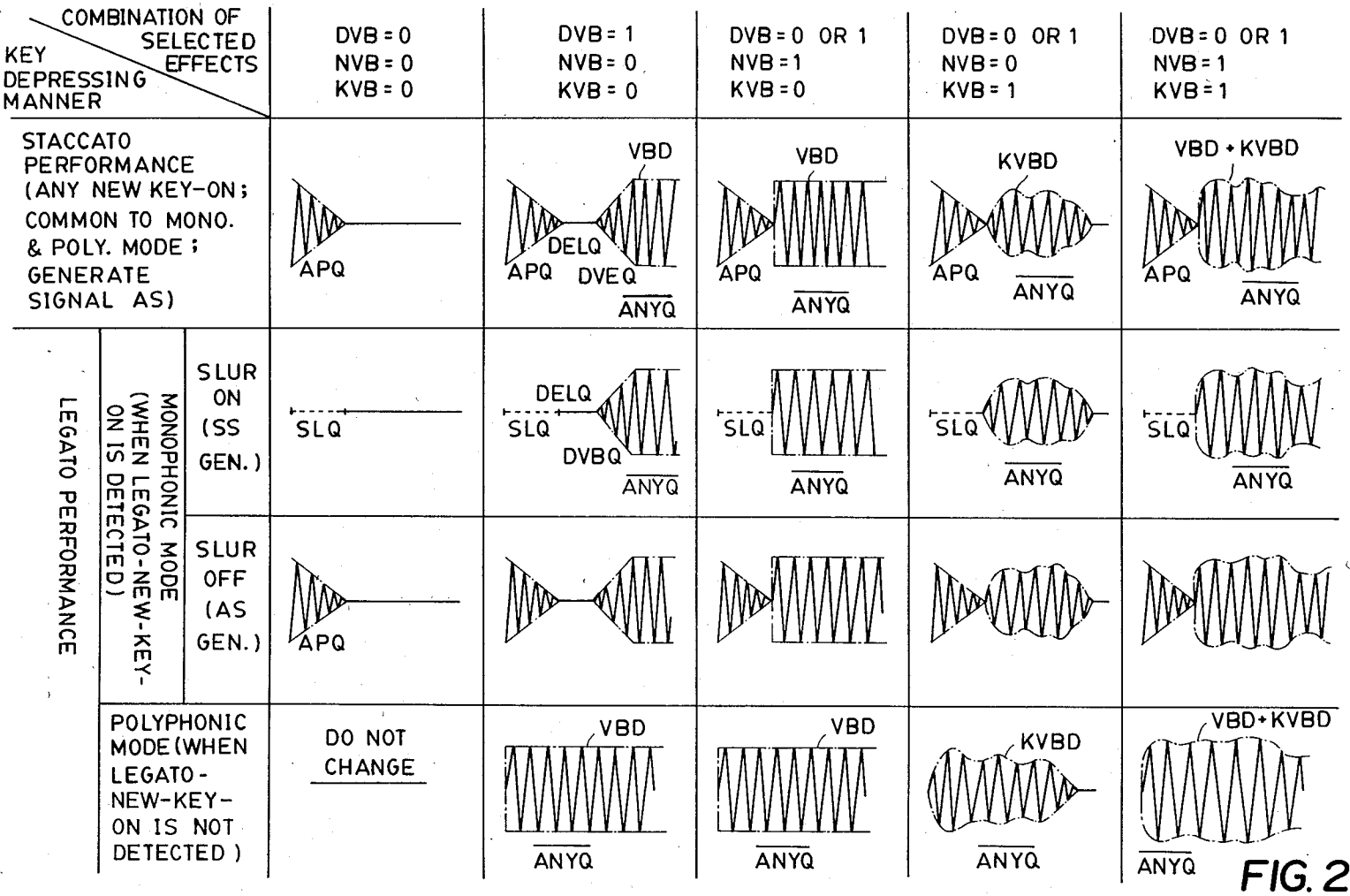
FIG. 24 illustrates various tonal effect combinations realized by the embodiment depending on the tonal effects selected and the key performance.

FIG. 24 illustrates the tonal effects such as the attack pitch, slur, vibrato, etc. obtained in the tonal effect imparting circuit 20 in various forms depending on the combination of the selected tonal effects and the manner in which the key is depressed. Selection of the tonal effects is indicated in the uppermost horizontal space, wherein DVB, NVB, KVB each represent the delay vibrato, normal vibrato, after touch vibrato, respectively, the symbol "1" meaning that a tonal effect is selected while "0", not selected. Selection of the delay vibrato (DVB) is made by the potentiometer V4 (FIG. 6) such that the delay vibrato is not selected when the value set by the potentiometer V4 is 0 and is selected when said value is other than 0. The normal vibrato (NVB) and the after touch vibrato (KVB) are selected by the respective selection switches NVBS and KVBS (FIG. 14). It should be noted that the potentiometers V2 and V3 (FIG. 6) may be used in place of the selection switches NVBS and KVBS. The key depressing manner is indicated in the left-hand side column in FIG. 24. The staccato performance is a way of performance in which a key is newly depressed when no other key is in a depressed position so that "any new key-on" as earlier mentioned is detected. In this performance, tonal effect combinations common to the monophonic mode and polyphonic mode are obtained. This is because the monophonic key assigner 14A shown in FIG. 4 is adapted to generate the attack pitch start signal AS in response to "any new key-on" when either of the monophonic mode and polyphonic mode is selected. The legato performance is a way of performance in which a key is newly depressed before the last depressed key is released so that "legato new-key-on" as stated before is detected. In this performance, the tonal effect combinations available are difference between the monophonic mode and the polyphonic mode. In the monophonic mode, moreover, the tonal effect combinations vary depending whether the slur effect is selected or not. This is because, in the case of legato new key-on, the monophonic key assigner 14A shown in FIG. 4 is adapted to generate the slur start signal SS when the slur effect is selected (slur on) in the monophonic mode and generate the attack pitch start signal AS when the slur effect is not selected (slur off) in the monophonic mode, without carrying out detection itself of "legato new key-on" (see the AND gate 77 and the flip-flop NKQ) in the polyphonic mode.

Tonal effect combinations are schematically shown where the corresponding vertical and horizontal spaces meet in FIG. 24. Reference to FIG. 15(*a*) may help understand the schematic views in FIG. 24, which illustrate in an exaggerated manner the change of the modulating signal (VAL) and the depth envelope (ENV) which characterize the tonal effect combinations. The characters are added in the views so that the tonal effects combined may be clear. Those characters correspond to the states of the flip-flops 224 to 227 (FIG. 14), including APQ for the attack pitch, DELQ for the delay vibrato start time, DVBQ for the delay vibrato and $\overline{\text{ANYQ}}$ for the normal vibrato or after touch vibrato. SLQ indicates the part at which the slur is effected. VBD indicates the depth of the normal vibrato while KVB indicates the depth of the after touch vibrato.

It will not be necessary to repeat the reasons here why such various tonal effect combinations as shown in FIG. 24 are possible as they will be clear from the description given above. One of the characteristic features which will become apparent by the summary is that it is automatically decided whether the attack pitch is to be effected or not in accordance with the manner in which the key is depressed as well as with the distinction between the monophonic and polyphonic modes. Such automatic attack pitch imparting has never been hitherto known.

Description of the tone Signal Generation Section

Figures 25, 26:
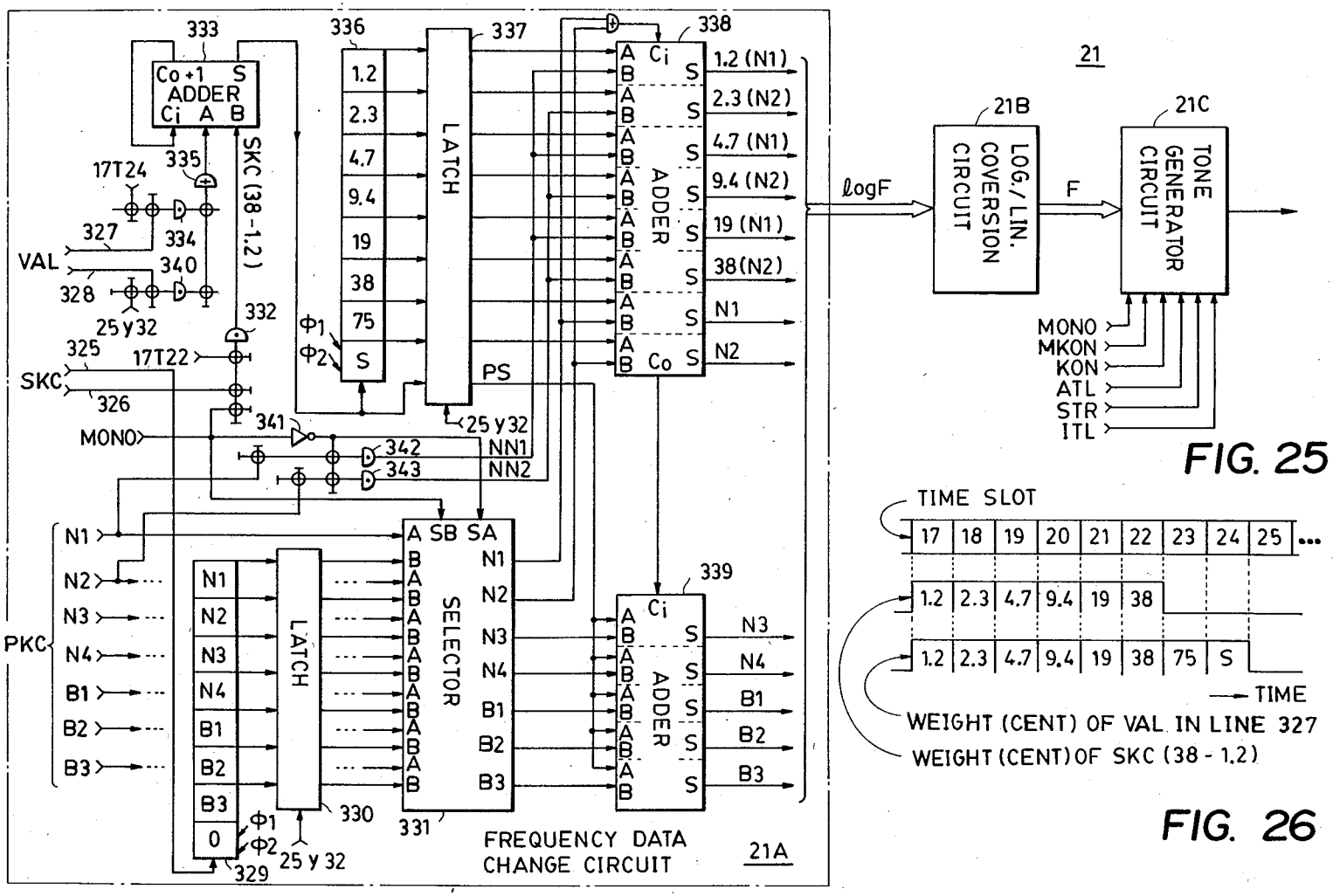
FIG. 25 is a circuit diagram of an example of the tone signal generation section shown in FIG. 2, illustrating the frequency data change circuit particularly in detail.
FIG. 26 is a time chart showing the operation timing of the lower bits of the monophonic frequency data and the modulating signal instantaneous data shown in FIG. 25.

FIG. 25 illustrates in detail an example of the tone signal generation section 21 (FIG. 2), particularly the frequency data change circuit 21A comprised in the generator 21. The frequency data change circuit 21A changes the frequency data of the tone to be generated in accordance with the modulating signal instantaneous value data VAL supplied from the register 163 (FIG. 13) of the tonal effect imparting circuit 20 and outputs pitch-controlled frequency data. The frequency data change circuit 21A is used commonly in the monophonic and polyphonic modes and its circuit function is switched depending on the mode selected.

In case the monophonic mode is selected, the frequency data change circuit 21A adds the modulating signal instantaneous value data VAL supplied from the register 163 of the calculator CUL2 shown in FIG. 13 to the monophonic frequency data SKC supplied from the register 283 of the calculator CUL5 shown in FIG. 14. As stated before, the frequency data SKC is expressed in logarithm (cent value) and the data VAL also is expressed as a cent value. By adding one data to the other (or subtracting one from the other), therefore, the frequency data log F in a logarithmic form (by cent) is obtained which corresponds to the cent value of the monophonic frequency data SKC shifted toward the high value region or low value region by the cent value corresponding to the data VAL.

The monophonic frequency data SKC is used for operation with its higher 7 bits or key code portion (B3 to N1) separate from its lower data portion having weights of 38 cent to 1.2 cent. Accordingly, the data SKC is taken out from the eighth stage of the register 283 shown in FIG. 14 through the line 325 and also from the fourteenth stage through the line 326. Referring to FIG. 25, the data SKC is applied through the line 325 to an 8-stage/1-bit shift register 329 and shifted sequentially in accordance with the system clock pulses $\phi_1$ and $\phi_2$. The outputs (7 bits in all) of the second to the eighth stages of the shift register 329 are supplied in parallel to a latch circuit 330 so that the contents of the register 329 are latched in parallel by the latch circuit 330 by the signal 25y32 (FIG. 5). Since each stage of the shift register 283 has a weight as shown in FIG. 14 at the seventeenth time slot, the higher 8 bits of the data SKC, namely, N1, N2, N3, N4, B1, B2, B3, "0" (i.e., key code portion) occur sequentially in the line 325 and are loaded sequentially into the shift register 329 shown in FIG. 25 from the seventeenth to the twentyfourth time slots (8 time slots in all). At the twentyfifth time slot, therefore, each stage of the register 329 has a weight as shown in FIG. 25 and the higher 7 bits or key code portion B3 to N1 of the data SKC is latched by the latch circuit 330 by the signal 25y32. Thus the latch circuit 330 outputs the key code portion B3 to N1 of the monophonic frequency data SKC all the time. The outputs of the latch circuit 330 are applied to the inputs B of a selector 331. The monophonic mode selection signal MONO outputted from the monophonic mode selection switch NO-SW (FIG. 2) is supplied to the B selection control input SB of the selector 331 so that the data B3 to N1 supplied from the latch circuit 330 to the input B is selected by the selector 331 in the monophonic mode.

In the meantime, the data SKC supplied through the line 326 is fed to an AND gate 332. The AND gate 332 is provided with the monophonic mode selection signal MONO and the timing signal 17T22 and selects the data from the line 326 from the seventeenth to the twentysecond time slots, provided that the data is of the monophonic mode. Each stage of the register 283 has a weight as shown in FIG. 14 at the seventeenth time slot so that, from the seventeenth to the twentysecond time slots (6 time slots in all), the 6 bits of the data SKC having weights of 1.2 cent to 38 cent sequentially occur in the line 326 and the serial 6-bit data SKC (38 ~ 1.2) is selected by the AND gate 332 and supplied to the input B of an adder 333 (see FIG. 26).

The modulating signal data VAL stored in the register 163 shown in FIG. 13 is taken out from its eighth stage through a line 327 as well as from its ninth stage through the line 327. Referring to FIG. 25, the modulating signal VAL from the line 327 is supplied to an AND gate 334 and thereby selected from the seventeenth to twentyfourth time slots by the timing signal 17T24 (FIG. 5). Each stage of the shift register 163 has a weight as indicated in FIG. 13 at the seventeenth time slot so that, from the seventeenth to the twentyfourth time slots (8 time slots in all), the highest 8 bits of the data VAL having weights from 1.2 cent to 75 cent and the sign bit (S) occur in the line 327 and selected by the AND gate 334. The output of the AND gate 334 is supplied through an OR gate 335 to the input A of the adder 333. Therefore, the higher 8 bits of the data VAL (the 7 bits having weights of 1.2 cent to 75 cent as well as the sign bit) are serially applied to the input A of the adder 333 from the seventeenth to the twentyfourth time slots as shown in FIG. 26.

As will be seen from FIG. 26, the adder 333 performs a serial operation by adding the lower 6 bits (32 to 1.2) of the data SKC and the data VAL such that a bit of the data SKC having a weight is added to a bit of the data VAL having the same weight. The carryout signal generated by the addition of bits of a certain weight is outputted from the carryout output Co+1 at the following time slot and supplied to the input Ci so as to be added to the data more significant by one bit. It is noted that, in case the data VAL is expressed as a negative value (the two's complement), subtraction is virtually performed in the adder 333.

The output of the adder 333 is applied to an 8-stage/1-bit shift register 336 and therein shifted sequentially in accordance with the clock pulses $\phi_1$, $\phi_2$. The shift register 336 and the latch circuit 337 are provided to rearrange the serial addition output into the parallel data, similarly to the shift register 329 and the latch circuit 337. The result of addition involving the bits having a weight of 1.2 cent, outputted from the adder 333 at the seventeenth time slot, is shifted up to the eighth stage of the shift register 336 eight time slots later at the twentyfifth time slot. At the twentyfifth time slot, therefore, the stages of the shift register 336 each have weights corresponding to 1.2 cent to 75 cent as well as the sign bit (S) as shown and the data of such weights are latched in parallel to the latch circuit 337 by the timing signal 25y32.

The 8-bit data latched by the latch circuit 337, corresponding to the weights of 1.2 cent to 75 cent and the sign bit is supplied to the inputs A of an 8-bit parallel adder 338. The lowest 2 bits N1 and N2 of the key code outputted from the selector 331 are applied to the respective inputs B for the highest 2 bits of the adder 338. Further, data NN1 and NN2 are applied to the inputs B for the least significant bit of the adder 338, said data remaining "0" all the time when in the monophonic mode. Accordingly, the adder 338 adds the least significant bit N1 of the key code portion of the data SKC to the addition result having a weight of 75 cent supplied from the latch circuit 337 and adds the bit N2 of said key code portion to the addition result having a weight of the sign bit supplied from the latch circuit 337. This is because the adder 333 only carries out addition whereby the bits of the data SKC having weights of 38 cent to 1.2 cent are virtually added to the bits of the data VAL having the corresponding weights and does not perform the addition involving the bits having weights of 75 cent and more. The adders 338 and 339, therefore, carry out the addition involving the bits having weights of 75 cent and more.

The carryout output Co of the most significant bit of the adder 338 is supplied to the carrying input Ci of the least significant bit of the adder 339, a 5-bit parallel adder, whose inputs B are provided respectively with the higher 5 bits B3, B2, B1, N4, N3 of the key code portion of the data SKC outputted from the selector 331. The least significant bit N1 of the key code portion of the frequency data SKC expressed in a logarithmic form as mentioned before is equivalent to the weight of 75 cent and the more significant bit N2 is equivalent to the weight of 150 cent. Therefore the adder 338 adds the outputs of the latch circuit 337 having a weight of 75 cent and the weight more significant by one bit to the bits N1 and N2, respectively. The addition involving still more significant bits is carried out by the adder 339.

In the operation involving this complement, the sign bit needs to be extended up to the most significant bit. For this purpose, the latch circuit 337 comprises an extra latching position for the extended sign bit signal PS. The output of the adder 333 is applied to this latching position. The data VAL from the line 328 is supplied to an AND gate 340. The sign bit (S) of the data VAL occurring in the line 327 at the twentyfourth time slot as shown in FIG. 26 occurs in the line 328 one time slot later, at the twentyfifth time slot. This 1-time-slot delayed sign bit (S) is sampled by the AND gate 340 by the timing signal 25y32 and supplied to the input A of the adder 333 through the OR gate 335. The addition output corresponding to the delayed sign bit (S) is latched to a latch circuit 337 so as to be used as the extended sign bit signal PS. The sign bit thus extended (all "1" or all "0") is added to the higher 5 bits B3 to N3 of the data SKC.

In the monophonic mode, therefore, the frequency data change circuit 21A carries out the addition whereby the modulating signal data VAL is added to the monophonic frequency data SKC such that the bits added to one another have equal weights. The operation by the frequency data change circuit 21A is a virtual subtraction in case the data VAL has a negative value (two's complement). The adder 339 and 338 thus output the frequency data log F obtained by shifting the frequency data SKC in either of the directions of the high value and low value regions in accordance with the value by cent of the data VAL. The output of each bit in the adders 339 and 338 has a weight as shown. In case no deviation is created in the pitch, the truth values of those bits having weights of 38 cent to 1.2 cent correspond to the lowest 2 bits N2 and N1 of the key code portion in a repeated manner as indicated in parentheses adjacent to the respective weight indications of 38 cent to 1.2 cent.

The pitch-controlled frequency data log F in a logarithmic form outputted from the frequency data change circuit 21A is applied to a logarithm-linear conversion circuit 21B thereby to be converted to frequency data F in a linear form. The frequency data F is applied to a tone generator circuit 21C, which generates the tone signal of a frequency corresponding to the data F. Various tone generating systems are available for use in the tone generator circuit 21C, including the frequency modulation system, the harmonics synthesizing system, the waveform memory read-out system, the particulars of which will not be mentioned here.

In a case where the polyphonic mode is selected, the frequency data change circuit 21A produces frequency data in a logarithmic form as mentioned before based on the key code PKC of the depressed key in the polyphonic mode and adds the modulating signal instantaneous value data VAL to said frequency data. In the case of the polyphonic mode, a polyphonic key assigner 14B (FIG. 2) outputs a plurality of the key codes PKC indicating the depressed keys assigned to a plurality of the respective tone generating channels on a time shared basis in every channel and supplies those key codes PKC to the frequency data change circuit 21A. The key code PKC consists of the 7 bits B3 to N1 as in the case mentioned before. The bits B3 to N1 of the key code PKC are supplied to the respective inputs A of the selector 331. The monophonic mode selection signal MONO, "1", is inverted by an inverter 341, whose output "1" enables the A selection control input so that the key code PKC for the polyphonic mode is selected. Besides, the output "1" of the inverter 341 enables AND gates 342 and 343 to select the lowest 2 bits of the key code PKC, i.e., N2 and N1, which are applied as data NN2 and NN1 alternately to the inputs B for the lower 6 bits of the adder 338. Thus the key code PKC is now the result of adding its lowest 2 bits N2 and N1 as still less significant bits repeatedly (namely, converted to frequency data in a logarithmic form).

Meanwhile, the AND gate 332 is disabled and the adder 333 outputs the modulating signal data VAL as it is by the signal MONO of "0". Consequently, the data VAL is latched by the latch circuit 337 as it is as well as the sign bit extension signal PS. Accordingly, the adders 338 and 339 add (subtract in case the data VAL has a negative value) the data VAL to the frequency data in a logarithmic form corresponding to the key code PKC such that the bits added with one another have equal weights, and outputs the pitch-controlled frequency data log F in a logarithmic form. The tone generator circuit 21C comprises a plurality of tone generation channels and generates a tone in every channel based on the frequency data of each channel supplied on a time shared basis.

Figure 27:
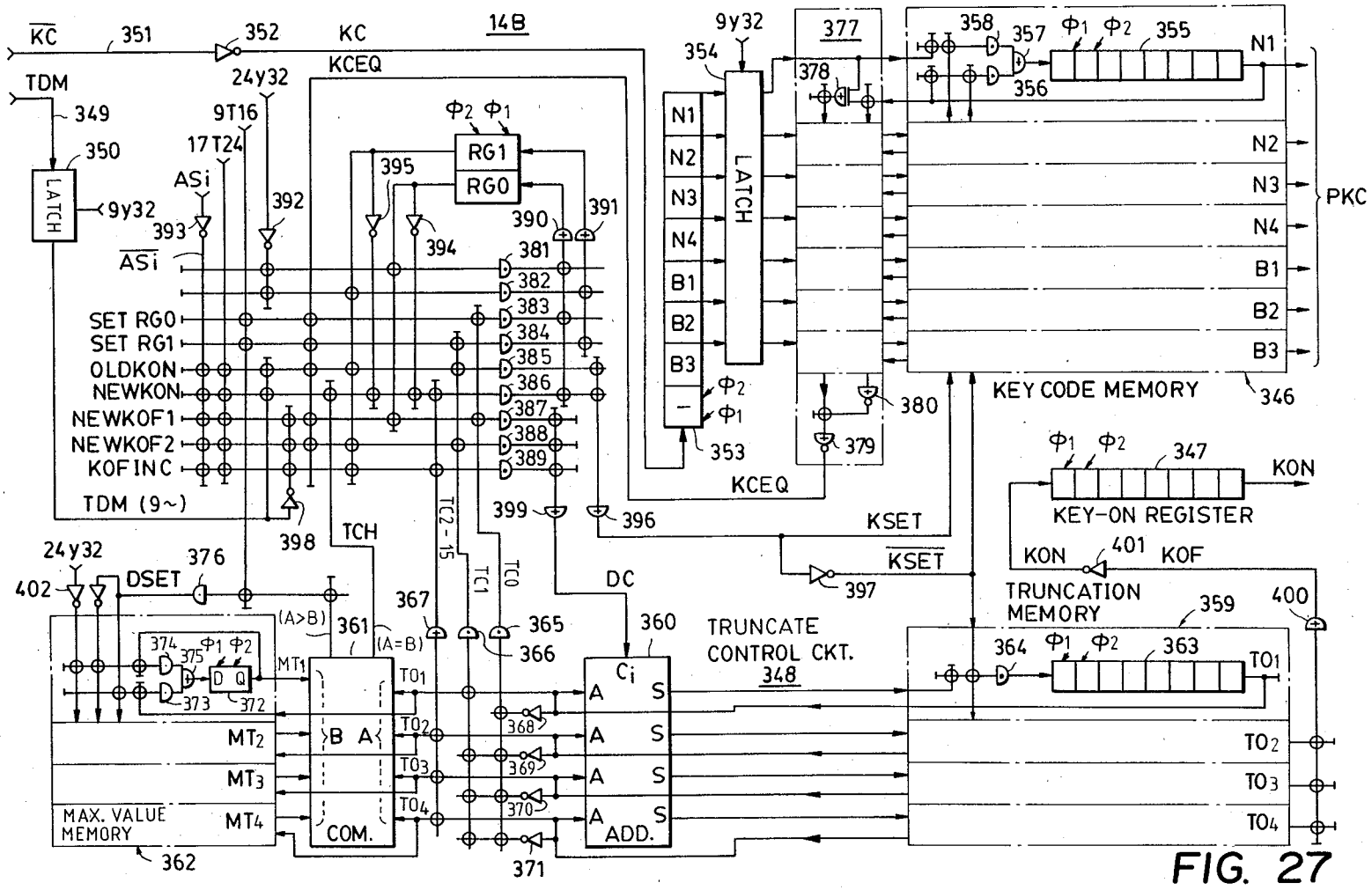
FIG. 27 is a circuit diagram illustrating in detail an example of the polyphonic key assigner shown in FIG. 2.

As a matter of course, the tone generator circuit 21C is adapted to generate a tone signal in response to the monophonic mode as well as the polyphonic mode and comprises, for example, a monophonic mode tone generation channel and polyphonic mode tone generation channels. The tone generation circuit 21C is provided with the monophonic mode selection signal MONO, the monophonic key-on signal MKON outputted from the monophonic key assigner 14A (FIG. 4) and the polyphonic key-on signal KON outputted from the polyphonic key assigner 14B (FIG. 27 later referred to). In case the monophonic mode is selected (where MONO is "1"), the tone generator circuit 21C forms the tone amplitude envelope based on a monophonic mode key-on signal MKON and controls the tone generation based on the tone signal according to said amplitude envelope by using the monophonic mode tone generation channel. In case the polyphonic mode is selected (where MONO is "0"), the circuit 21C forms the tone amplitude envelope in every channel based on the polyphonic mode key-on signal KON and controls the tone generation in every channel according to the amplitude envelope. The tone generator circuit 21C is further provided with after touch level data ATL, sustain speed data STR, and initial touch level data ITL from the registers 106, 107, and 108 shown in FIG. 7 respectively and, based on such data, controls the volume of the tone as well as the sustaining time of the amplitude envelope.

Description of the Polyphonic Key Assigner

Referring to FIG. 27, the polyphonic key assigner 14B comprises a key code memory 346, key-on register 347, truncate device 348, and a control device (all the parts of the assigner 14B but the circuits 346, 347, and 348) which implements the assignment process and controls the circuits 346, 347, and 348. The key assigner 14B is characterized in that it carries out an effective assignment operation by successfully dealing with the temporary interruption of the time division multiplexed key data caused by chattering of the key switch.

Figure 28:
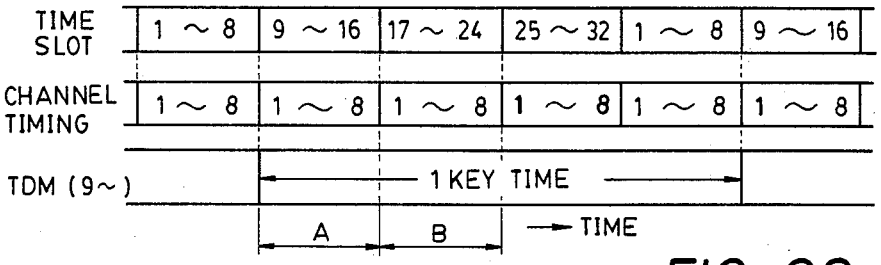
FIG. 28 is a time chart showing the relation in terms of time between various processing by the circuit shown in FIG. 27.

The time division multiplexed key data TDM outputted from a multiplexer 30 (FIG. 3) of a depressed key detector 12 is supplied through a line 349 to a latch circuit 350 shown in FIG. 27 and thereby latched by the timing signal 9y32. Serial key code $\overline{KC}$ outputted from the last stage (Q16) of the shift register 25 (FIG. 3) comprised in a counter 13 for controlling the key switch scanning is supplied through a line 351 to the key assigner 14B shown in FIG. 27. Since the key code $\overline{KC}$ is the inverse of the proper key code KC, as mentioned before, an inverter 352 inverts the key code $\overline{KC}$ to obtain the proper key code KC. The serial key code KC is supplied to an 8-stage/1-bit shift register 353 and shifted sequentially in accordance with the system clock pulses $\phi_1$ and $\phi_2$. The second to eighth stage outputs of the shift register 353 are applied in parallel to a latch circuit 354 and latched at a timing of the signal 9y32. As stated earlier, each stage of the shift register 25 has a weight as indicated in each block in FIG. 3 at the first time slot. Eight time slots thereafter at the ninth time slot, the bits B3 to N1 of the key code KC are shifted to the second to the eighth stages of the shift register 353 as indicated in the blocks in FIG. 27. Therefore the bits B3 to N1 of the key code each indicating the key presently scanned are held in the latch circuit 354 during 32 time slots from the ninth to the eighth time slots. In synchronism with this, the key data TDM indicating the depression or release of the key corresponding to the key code KC latched by the latch circuit 354 is held by the latch circuit 350 during 32 time slots from the ninth to the eighth time slots. Accordingly, the key data TDM (9~) outputted from the latch circuit 350 is delayed by 8 time slots in relation to the key data TDM. FIG. 28 illustrates the section of the key data TDM (9~) corresponding to one key. In this section, the key data TDM (9~) indicates "key switch-on" when it is "1" and "key switch-off" when "0".

The key code memory 346 is provided to store the key code PKC of the depressed key assigned to each channel. The memory 346 comprises 8-stage/1-bit shift registers 355 for the respective bits B3 to N1 of the key code PKC and stores the key code PKC for 8 channels on a time shared basis. Each of the shift registers 355 is shift controlled by the system clock pulses $\phi_1$ and $\phi_2$ and the last stage output thereof is held so as to circulate through an AND gate 356 and OR gate 357. Normally, the signal $\overline{KSET}$ is "1" so as to enable the AND gate 356. An AND gate 358 is for writing. While the circuits 355 to 358 are shown only for the bit N1, like circuits are provided for the other bits B3 to N2 as well to form the key code memory 346 all together. FIG. 28 illustrates the time division timings designated by the numbers 1 to 8 of the respective channels against the time slots corresponding to one key time. As will be seen, each channel timing occurs four times in order in 32 time slots. The key code PKC for each channel outputted from the key code memory 346 on a time shared basis is supplied to the tone signal generation section 21 (the frequency data change circuit 21A shown in FIG. 25), which generates the tone signal in every channel based on the key code PKC.

The truncate control circuit 348 is provided to determine the order of possibility of assignment to the respective channels and designates a channel for which the possibility of order of assignment is at the maximum value as a truncate channel (i.e., a channel enabling the old assignment data to be truncated and a new key to be assigned to it). The truncate control circuit 348 comprises a truncation memory 359, a 4-bit adder 360, a comparator 361 and a maximum value memory 362. The truncate memory 359 is provided with four parallel 8-stage/1-bit shift registers 363. The input side of each register 363 is provided with an AND gate 364 for the clear control. The memory 359 stores data T01, T02, T03, and T04 indicating the possibility of assignment to the respective channels (truncate order) in the respective channels on a time shared basis in a parallel 4-bit form. Therefore, each of the shift registers 363 is shift controlled by the system clock pulses $\phi_1$ and $\phi_2$ in synchronism with the time division channel timing of the key code memory 346. While the shift register 363 and AND gate 364 are shown only for the bit T01 among the binary 4 bits truncate order data T01 to T04, like circuits are provided for the other bits T02 to T04 to form the truncation memory 359 all together.

The outputs T01 to T04 of the respective registers 363 in the truncation memory 359 are applied to the adder 360 and added each with "1" whenever the signal "1" is supplied to the carry-in input Ci. The 4-bit addition outputs are supplied to the truncation memory 359 and each stored to the shift register 363 through the AND gate 364. The data T01 to T04 supplied from the truncation memory 359 to the adder 360 are time divided in every channel and the count signal DC is supplied for each channel according to its time division timing and added to the input Ci. The truncation memory 359 and the adder 360 thus form a counter which counts the count signal DC on a time shared basis in each channel individually. Every time the count signal DC is supplied at a channel timing, the value of the truncate order data T01 to T02 with regard to that channel increases. Normally the output of the adder 360 (i.e., T01 to T04) is held in the memory 359 by the signal $\overline{KSET}$ at "1" applied to each of the AND gates 364 in the memory 359. When the signal $\overline{KSET}$ goes to "0" at a certain channel timing, the truncate order data T01 to T04 with regard to that channel is cleared to all "0".

The truncate order data T01 to T04 indicates that possibility of assignment is zero (i.e., no other key may be assigned to the channel to which the presently depressed key is assigned) by its "0" in decimal notation (or "0000" in binary notation). The greater the value of the data T01 to T04, the greater the possibility of assignment to a channel, provided that the value of the data T01 to T04 is not smaller than "1" in decimal notation ("0001" in binary notation). In view of the chattering of the key switch, however, the data T01 to T04 not greater than a predetermined value is supposed to virtually indicate possibility of assignment zero. In the embodiment, the decimal value "1" of the data T01 to T04 indicates that the key data TDM regarding the key assigned to the channel concerned has gone to "0" for the first time in the preceding scanning cycle. Since this could be a temporary interruption of the key data TDM due to the chattering, said value "1" of the data T01 to T04 is supposed to indicate possibility of assignment zero (i.e., the key is still being depressed) rather than show that the key has been really released. The decimal value of the data T01 to T04 equal to or greater than "2" indicates that the key assigned to a certain channel has been released and therefore the channel is available for assignment. The data T01 to T04 having a decimal value equal to or greater than "2" is counted up every time another key is released at a later time with the result that the data T01 to T04 of the channel to which the earliest depressed key has been assigned shows the maximum value.

The AND gates 365, 366, OR gate 367, and the inverters 368 to 371 are provided to decode the truncate order data T01 to T04 according to said three states thereof. The AND gate 365 is supplied with the inverse of all the bits of the data T01 to T04 through the inverters 368 to 371. The output signal TCO of the AND gate 365 goes to "1" in response to the channel wherein the data T01 to T04 is "0" in decimal notation or the channel to which the presently depressed key is assigned. The AND gate 366 is supplied with the inverse of the data T01 and data T02 to T04 through the inverters 369 to 371 and its output signal TC1 goes to "1" in response to the channel wherein the data T01 to T04 is "1" in decimal notation or the channel to which the key of which the key data TDM has gone to "0" for the first time in the preceding scanning cycle is assigned. The OR gate 367 is supplied with the most significant 3 bits T02 to T04 of the data T01 to T04 and its output TC2-15 goes to "1" in response to the channel wherein the decimal value of the data T01 to T04 is not smaller than "2" or the channel to which the key that has been already released is assigned.

The maximum value memory 362 is provided to store the maximum value of the data T01 to T04 in each channel and comprises a delay flip-flop 372, AND gates 373, 374, and OR gate 375 for each bit of the maximum value data MT1 to MT4. While these circuits 372 to 375 are shown with regard to the bit MT1 only, like circuits are provided to the other bits MT2 to MT4. The input A of a comparator 361 is provided on a time shared basis with said data T01 to T04 in each channel stored in the truncate memory 359 while the input B is provided with the maximum value data MT1 to MT4 stored in the maximum value memory 362. The comparator 361 supplies "1" to an AND gate 376 when "A>B" is established, namely, when the data T01 to T04 supplied exceeds the maximum value data MT1 to MT4 stored in the memory 362. The AND gate 376 is enabled by the timing signal 9T16 from the ninth to the sixteenth time slots, during which the output A>B of the comparator 361 is selected and supplied as the signal DSET to the AND gate 373. The data T01 to T04 are each supplied to the respective AND gates 373 provided each for the bits MT1 to MT4, selected when the signal DSET is "1" and then loaded into the delay flip-flops 372 through the OR gates 375. The data T01 to T04 loaded into the delay flip-flop 372 are outputted as the new maximum value data MT1 to MT4 one time slot later while they are held through an AND gate 374. The AND gate 374 is enabled when the signal DSET is "0" and disabled when it is "1" so that the old maximum value data MT1 to MT4 may be cleared when "A>B" is established in the comparator 361. The AND gate 374 is supplied with the inverse of the timing signal 24y32 from an inverter 402 so as to be disabled at the twentyfourth time slot and clear the data MT1 to MT4 stored in the memory 362. Accordingly, the data MT1 to MT4 is all "0" at the ninth time slot when the signal 9T16 rises.

The data T01 to T04 in each channel is thus compared sequentially during 8 time slots from the ninth to the sixteenth time slots during which the AND gate 376 is enabled by the signal 9T16 so as to store data T01 to T04 of the greater value in the memory 362 as the data MT1 to MT4. When the sixteenth time slot is finally over, there is stored in the memory 362 the data MT1 to MT4 having the maximum value among the data T01 to T04 in the respective channels. The comparison period corresponds to the section A shown in FIG. 28. The maximum value data MT1 to MT4 is held in the memory 362 during 8 time slots from the seventeenth to the twentyfourth time slots until it is cleared by the signal 24y32. The maximum value data hold period corresponds to the section B shown in FIG. 28. The comparator 361 generates a truncate channel designation signal TCH (allows TCH to go to "1") when "A=B" is established, i.e., in response to the timing of the channel whose data T01 to T04 has the maximum value (MT1 to MT4). As will be clear, the truncate channel designation signal TCH is effective in the section B (from the seventeenth to the twentyfourth time slots) shown in FIG. 28.

A coincidence detection circuit 377 compares the key code KC latched by the latch circuit 354 and the key code PKC of each channel stored in the key code memory 346 and, when the key code KC indicating the presently scanned key coincides with the key code PKC stored in the key code memory 346, outputs a key code coincidence signal KCEQ in response to the relevant channel timing. The coincidence detection circuit 377 has exclusive OR gates 378 to compare the key code KC stored in the latch circuit 354 and the key code PKC outputted on a time shared basis from each of shift registers 355 in the key code memory 346 in each of the bits B3 to N1 individually. The coincidence detection circuit 377 further comprises a NOR gate 379 which is provided with the output of the exclusive OR gates 378 each corresponding to the respective bits B3 to N1. While an exclusive OR gate 378 is shown only for the bit N1, like gate is provided for each of the bits B3 to N2. When the key code KC presently scanned coincides with the key code of a certain channel, the output of the exclusive OR gates 378 for the respective bits B3 to N1 go to "0" and the output signal KCEQ of the NOR gate 379 goes to "1" in response to the channel timing. When, conversely, the key codes prove to differ from each other even in one of the bits, "1" is outputted from the exclusive OR gate 378 and applied to the NOR gate 379, whose output signal KCEQ then goes to "1". It is to be noted that the outputs of all the bits of the key code PKC are applied to a NOR gate 380 whose output is supplied to the NOR gate 379 so that the signal KCEQ may not be outputted when the key code PKC is all "0".

Two delay flip-flops RG0 and RG1 are controlled by the system clock pulses $\phi_1$ and $\phi_2$. The flip-flop RG0 is provided to memorize the arrival of the key scanning timing in the present scanning cycle related to the key which has been already assigned to a certain channel and of which depression has been detected until the last scanning cycle. The other flip-flop RG1 is provided to memorize the arrival of the key scanning timing in the presently scanning cycle related to the key which has been already assigned to a certain channel and of which release was detected for the first time in the last scanning cycle. The operation of setting the states of these flip-flops RG0 and RG1 is performed by AND gates 383 and 384 from the ninth to the seventeenth time slots (section A shown in FIG. 28). As mentioned earlier, the section from the ninth to the seventeenth time slots (section A) is the first 8 time slots among those during which the key data TDM (9~) corresponding to one key time is outputted from the latch circuit 350 and it is also the first 8 time slots among those during which the key code KC corresponding to the key data TDM (9~) is outputted from the latch circuit 354.

The AND gate 383 is provided with the timing signal 9T16 indicating the period from the ninth to the seventeenth time slots, the key code coincidence signal KCEQ outputted from the coincidence detection circuit 377, and the signal TC0 outputted from the AND gate 365. In case the key presently scanned has been already assigned to a certain channel, the coincidence signal KCEQ goes to "1" as mentioned before, and, at the same time, in case that the key happens to be presently depressed (precisely, in case depression of that key had been detected until the last scanning cycle), the signal TC0 goes to "1" in response to that channel timing, thereby enabling the AND gate 383. The output "1" of the AND gate 383 is loaded into the delay flip-flop RG0 through an OR gate 390 and outputted from the delay flip-flop RG0 one time slot later. The output of the flip-flop RG0 is self-held through the AND gate 381 and OR gate 390.

The AND gate 384 is provided with the timing signal 9T16, the key code coincidence signal KCEQ and the signal TC1 outputted from the AND gate 366. In case the key presently scanned has been already assigned to a certain channel, the key code coincidence channel KCEQ goes to "1" in response to the relevant channel timing, as mentioned before, and in case, at the same time, the key data TDM corresponding to that key went to "0" for the first time in the last scanning cycle, the signal TC1 goes to "1" in response to that channel timing, thus enabling the AND gate 384. The output "1" of the AND gate 384 is loaded into the delay flip-flop RG1 through an OR gate 391 and outputted from the flip-flop RG1 one time slot later. The output of the flip-flop RG1 is self-held through the AND gate 382 and OR gate 391.

The inverse of the timing signal 24y32 is supplied from an inverter 392 to the AND gates 381 and 382. Hence, once set by the outputs of the AND gates 383 and 384 from the ninth to the sixteenth time slots (period A shown in FIG. 28), the states of the flip-flops RG0 and RG1 are held until the twentyfourth time slot when they are reset by the signal 24y32.

Control over the key code memory 346 and the truncate device 348 is exercised using AND gates 385 to 389 from the seventeenth to the twentyfourth time slots (period B shown in FIG. 28) during which the flip-flops RG0 and RG1 are held in the effective states. Therefore, the AND gates 385 to 389 are provided with the timing signal 17T24 so as to be enabled for the period B. Further, the AND gates 385 to 389 are provided from an inverter 393 with the inverse $\overline{ASi}$ of the signal ASi which is normally "0".

The AND gates 386 is provided for the processing of new key-on (NEWKON) whereby the newly depressed key is assigned to a designated channel according to a truncate channel designating signal TCH. The AND gate 386 is provided, in addition to the signals mentioned above, with the key data TDM (9~), the truncate channel designating signal TCH, the output signal TC2-15 of an OR gate 367, and the inverse of the outputs of the flip-flops RG0 and RG1 from respective inverters 394 and 395. TDM (9~) at "1" indicates that the presently scanned key is depressed whereas RG0 and RG1 at "0" (the outputs of the inverters at "1") indicate that key has not yet been assigned to any channel and satisfaction of these conditions indicates that a new key has been depressed. As stated earlier, the signal TC2-15 denotes the channel to which the key already released has been assigned whereas the signal TCH denotes the channel of which the truncate order data T01 to T04 has the maximum value, as mentioned before. In case, therefore, the key corresponding to the key data TDM happens to be the newly depressed key, the AND gate 386 is enabled in response to the time slot of the channel to which the earliest released key has been assigned (the channel denoted by TCH). The output "1" of the AND gate 396 is supplied as a signal KSET to the key code memory 346 through an OR gate 396.

When the signal KSET is "1", the AND gate 358 for writing provided for each bit in the memory 346 is enabled to load the memory 346 (or, more precisely, the shift register 355 for every bit) with the key code KC of the newly depressed key latched in the latch circuit 354. At the same time, the signal $\overline{KSET}$ at "0" clears the key code PKC in the memory 346 indicating the key last assigned to the subject channel, said signal $\overline{KSET}$ from the inverter 397 being the inverse of the signal KSET. In addition, the signal $\overline{KSET}$ at "0" disables the AND gate 364 provided for each bit in the truncate memory 359, thereby letting the data T01 to T04 regarding the subject channel go to all "0". The assignment of the newly depressed key is executed in this way.

In case a plurality of channels have the data T01 to T04 equivalent to the maximum value MT1 to MT4, the signal TCH is generated at a plurality of time slots in 8 time slots during which the AND gate 386 is enabled by the signal 9T16. In order to prevent a newly depressed key from being assigned to a plurality of channels successively, the output of the AND gate 386 is supplied to the delay flip-flop RG0 through the OR gate 398 so as to set the flip-flop RG0 when the AND gate 386 is enabled at a time slot, ensuring that the AND gate 386 is not enabled thereafter. Thus the signal KSET goes to "1" only once at a certain time slot and a newly depressed key is assigned to only one channel.

The AND gate 387 is provided to carry out processing for preliminary new key-off (NEWKOF1). The processing for preliminary new key-off is made when the key data TDM of the up-to-now depressed key has gone to "0" for the first time in the present scanning cycle and is a preliminary processing to make distinction between the real release of the key and the chattering. The AND gate 387 is provided with the inverse of the key data TDM (9~) from an inverter 398, the key code coincidence signal KCEQ, the signal TC0 and the output of the flip-flop RG0 in addition to the signals $\overline{ASi}$ and 17T24 mentioned before. The key data TDM (9~) at "0" (the output of the inverter 398 at "1") indicates that the presently scanned key has been released or, alternatively, it is temporarily in a switch-off state due to the key switch chattering whereas RG0 at "1" indicates that said key has been depressed up to now and it is presently assigned to a channel, satisfaction of these conditions meaning that the key data TDM of the key depressed up to now has gone to "0" for the first time in the present scanning cycle. This in turn is the condition for detecting preliminary new key-off (NEWKOF1), upon satisfaction of which the output of the AND gate 387 goes to "1" in response to the channel timing (specified by the signals KCEQ and TC0) to which that key has been assigned. The output "1" of the AND gate 387 is supplied as a count signal DC to an adder 360 through an OR gate 399. Hence the truncate order data T01 to T04 of the subject channel which was all "0" before that time (TC0 was "1") becomes "0001" (1 in decimal notation) whereas the signal TC1 goes to "1". As stated before, the fact that the data T01 to T04 has gone to 1 (in decimal notation) by the processing of preliminary new key-off (NEWKOF1) is not considered to indicate the real release of key.

Said flip-flop RG1 is set in the scanning timing of the key regarding the processing of preliminary new key-off which is carried out in the scanning cycle following another scanning cycle in which the processing of that preliminary new key-off (NEWKOF1) was carried out. This is because in response to the timing of the channel to which the subject key has been assigned, the signal TC1 goes to "1" while the signal KCEQ also goes to "1". As mentioned earlier, the flip-flop RG1 is set in the period A (shown in FIG. 28). On condition that the output of the flip-flop RG1 is "1" in the following period B (i.e., the processing for preliminary new key-off was carried out in the preceding scanning cycle), processing for old key-on (OLDKON) or true new key-off (NEWKOF2) and key-off increment (KOFINC) is carried out.

The AND gate 385 is provided to carry out processing for old key-on (OLDKON). Processing for old key-on (OLDKON) is carried out in case the key data TDM of the key with which processing for preliminary new key-off was carried out in the preceding scanning cycle has returned to "1" in the present scanning cycle. Namely, in case "old key-on" (OLDKON) is realized, it is understood that the signal "0" of the key data TDM in the last scanning cycle was due to a temporary interruption caused by key switch chattering. The AND gate 385 is provided with the key data TDM (9~), the key code coincidence signal KCEQ, the signal TC1 and the output signal of the flip-flop RG1 in addition to said signals $\overline{ASi}$ and 17T24. The key data TDM (9~) at "1" indicates that the presently scanned key has been depressed whereas RG1 at "1" indicates that processing for preliminary new key-off was carried out with regard to that key in the preceding scanning cycle, that is, the key data TDM of that key went to "0" for the first time in the preceding scanning cycle and satisfaction of these conditions means that the signal "0" of the key data TDM in the preceding scanning cycle was simply due to a temporary interruption caused by chattering. This is the "old key-on" (OLDKON) detection condition, upon satisfaction of which the output of the AND gate 385 goes to "1" in response to the channel timing (specified by the signals KCEQ and TC1) to which that key is assigned.

The output "1" of the AND gate 385 is used as a signal KSET through the OR gate 396. The signal KSET is not used to execute a new assignment but to return the truncate order data T01 through T04 to the state in which it was before processing for preliminary new key-off was carried out (i.e., all "0"). More specifically, by the inverse $\overline{KSET}$ of the signal KSET, the value "0001" of the data T01 to T04 in the relevant channel is cleared and returned to "0000". While the key code memory 346 is loaded with the key code KC from the latch circuit 354 by the signal KSET, no substantial difference is thus made as that key code KC is identical to the old key code PKC in the relevant channel.

The AND gate 388 is provided for processing for real new key-off (NEWKOF2). The AND gate 388 is provided with the inverse of the key data TDM (9~) from the inverter 398, the key code coincidence signal KCEQ, the signal TC1 and the output signal of the flip-flop RG1 in addition to said signals $\overline{ASi}$ and 17T24. The AND gate 388 is provided with the same signals as the AND gate 385 except for the inverse of the key data TDM (9~). When the key data TDM of the up-to-now depressed key maintains "0" in two consecutive scanning cycle, the AND gate 388 is enabled and outputs "1" at a timing of the channel to which that key is assigned. Only when the key data TDM has thus maintained "0" in two consecutive scanning cycles, it is judged that another release of key has taken place. The output "1" of the AND gate 388 is supplied to the adder 360 through the OR gate 399. Accordingly, the truncate order data T01 to T04 in the relevant channel, which became "0001" as a result of processing for preliminary new key-off in the preceding scanning cycle, is further added with "1" to become "0010" (decimal 2). Thus it is known that a key assigned to a channel in which the truncate order data T01 to T04 has a value not smaller than 2 in decimal notation has been released.

The AND gate 389 is provided to carry out processing for key-off increment (KOFINC), whereby, when the condition of said true new key-off (NEWKOF2) is reached, namely, when "new key-off" is detected, the truncate order data T01 to T04 in the other channels already in a key-off state are respectively counted up by 1. The AND gate 389 is provided with the inverse of the key data TDM (9~) and the output of the flip-flop RG1, as is the AND gate 388, and enabled upon detection of "new key-off", that is, in case processing for preliminary new key-off was carried out in the preceding scanning cycle (RG1 is "1") and yet the key data TDM is "0" in the present scanning cycle. The AND gate 389 is further provided with the signal TC2-15 so as to output "1" in response to the timing of the channel already in a key-off state rather than the channel of which new key-off has been detected, as compared to the AND gate which outputs "1" in response to the timing of the channel of which new key-off has been detected. The output "1" of the AND gate 389 is supplied as the count signal DC to the adder 360 through the OR gate 399. Thus the data T01 to T04 in the channel already in a key-off state (not less than 2 in decimal notation) is further counted up by 1. Therefore by processing for key-off increment, the data T01 to T04 in channels in a key-off state are each counted up by 1 every time "new key-off" (real new key-off NEWKOF2) is detected so that the data T01 to T04 in the channel assigned for the earliest released key has the maximum value. Although it is not illustrated, the data T01 to T04 in all the channels need to have been preset at a predetermined value not smaller than 2 when power is thrown in.

The most significant 3 bits T02, T03, and T04 of the data T01 to T04 outputted from the truncate memory 359 are applied to an OR gate 400 from which a key-off signal KOF is obtained. The key-off signal KOF goes to "1" in response to the timing of the channel in which the data T01 to T04 has a value not less than 2 in decimal value (i.e., the channel in a key-off state). The key-off signal KOF at "0" denotes a channel in a key-on state. Therefore, the key-off signal KOF is inverted by an inverter 401 to obtain a key-on signal KON, which is allowed to pass through a key-on register 347 or an 8-stage/1-bit shift register. The key-on signal KON outputted from the register 347 is in synchronism with the time division channel timing of the key code PKC outputted from the key code memory 346 and goes to "1" in a channel in a key-on state and "0" in a channel in a key-off state. The key-on signal KON is supplied to the tone signal generation section 21 (the tone generation circuit 21C shown in FIG. 25) to control the tone generated in each channel. In case, after said processing for preliminary new key-off (NEWKOF1), processing for old key-on (OLDKON) was carried out, namely, chattering took place, the key-on signal KON is not interrupted at all so chattering is eliminated.

The signal ASi is supplied from the monophonic key assigner 14A shown in FIG. 4 in response to the initial sensing signal IS in the polyphonic mode and used to inhibit assignment operation by the polyphonic key assigner 14B for about 10 ms of the waiting time for initial touch detection. Referring to FIG. 4, the output of the flip-flop AKQ is supplied to an OR gate 345 through the AND gate 91 and further the output of an AND gate 344 is supplied to the OR gate 345 while the output of the OR gate 345 is supplied as the signal ASi to the circuit shown in FIG. 27. The AND gate 344 is provided with the output of the flip-flop XKQ and the inverses of the outputs of the flip-flops MK1 and MK2. When the key data TDM corresponding to said "any new key-on" is supplied, the output of the flip-flop XKQ rises to "1" at the seventeenth time slot and then 8 time slots later at the twentyfifth time slot, the output of the flip-flop AKQ rises to "1" which is held for about 10 ms. In response to the signal "1" of AKQ, the initial sensing signal IS goes to "1" so that said processing for initial touch detection is carried out. As mentioned before, sounding of the tone is not started until the initial touch detection period is over. Therefore, assignment operation by the polyphonic key assigner 14B, particularly processings by tye AND gate 385 to 389 (OLDKON, NEWKON, NEWKOF1, NEWKOF2, and KOFINC) are inhibited by the signal ASi corresponding to the signal IS. The signal ASi rises to "1" earlier than the signal IS by time length equal to the output of the AND gate 344. This is to ensure that the assignment operation be prohibited during the period from the seventeenth to the twentyfourth time slots as well during which "any new key-on" detection is effected (period B shown in FIG. 28) since the signal IS or the output of the flip-flop AKQ rises at the twentyfifth time slot and therefore inhibition of the assignment operation cannot be secured during said period without such arrangement. Namely, the AND gate 344 operates on the same condition as the set condition of the flip-flop AKQ and its output rises to "1" at the seventeenth time slot or 8 time slots earlier than the output of the flip-flop AKQ rises to "1".

Thus, using the truncate device 348 provided in the polyphonic key assigner 14B shown in FIG. 27, it is possible to eliminate key switch chattering so that a chattering elimination circuit need not be provided on the side of the depressed key detection section 12 (FIGS. 2 and 3) and therefore circuit construction can be simplified.

Although in the above embodiment interruption of the key data TDM in only one scanning cycle (about 2 ms) is considered to have been caused by chattering while interruption of the key data TDM occurring in more than one scanning cycle consecutively is regarded to indicate key release, the key data TDM interruption period to denote chattering may be specified at any other numbers of scanning cycles. For that purpose, said processing for preliminary new key-off (NEWKOF1) needs to be carried out consecutively in a predetermined number of scanning cycles and, therefor, the circuit needs to be constructed such that when the value of said truncate order data T01 to T04 is 1 or any other predetermined value, said signal TC1 is generated and when the data T01 to T04 is greater than said predetermined value, the signal TC2-15 is generated.

While the depressed key detection section 12 shown in FIG. 3 is of a type generating a time division multiplexed key data TDM, the section 12 may be of any other detection type. Also while the monophonic mode and polyphonic mode are available for selection in the above embodiment, only one of the modes may be provided.

In case a key touch detection signal is used for the attack pitch control, the touch sensor 10 may be adapted to generate a digital output instead of an analog output. Further, in case the key touch detection signal is used for the attack pitch control, the touch sensor 10 need not be an after-touch sensor but may be a sensor for initial touch detection. Besides, not only the attack pitch initial depth but also the attack pitch envelope rate may be controlled according to the initial touch.

While in the above embodiment, only one touch sensor 11 is used for all the keys, a touch sensor may be provided for each key independently or one for a predetermined tone range such as half an octave or one octave. The after touch sensor 11A is not limited in its shape, material and the like, provided that it produces an output corresponding to the key touch even under continuous key depression. The after touch sensor may include those using, for example, pressure-sensing conductive rubber, piezoelectric element, semi-conductor pressure sensor, optical systems, coils, and the magnetic effect.

In the operation in which the peak value of the output signal from the after-touch sensor 11A is detected in a predetermined period based on "any new key-on" or "legato new key-on" and held, and exact holding of the peak value is not necessarily required, only provided that the force (initial touch) which the performer initially applies to a key in his key depressing operation is detected in terms of quantity within said predetermined period. While said predetermined period for the initial touch detection is about 10 ms (milliseconds) in the embodiment, it may be of any length so long as start of sounding of the tone is not unnaturally delayed.

Although the touch detection signals (the outputs of the potentiometers V3, V6 and V8) and the other effect setting signals (the outputs of the potentiometers V1, V2, V4, V5, and V7) are analog-to-digital converted by the common analog to digital conversion section, an analog to digital conversion device may be provided exclusively for the touch detection signals.

In the analog to digital conversion of the potentiometers V1 to V7 by the analog to digital converter 18 shown in FIG. 6, the amount of change in data in one sampling cycle is limited to $\pm 1$ in order to prevent an abrupt change in data. It is, however, possible to limit the amount of change in data in one sampling cycle to within $\pm N$ (N is a given number not less than 2) or not to limit such amount at all. In the latter case, the circuit needs to be arranged such that the output of the delay flip-flop 140 is applied to the AND gate 144 for upcount while the signals TiM2+3 and TiM1 are removed from the AND gates 142 and 144. In said latter case, moreover, it is necessary to arrange the circuit such that the input combinations of the AND gates 142 and 144 be modified in the same manner as described above and the number of connection (number of shift stages) of the delay flip-flop 137 be increased in accordance with N so as to enable the AND gates 142 and 144 only when the delay signal of the signal TiM is being outputted from each of the stages of the flip-flop 137. As a matter of course, control may be exercised not only on the tone pitch, tone volume but on other musical tone elements such as the tone color in response to the touch detection signal. It has been already mentioned that in the calculator CUL2 shown in FIG. 13, the data ΔENV is used as a variation range data, said data ΔENV being obtained by shifting down by predetermined bits the envelope data ENV (target value to be reached) which in turn is obtained by the calculator CUL3. However, a separate means may be provided to produce variation range data. The calculators CUL1 to CUL4 as well as CUL5 and CUL6 may be parallel calculators instead of serial claculators. In the above embodiment, the timing at which the variation range data ΔENV is calculated in the calculator CUL2 is the output timing of the carry-out signal of the most significant bit in the calculator CUL1. However, the calculator CUL2 may be arranged to perform calculation when the contents of the calculator CUL1 become a predetermined value. For that purpose, a comparator may be provided to detect the contents of the calculator CUL1 which have become a predetermined value so that the operation timing of the calculator CUL2 may be controlled by the output of such a comparator. Alternatively, the latch timing of the latch circuit 257 may be changed for the same purpose.

While the attack pitch control described in the above embodiment is of a vibrato type, it may be of any type so long as it creates turbulence in pitch at the start of sounding of the tone.

While FIGS. 6 and 7 illustrate a serial processing type analog to digital conversion section 17, a parallel processing type analog to digital conversion section may be constructed in the similar manner.

Further, the time division sampling in the analog voltage multiplexer 16 may be controlled by microcomputer program. In that case, the time division sampling timing need not occur regularly at all times but may be irregular or discontinuous depending on the process by the microcomputer. In case the sampling cycle is irregular, the microcomputer program enables the limited value of the variation of the digital data to be automatically changed in an appropriate manner in response to every sampling cycle.

Description of Essential Construction of the Circuit for Each Tonal Effect or Control:

Description will now be separately made, with reference to FIGS. 29 through 34, as to each essential circuit construction for realizing each tonal effect or control according to the invention. The essential circuit construction for the attack pitch control according to the invention has already been described referring to FIG. 1. Detailed description of the embodiment of the essential circuit construction for each tonal effect or control has already been made referring to FIGS. 2 through 28. In FIGS. 29 through 34, the reference numerals 410, 412, 413, and 415 each correspond to the same numerals used in FIG. 1, designating the keyboard section, depressed key detection device, tone generation device, and sound system, respectively.

Figure 29:
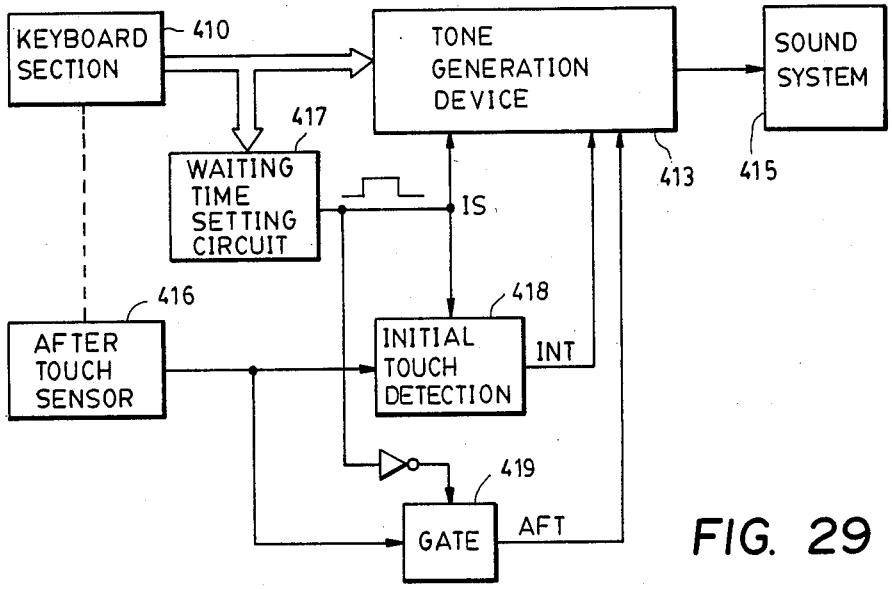
FIG. 29 is a block diagram showing the basic construction of an electronic musical instrument to perform the touch response control in accordance with the invention.

FIG. 29 shows the essential construction of an electronic musical instrument capable of performing the touch response control according to the invention. An after touch sensor 416 is provided to detect the key touch based on the key depressing force, speed or depth of key depression (or anything provided that it enables the key touch to be detected) concerning the depressed key in the keyboard section 410. The sensor 416 can detect the key touch even when the key is being depressed. A waiting time setting circuit 417 detects the start of a key depression of the keyboard section 410 and set a waiting time starting from the detected initiation of key depression. The circuit 417 outputs the initial sensing signal IS during the waiting time. The output of the after touch sensor 416 is supplied to an initial touch detection circuit 418 and gate 419. The initial touch detection circuit 418 detects the signal responsive to the initial touch based on the output signal of the touch sensor 416 during the time the initial sensing signal IS is being supplied. Since the touch sensor 416 outputs a signal in response to the initial key touch in the key depression operation while the initial sensing signal IS is being generated, a proper initial touch detection is possible based on the output signal of the touch sensor 416 supplied during generation of the signal IS. The initial touch detection circuit 418 may, for example, be a peak hold circuit so as to hold the peak value of the signal outputted from the touch sensor 416 during generation of the initial sensing signal IS and to output this peak value as an initial touch control signal INT.

The gate 419 is closed while the initial sensing signal IS is being "1" and opened when the signal IS being "0", namely, when the waiting time terminates. Upon termination of the waiting time, therefore, the output signal of the after touch sensor 416 passes the gate 419 to be outputted from it as an after touch control signal AFT. The initial touch control signal INT and after touch control signal AFT are supplied to the tone generation device 413 so as to control one or more of the pitch, level and color of the tone generated by the device 413. The tone generation device 413, which generates a tone signal in response to the depressed key of the keyboard section 410, is controlled so as to delay the start of the tone generation according to the initial sensing signal IS. Consequently, in case the initial touch control is to be effected, it is possible to effect the control responsive to said signal INT just from the start of the tone generation so that no inconvenience results from the waiting time purposely provided for the initial touch detection.

Figure 30:
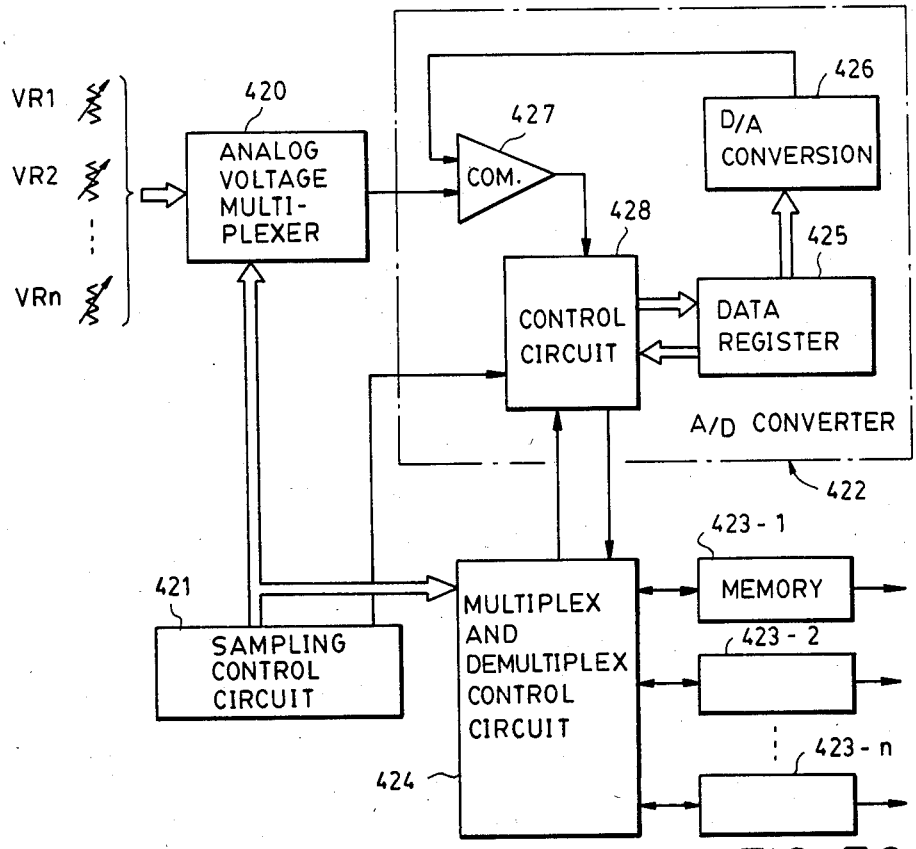
FIG. 30 is a block diagram showing the basic construction of a device for analog to digital converting the set data of various tone signal elements.

FIG. 30 shows the essential construction of a device for analog-to-digital converting the setting data of various tone control elements such as tone level, vibrato speed and vibrato depth. VR1 through VRn are analog voltage setting potentiometers similar to V1 through V8 shown in FIG. 6 and provided in plurality so as to correspond to the various tone control elements. Desired analog voltage values are set by manually operating the knob (not shown) of the potentiometers VR1 through VRn to regulate the resistance values. The analog voltages set by the respective potentiometers VR1 through VRn are applied in parallel to an analog voltage multiplexer 420. This multiplexer 420 sequentially samples the output voltages of the potentiometers VR1 through VRn on a time shared basis in response to the control signal supplied from a sampling control circuit 421 and outputs them to a common output line after multiplexing them. An analog to digital converter 422 converts the analog voltage supplied from the analog voltage multiplexer 420 into digital data.

Memories 423-1 through 423-n are provided so as to correspond respectively to the potentiometers VR1 through VRn and store the digital data corresponding to the respective set values of VR1 through VRn. A multiplex and demultiplex control circuit 424, in its first function, distributes the digital data corresponding to the set values of the potentiometers VR1 through VRn outputted on a time shared basis from the analog to digital converter 422 among the predetermined memories 423-1 through 423-n (demultiplexing function). Therefore, the sampling control signal is supplied from the sampling control circuit 421 to the control circuit 424 so that the output digital data of the analog to digital converter 422 may be distributed among the predetermined memories 423-1 through 423-n in synchronism with the time division sampling of the analog voltage in the multiplexer 420. The digital data stored in each of the memories 423-1 through 423-n is outputted as data indicating the set value of each control element.

The analog to digital converter 422 may be, for example, of a type which obtains digital data corresponding to the present sampling value by adding or subtracting the small value corresponding to the analog value sampled at the present sampling timing to or from the digital data obtained at the preceding sampling timing. Specifically, the analog to digital converter 422 of said type comprises a data register 425 to store the digital data, a digital to analog conversion circuit 426 to convert the value of the digital data stored in said data register 425 into an analog voltage, a comparator 427 to compare the output voltage of said digital to analog conversion circuit 426 and the analog voltage supplied from the multiplexer 420, and a data register control circuit 428 to control addition and subtraction to and from the contents of the data register 425 according to the output of said comparator 427. The multiplex and demultiplex control circuit 424, in its second function, reads out the data stored in the memories 423-1 through 423-n on a time shared basis in synchronism with the time division sampling of the analog voltage in the multiplexer 420 and supplies such data to the analog to digital converter 422 after multiplexing it (multiplexing function). In synchronism with the analog voltage sampling timing regarding the given potentiometers VR1 through VRn, the circuit 424 reads out digital data from the memories 423-1 through 423-n corresponding to those potentiometers and supplies said digital data to the analog to digital converter 422. Through the control circuit 428, the converter 422 loads the data register 425 with the digital data (data obtained at the preceding sampling timing) supplies through the control circuit 424 from the memories 423-1 through 423-n. The digital data obtained at the preceding sampling timing and thus loaded into the register 425 is converted into an analog voltage by the digital to analog conversion circuit 426 and then compared with the now sampled analog voltage by the comparator 427.

The control circuit 428 controls the operation of adding or subtracting a predetermined value to or from the contents of the data register 425 according to the output of the comparator 427. As a result, the value of the digital data stored in the data register 425 changes so as to approach the value corresponding to the analog voltage supplied from the multiplexer 420. If the control circuit 428 is adapted to perform addition or subtraction repeatedly until both input voltages to the comparator 427 coincide with each other, a digital conversion immediately following the change of the input analog voltage is made possible. On the other hand, the variation of the digital data at one sampling timing can be confined to within a predetermined value by limiting the number of additions or subtractions at one sampling timing to a predetermined number. The sampling control circuit 421 supplies to the control circuit 428 a signal corresponding to the sampling timing, according to which signal a predetermined control is effected at each sampling timing. Upon completion of the digital conversion operation for one sampling timing by the above control by the control circuit 428, the contents of the data register 425 are received by the predetermined memories 423-1 through 423-n through the control circuits 428 and 429. To economize wiring and control circuits, it is preferable that the digital data be serially transmitted between the analog to digital converter 422 and the memories 423-1 through 423-n.

Figure 31:
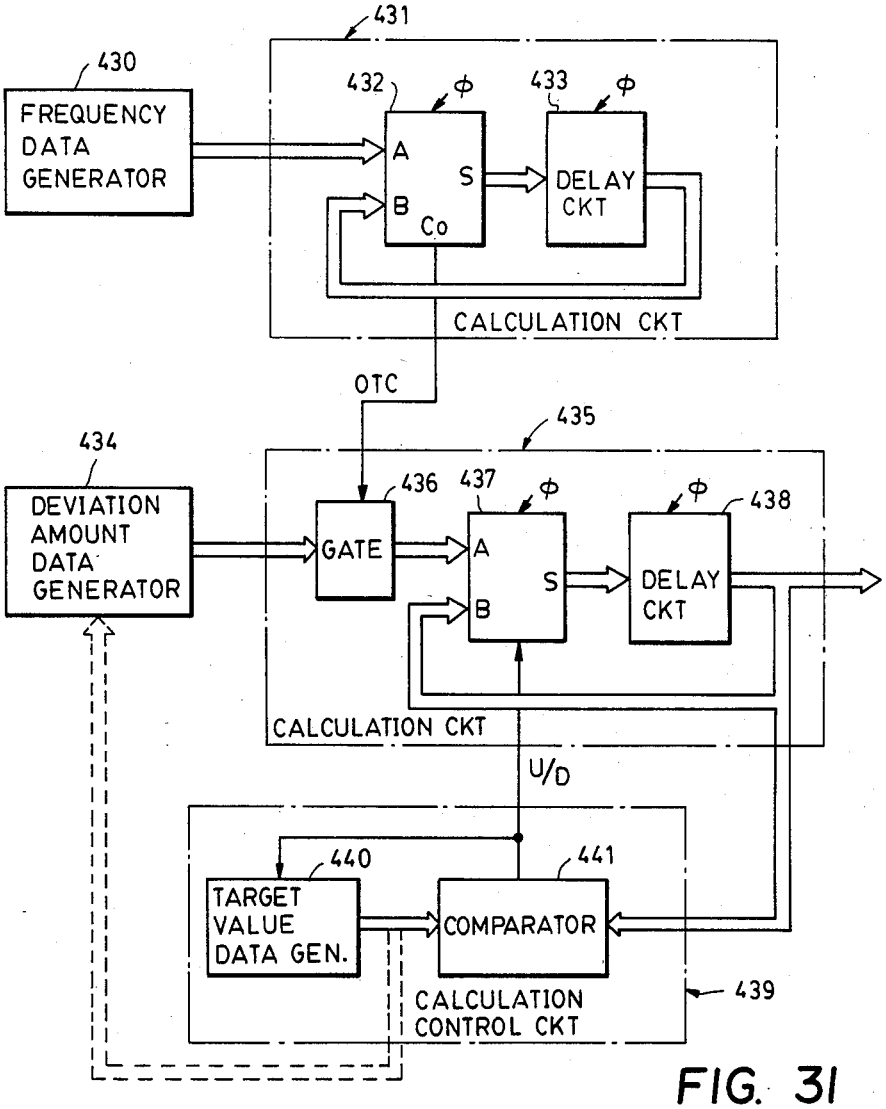
FIG. 31 is a block diagram showing the basic construction of a device to generate the modulating signal for various tonal effects.

FIG. 31 illustrates the essential construction of a device to generate the modulating signals for various tonal effects. A frequency data generator 430 generates numerical data for setting the frequency of the modulating signal to be generated. A first calculation circuit 431 repeatedly adds (or may subtract) the numerical data generated by the frequency data generator 430 and output a calculation timing control signal OTC every time the result of such calculation reaches a predetermined value. The calculation circuit 431 may, for example, consist of a predetermined modulo number of accumulators, each formed of an adder 432 and delay circuit 433, so as to repeatedly accumulate the numerical data supplied from the device 430 at regular time intervals according to a given clock pulse $\phi$. Every time the calculation result reaches the predetermined modulo number, the carryout signal is generated at the carryout output Co of the adder 432 and outputted as the calculation timing control signal OTC. Thus the control signal OTC is generated periodically at time intervals corresponding to the numerical data generated from the frequency data generator 430.

A deviation amount data generator 434 generates a numerical data indicating the deviation amount of the numerical value of one calculation by a second calculation circuit 435. The second calculation circuit 435 adds or subtracts the numerical data supplied from said deviation amount data generator 434 every time said calculation timing control signal OTC is supplied from the first calculation circuit 431. The calculation circuit 435 has an accumulator formed of an addition and subtraction circuit 437 and delay circuit 438 and closes a gate 436 whenever the calculation timing control signal OTC is supplied so that the numerical data generated by the deviation amount data generator 434 is supplied to the input A of the circuit 437. The circuit 437 operates in either of the addition and subtraction modes. In the addition mode, it adds the deviation amount numerical data supplied to the input A to the preceding calculation result supplied from the delay circuit 438 to the input B whereas it subtracts the deviation amount numerical value data supplied to the input A from the preceding calculation result supplied to the input B.

A calculation control circuit 439 shifts the calculation mode of the second calculation circuit 435 from the addition mode to the subtraction mode or vice versa and comprises a target value data generator 440 and comparator 441. The target value data generator 440 generates target value data for setting the depth of the modulating signal to be generated. The comparator 441 compares the output of the second calculation circuit 435 and the target value, outputting a signal U/D for controlling the calculation mode of the circuit 437 according to the comparison result. The target value data generator 440 selectively generates either of the target value corresponding to the maximum value of the modulating signal and the target value corresponding to the minimum value of the modulating signal.

When, for example, the output signal U/D of the comparator 441 is indicating the addition mode, the second calculation circuit 435 repeatedly adds the numerical data indicating the deviation amount every time the control signal OTC is generated so that the value of the output signal of the calculation 305 increases gradually. At that time, the target value data generator 440 generates data indicating the maximum target value. When the gradually increasing value of the output signal of the calculation circuit 435 reaches the maximum target value, the contents of the output signal U/D of the comparator 441 are switched so as to instruct the subtraction mode. As a result, the calculation circuit 435 repeatedly subtracts the numerical data indicating the deviation amount every time the control signal OTC is generated whereas the target value data generator 440 generates the data indicating the minimum target value. The value of the output signal of the calculation circuit 435 gradually decreases until it reaches the minimum target value when the contents of the output signal is switched so as to instruct the addition mode. Thus the calculation circuit 435 shifts its calculation mode alternately so that its output signal oscillates between the maximum and minimum target values. The output signal of the second calculation circuit 435 is supplied as a modulating signal of the digital data to a circuit (not shown) provided to modulation control the tone pitch, tone level and the like.

As shown by a dotted line, the target value data generated by the target value data generator 440 may be supplied to the deviation amount data generator 434 so that the generator 434 may obtain a small value by shifting down said target value data by a predetermined number of bits and output this small data as numerical data indicating the deviation amount. Then the value of the deviation amount data changes in response to the change of the target value (i.e., the ratio of the value of the deviation value data to the target value remains constant) so that the number of the calculations performed until the modulating signal given by the calculation circuit 435 reaches from the maximum target value to the minimum target value (or vice versa) always remains constant. As a result, the oscillation frequency of the modulating signal depends solely on the generation interval of the calculation timing control signal OTC and therefore the frequency of the modulating signal can be set with ease. Also the depth of the modulating signal can be freely set by changing the target value generated by the target value data generator 440 so that complicated shift circuits for depth control are not necessary. For modulation effects wherein the depth stays unchanged as time elapses (normal vibrato effect, for example), the target value data generator 440 need only be so constructed as to continuously generate a constant target value corresponding to the depth selected by the performer. On the other hand, for the modulation effects wherein the depth varies with time (delay vibrato effect, for example), the target value data generator 440 may be so constructed as to generate the target value data in the form of an envelope which changes with time.

The modulating signal generator shown in FIG. 31 corresponds to the tonal effect imparting circuit 20 (see FIGS. 2, 12, 13, and 14) of the embodiment earlier described in detail, of which an example is illustrated in FIG. 13 in detail. Further, the part serving to set the frequency and depth of the modulating signal is also related to the tonal effects setting manual operators 15 and the analog to digital conversion section 17 (see FIGS. 2, 6, and 7).

While the embodiment described in detail referring to FIGS. 2 through 28 is of the modulating signal generator for effecting vibrato (for modulating the tone pitch), a similar modulating signal generator may be used to modulate the tone level or other like elements.

Figure 32:
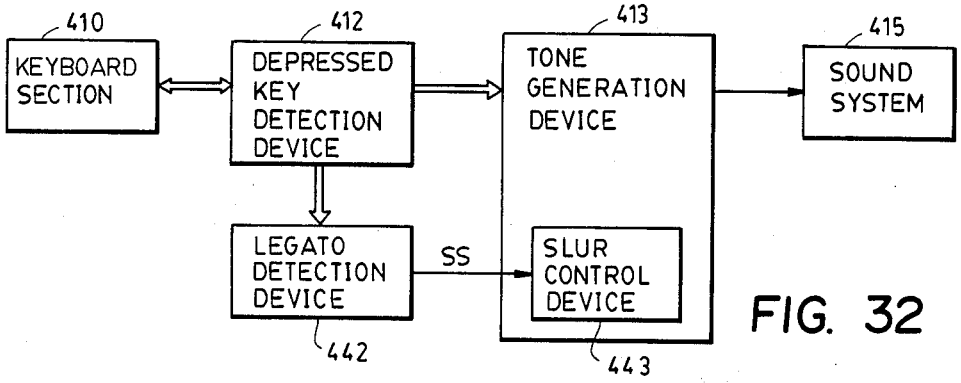
FIG. 32 is a block diagram showing the basic construction of an electronic musical instrument to realize the slur (portamento) effect according to the invention.

FIG. 32 shows the essential construction of an electronic musical instrument to realize the slur effect (portamento effect) according to the invention. A legato detection device 442 provided in association with a depressed key detection device 412 finds out whether application of depression was shifted from one key to another in the legato form (whether a new key has been depressed before the old depressed key has been completely released). A tone generation device 413 comprises a slur control device 443 by which the pitch of the old depressed key smoothly changes into the pitch of the newly depressed key. It is to be noted that the slur control device 443 does not respond to every key operation but responds only when depression has been shifted from one key to another in the legato form. Specifically, upon detecting the shifting of key depression in the legato form, the legato detection device 442 supplies the slur start signal SS to the slur control device 443, which then operates in response to this slur start signal SS. Accordingly, while the slur effect (portamento effect) is not applied by the key performance in the legato form, such tonal effect is automatically produced by only changing the key performance manner to the legato form.

Figure 33:
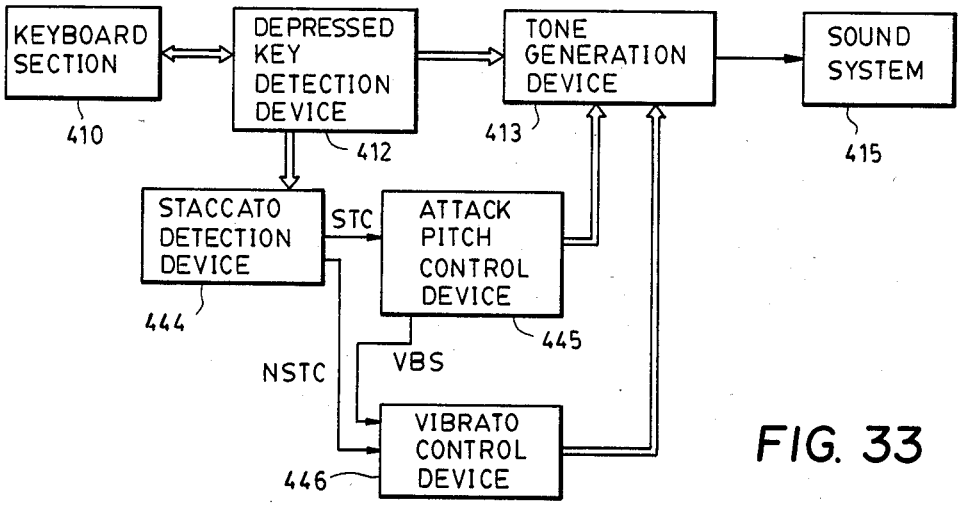
FIG. 33 is a block diagram showing the basic construction of an electronic musical instrument to effect the attack pitch control and vibrato control according to the invention.

FIG. 33 shows the essential construction of an electronic musical instrument to effect the attack pitch control and vibrato control according to the invention such that the nature of the control effected is automatically switched depending whether or not a staccato performance has been carried out. A staccato detection device 444 provided in association with the depressed key detection device 412 finds out whether or not the key performance was made in the staccato form. Specifically, the device 444 recognizes a staccato performance to have been made when a new key has been depressed after the old depressed key has been completely released. An attack pitch control device 445 modulation controls the pitch of the tone signal generated by the tone generation device 413 at the start of sounding of the tone (during a predetermined period from the start of sounding of the tone). The vibrato control device 446 is provided to vibrato modulate the tone signal generated by the tone generation device 413. When the key performance has been carried out in the staccato form, the staccato detection device 444 supplies the staccato detection signal STC to the attack pitch control device 445, which then generates a modulating signal for the attack pitch control based on the signal STC. Upon termination of the attack pitch control, the vibrato start signal VBS is supplied to the vibrato control device 446, which then generates the vibrato modulating signal based on said signal VBS. On the other hand, when the key performance was not made in the staccato form, namely, when it was carried out in the legato form, the staccato detection device 444 supplies the non-staccato signal NSTC to the vibrato control device 446, which then generates the vibrato modulating signal based on said signal NSTC from the start of sounding of the tone.

Accordingly, in vibrato performance, if the key performance is carried out in the staccato form, a performance effect is realized wherein the attack pitch control is effected automatically at the start of sounding of the tone, with the vibrato control following the end of the attack pitch control. If the key performance is not made in the staccato form, the attack pitch control is not effected and the tone is accompanied by the vibrato effect from the start of sounding. Reverting to FIG. 24, the tonal effects illustrated in the horizontal row for the staccato performance are those based on the staccato detection signal STC whereas the tonal effects illustrated in the horizontal row for the polyphonic mode legato performance are those based on the non-staccato signal NSTC.

Figure 34:
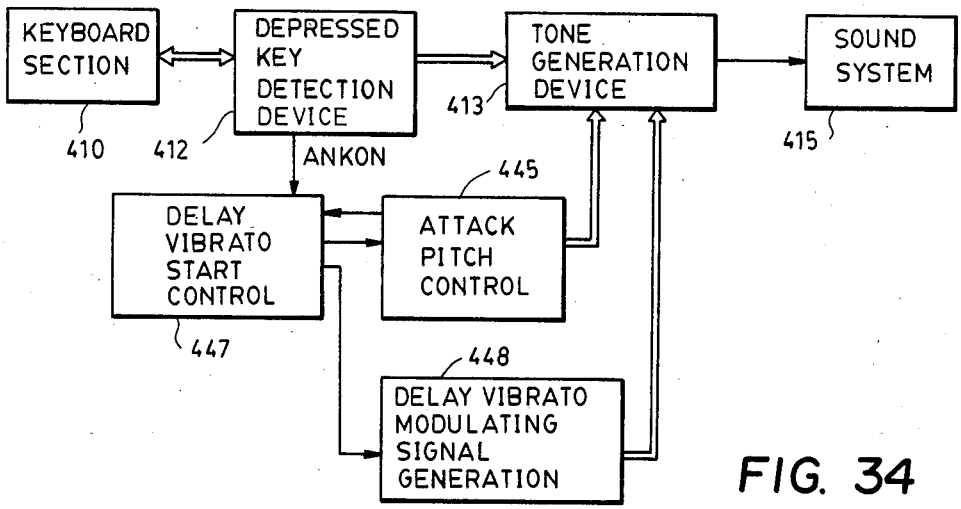
FIG. 34 is a block diagram showing the basic construction of an electronic musical instrument to effect the attack pitch control and delay vibrato control according to the invention.

FIG. 34 shows the essential construction of an electronic musical instrument to effect the attack pitch control and delay vibrato control according to the invention such that the delay vibrato control is automatically accompanied with the attack pitch control. A delay vibrato start control device 447 controls the start of the delay vibrato performance based on the any new key-on signal ANKON which indicates that a new key has been depressed. Said device 447 also controls the attack pitch control device 445. When a new key has been depressed, the device 447 first operates the attack pitch control device 445 so as to apply the attack pitch control to the tone signal. When a predetermined waiting time has elapsed from the end of the attack pitch control, a delay vibrato modulating signal generation device 448 is operated so as to start generating the delay vibrato modulating signal. Based on this modulating signal, the delay vibrato modulation is applied to the tone generated by the tone generation device 413. FIG. 24 schematically shows in the column of DVB=1 how the attack pitch control is effected automatically prior to the delay vibrato control (see said column where the horizontal rows for the staccato performance and slur-off meet it). These controls are realized by the essential construction shown in FIG. 34.

We claim:

1. An electronic musical instrument comprising:

keyboard means having a plurality of keys;

depressed key detection means connected to said keyboard means for detecting a depressed key;

tone generation means responsive to said depressed key detection means for generating a tone signal having a pitch corresponding to said depressed key;

touch detection means for detecting an initial key touch of said depressed key as it is first depressed and for delivering an initial touch signal relating to said initial key touch; and attack pitch control means, connected to said depressed key detection means, said tone generation means and said touch detection means, for automatically modulating the pitch of said tone signal during an attack pitch time interval starting from the beginning of sounding of the tone corresponding to said tone signal, and for establishing the initial pitch deviation of said pitch modulation during said attack pitch interval in accordance with said initial touch signal, said modulation thereafter being independent of subsequent depressed key movement.

2. An electronic musical instrument as defined in claim 1 wherein said attack pitch control means includes modulating signal generation means for generating a modulating signal in response to said initial touch signal, the pitch of said tone signal being modulated for said attack pitch time interval in accordance with said modulating signal.

3. An electronic instrument as defined in claim 2 wherein said modulating signal has a maximum pitch deviation corresponding to said initial touch signal from said pitch corresponding to said depressed key.

4. An electronic musical instrument as defined in claim 2 wherein said modulating signal is a periodic signal whose period is less than said attack pitch time interval; and said attack pitch control means further includes envelope signal forming means for forming an envelope signal for said attack pitch time interval from said beginning of said sounding, the maximum value of said envelope signal being responsive to said initial touch signal and an envelope of said modulating signal being formed in accordance with said envelope signal.

5. An electronic musical instrument as defined in claim 4 wherein said envelope forming means comprises first calculation means for obtaining instantaneous value data of said envelope signal by repeatedly adding or subtracting second data obtained by shifting down first digital data corresponding to said touch signal by preset bits; and said modulating signal generation means comprises second calculation means for obtaining instantaneous value data of said modulating signal by repeatedly adding or subtracting third data obtained by shifting down said envelope instantaneous value data obtained by said first calculation means by preset bits and switching means for switching the addition and subtraction in said second calculation means so that said modulating signal will oscillate within the envelope determined by the envelope instantaneous value data.

6. An electronic musical instrument as defined in claim 5 wherein the first digital data used in said first calculation means is provided by multiplying said touch signal with a predetermined coefficient in accordance with a tone color of said tone signal and time interval of repetition of the calculation of the second data in said first calculation means and time interval of repetition of the calculation of the third data in said second calculation means are determined in accordance with said tone color.

7. An electronic musical instrument as defined in claim 2 wherein said depressed key detection means comprises means for setting a predetermined waiting time of a relatively short duration upon detecting the start of first depression of said key; and said touch detection means comprises a touch sensor for detecting said key touch and initial touch detection means for holding a signal outputted by said touch sensor during said waiting time to provide the signal held therein as said initial touch signal, the generation of the tone signal in said tone generation means and the generation of the modulating signal in said modulating signal generation means being started after lapse of said waiting time.

8. An electronic musical instrument as defined in claim 7 wherein said touch sensor outputs an analog signal representing the depressing force, depressing speed, depth of depression or any other factor relating to the depressed key and said initial touch detection means converts the analog signal outputted from the touch sensor during said waiting time to a digital signal and holds a peak value of the digital signal.

9. An electronic musical instrument as defined in claim 2 wherein said depressed key detection means comprises new key detection means for detecting depression of a new key and starts the generation of the modulating signal in said modulating signal generation means in response to detection of the depression of the new key.

10. An electronic musical instrument as defined in claim 2 wherein said depressed key detection means comprises:

means for outputting data representing a depressed key or keys upon detection of the depressed key or keys;

monophonic key assigning means for assigning a single key among the depressed key or keys to said tone generation means in response to the data representing the depressed key or keys;

polyphonic key assigning means for assigning a plurality of keys to said tone generation means in response to the data representing the depressed keys;

mode selection means capable of selecting one of a monophonic mode and a polyphonic mode for enabling, in response to selection of either mode, one of outputs of said monophonic key assigning means and said polyphonic key assigning means to be selectively utilized in said tone generation means;

any new key-on detection means for detecting depression of any key for the first time in a state where no key has been depressed; and legato new key-on detection means for detecting depression of another key in a state where some key is being depressed;

the generation of the modulating signal in said modulating signal generation means being started in response to the outputs of both said any new key-on detection means and said legato new key-on detection means when the monophonic mode is selected by said mode selection means whereas the generation of the modulating signal in said modulating signal generation means being started in response to the output of said any new key-on detection means when the polyphonic mode is selected by said mode selection means.

11. An electronic musical instrument comprising:

a plurality of keys;

a plurality of key switches provided for said plurality of keys respectively;

depressed key detection means connected to said key switches for detecting a depressed key;

tone generation means responsive to said depressed key detection means for generating a tone signal corresponding to said depressed key;

vibrato imparting means for applying vibrato modulation to the tone signal to be generated in said tone generation means;

attack pitch control means connected to said tone generation means for modulating the pitch of the tone signal for a little time from the beginning of sounding of the tone; and staccato detection means connected to said depressed key detection means, said vibrato imparting means and said attack pitch control means for detecting whether a new key has been depressed in a staccato form or not to control, responsive to the detection, said vibrato imparting means and said attack pitch control means such that the attack pitch control is effected by said attack pitch control means and thereafter the vibrato modulation is applied by said vibrato imparting means when the new key has been depressed in the staccato form whereas the vibrato modulation is applied without effecting the attack pitch control when the new key has not been depressed in the staccato form.

12. An electronic musical instrument as defined in claim 11 wherein said staccato detection means detects the depression in the staccato form by detecting depression of any key for the first time in a state where no key has been depressed.

13. An electronic musical instrument comprising:

a plurality of keys;

a plurality of key switches provided for said plurality of keys respectively;

depressed key detection means connected to said key switches for detecting a depressed key;

tone generation means responsive to said depressed key detection means for generating a tone signal or signals corresponding to said depressed key;

delay vibrato imparting means for applying delay vibrato modulation to the tone signal to be generated in said tone generation means;

attack pitch control means connected to said tone generation means for modulating the pitch of the tone signal for a little time from the beginning of sounding of the tone; and start control means, connected to said depressed key detection means, said delay vibrato imparting means and said attack pitch control means, for enabling said attack pitch control means in response to the depression of the new key and thereafter enabling said delay vibrato imparting means in response to termination of the pitch modulation by said attack pitch control means, thereby to automatically apply and complete the attack pitch modulation before starting of the delay vibrato modulation.

14. An electronic musical instrument comprising:

a plurality of keys;

a plurality of key switches provided for said plurality of keys respectively;

depressed key detection means connected to said key switches for detecting a depressed key or keys;

tone generation means responsive to said depressed key detection means for generating a tone signal or signals corresponding to said depressed key or keys;

slur control means connected to said tone generation means for shifting the pitch of the tone signal to be generated in said tone generation means from a first pitch to a second pitch, thereby performing a slur effect; and legato detection means connected to said depressed key detection means and said slur control means for detecting whether a new key has been depressed in a legato form or not to enable, responsive to the detection, said slur control means selectively so that said slur effect will be imparted to the tone signal when the new key has been depressed in the legato form.

15. An electronic musical instrument as defined in claim 14 wherein said legato detection means detects the depression in the legato form by detecting new depression of a second key in a state where a first key is being depressed, said first pitch is a nominal pitch of said first key and said second pitch is a nominal pitch of said second key.

16. An electronic musical instrument comprising:

first numerical data generation means for generating first numerical value used for setting frequency of a modulating signal;

first calculation means for repeatedly performing a calculation on the first numerical value to produce a control signal each time contents of calculation has reached a predetermined value;

second numerical data generation means for generating second numerical value representing a deviation range;

second calculation means for repeatedly performing a calculation on the second numerical value each time the control signal has been produced, the output of said second calculation means being used as the modulating signal for modulating a tone to be produced; and control means for controlling the calculation in said second calculation means in accordance with a target value for setting depth of the modulating signal.

17. An electronic musical instrument as defined in claim 16 wherein said second numerical data generation means uses data obtained by shifting down said target value by predetermined bits as said second numerical value.

18. An electronic musical instrument as defined in claim 17 wherein said control means comprises target value generation means for generating data representing the target value and comparison means for comparing the target value with the output of said second calculation means to switch said second calculation means from an addition mode to a subtraction mode or vice versa in response to a result of comparison, and contents of calculation in said second calculation means repeatedly increase and decrease within the target value.

19. An electronic musical instrument as defined in claim 18 wherein said target value generation means outputs an upper limit target value when said second calculation means is in the addition mode and a lower limit target value when said second calculation means is in the subtraction mode.

20. An electronic musical instrument as defined in claim 19 wherein said target value generation means comprises third calculation means for repeatedly adding or subtracting data obtained by shifting down a numerical value corresponding to a maximum depth by predetermined bits, contents of calculation in said third calculation means constituting data representing the target value and the depth of the modulating signal being timewisely changed.

21. An electronic musical instrument as defined in claim 20 wherein the lower limit target value is data obtained by shifting down the upper limit target value by predetermined bits.

22. An electronic musical instrument comprising:

a plurality of keys;

a plurality of key switches provided for said plurality of keys respectively;

depressed key detection means connected to said key switches for detecting a depressed key;

tone generation means responsive to said depressed key detection means for generating a tone signal corresponding to said depressed key;

touch sensor provided in association with said keys and being capable of detecting a key touch of said depressed key;

waiting time setting means, connected to said depressed key detection means, for setting, responsive to the detection of the start of depression of said key, a waiting time of a predetermined constant duration;

initial touch detection means, connected to said touch sensor and said waiting time setting means, for detecting a signal corresponding to the initial touch in response to the signal outputted from said touch sensor during said constant duration waiting time; and means, connected to said tone generation means and said waiting time setting means, for delaying the time for starting sounding of the tone by a time corresponding to said constant duration time;

the characteristics of the tone generated in said tone generation means being controlled in response to the output of said initial touch detection means.

23. An electronic musical instrument as defined in claim 22 wherein said initial touch detection means detects and holds a peak value of the signal representing the key touch outputted from said touch sensor during waiting time set by said waiting time setting means and outputs the held signal as the signal corresponding to the initial touch.

24. An electronic musical instrument as defined in claim 23 wherein said touch sensor outputs an analog signal representing said key touch and said initial touch detection means converts the analog signal outputted from said touch sensor during said waiting time to a digital signal and holds its peak value.

25. An electronic musical instrument as defined in claim 24 wherein said initial touch detection means comprises:

variable adjusting means for adjusting sensitivity of the analog signal outputted from said touch sensor;

analog to digital conversion circuit including a counter, a digital to analog converter and an analog comparator, converting an output of said counter to an analog signal by said digital to analog converter, comparing an output signal of said variable adjusting means with an output signal of said digital to analog converter by said analog comparator and successively counting up said counter in response to the output of said comparator during the waiting time until the value of the output signal of said digital to analog converter has reached the value of the output signal of said variable adjusting means; and a register for holding contents of said counter at the end of said waiting time.

26. An electronic musical instrument as defined in any of claim 22 through 25 wherein said waiting time setting means comprises new key detection means for detecting depression of a new key in said keys and timer means for counting said predetermined time in response to the detection of depression of the new key detected by said new key detection means.

27. An electronic musical instrument as defined in claim 22 wherein one or more of tone pitch, tone color and tone level of the tone generated by said tone generation means are controlled in response to the output of said touch sensor.

28. An electronic musical instrument comprising:

a plurality of analog signal setting means, provided one for each of a plurality of tone control factors, for setting control values of the respective tone control factors in the form of analog signals;

analog signal multiplexing means for sampling and multiplexing, on a time shared basis, each of the analog signals for the control values set by said analog signal setting means;

a like plurality of memory means, each associated with a respective one of said analog signal setting means, for storing digital data signals corresponding to the analog signals set by the respective analog signal setting means;

analog to digital conversion means for converting an analog signal provided by said analog signal multiplexing means to a digital data signal;

control means for controlling said analog to digital conversion means and said memory means in association with each other in synchronism with a time division sampling timing in said analog signal multiplexing means so that the digital data signal converted by said analog to digital conversion means will be stored in one of said memory means in sychronism with the time division sampling timing;

said analog to digital conversion means utilizing, at each time division sampling timing, the prior contents of the memory means associated with the analog signal setting means then being sampled as a starting value of digital data for the conversion carried out by said analog to digital conversion means;

note selection means for selecting a note among a plurality of notes;

tone generation means for generating a tone signal corresponding to the note selected by said note selection means; and means connected to said tone generating means and said plurality of memory means for controlling various factors constituting the tone signal to be generated in said tone generation means in response to the digital data signals provided by said memory means.

29. An electronic musical instrument comprising:

a plurality of analog signal setting means provided one for each of a plurality of tone control factors for setting control values of the respective tone control factors in the form of analog signals;

analog signal multiplexing means for sampling and multiplexing, on a time shared basis, each of the analog signals for the control values set by said analog signal setting means;

a plurality of memory means provided one for each of said analog signal setting means for storing digital data signals corresponding to the analog signals set by the respective analog signal setting means;

analog to digital conversion means for converting an analog signal provided by said analog signal multiplexing means to a digital data signal;

control means for controlling said analog to digital conversion means and said memory means in association with each other in synchronism with a time division sampling timing in said analog signal multiplexing means so that the digital data signal converted by said analog to digital conversion means will be stored in one of said memory means in synchronism with the time division sampling timing;

note selection means for selecting a note among a plurality of notes;

tone generation means for generating a tone signal corresponding to the note selected by said note selection means; and means connected to said tone generation means and said plurality of memory means for controlling various factors consistuting the tone signal to be generated in said tone generation means in response to the digital data signals provided by said memory means; and wherein said control means comprises:

first control means for selecting, at the beginning of or immediately before starting of each sampling timing, a digital data signal stored in one of said plurality of memory means corresponding to this sampling timing so as to multiplex the respective digital data signals selected in accordance with the respective sampling timings and deliver them to said analog to digital conversion means;

second control means for supplying a control signal to said analog to digital conversion means in synchronism with timing of delivering of the data by said first control means; and third control means for distributing a digital data signal outputted from said analog to digital conversion means in synchronism with each sampling timing to one of said plurality of memory means corresponding to the sampling timing for storing therein;

and wherein said analog to digital conversion means comprises:

a register for storing the digital data signal provided by said first control means;

a digital to analog conversion circuit for converting the digital data signal stored in said register to an analog signal;

a comparator for comparing an output signal of said digital to analog conversion circuit with the analog signal outputted from said analog signal multiplexing means; and a control circuit starting its control operation in response to the control signal provided by said second control means for increasing or decreasing the value of the digital data signal stored in said register in response to an output of said comparator.

30. An electronic musical instrument as defined in claim 29 wherein said plurality of memory means respectively output the digital data signals stored therein timewisely in series, the digital data which is delivered to said analog to digital conversion means through said first control means is converted to serial data, said register outputs data signals stored therein timewisely in series as output signals of said analog to digital conversion means, and the digital data signal distributed to said memory means through said third control means is converted serial data.

31. An electronic musical instrument as defined in claim 29 wherein said analog signal setting means consists of a potentiometer for setting an analog voltage.

32. An electronic musical instrument comprising:

analog signal setting means for setting an analog signal representing the characteristics of a tone to be produced;

sampling means for sampling said analog signal;

analog to digital conversion means for converting said sampled analog signal into a digital data signal;

control means for storing said digital data signal in a respective one of a plurality of memory means in accordance with sampling timing and for controlling the converting operation of said analog to digital conversion means in such a manner that the difference between the value of a new digital signal and the value of an old digital data signal, obtained at each sampling timing and stored in said memory means for storing the digital data signal, will be confined within a predetermined small range of values corresponding to a few bits of lowest significance substantially less than the overall coversion range of said analog to digital conversion means irrespective of the extent of change of said analog setting means, so as to prevent objectionable sound generation in response to abrupt change of said analog setting means;

note selection means for selecting a note among a plurality of notes;

tone generation means for generating a tone signal corresponding to the note selected by said note selection means; and means connected to said tone generation means and said plurality of memory means for controlling various factors constituting the tone signal to be generated in said tone generation means in response to said digital data signals provided by said memory means.

33. An electronic musical instrument as defined in claim 32 wherein said analog to digital conversion means comprises:

a register to which is supplied, at the beginning of or immediately before starting of each sampling timing, said digital data signal stored in one of said plurality of memory means corresponding to that sampling timing;

a digital to analog conversion circuit for converting the digital data signal stored in said register to an analog signal;

a comparator for comparing an output signal of said digital to analog conversion circuit with the analog signal outputted from said analog signal multiplexing means; and a calculation circuit responsive to an output of said comparator for increasing or decreasing the value of the digital data signal stored in said register:

and wherein said second control means controls said calculation circuit so as to restrict a maximum amount of increase or decrease in one sampling timing within predetermined values.

34. An electronic musical instrument as defined in claim 33 wherein said second control means successively implements, in one sampling timing, a first step in which contents of said register increase by a predetermined value irrespective of the output of said comparator, a second step in which the contents of said register decrease by a predetermined value if the output of said comparator indicates that the contents of said register are greater and a third step in which the same control as in said second step is performed.

35. An electronic musical instrument as defined in claim 1 wherein said initial touch signal is a held initial touch value set in response to said first depression of said depressed key.

36. An electronic musical instrument according to claim 28 wherein said analog to digital conversion means includes;

a digital to analog conversion circuit receiving a digital data value;

a comparator for comparing the analog output of said digital to analog conversion circuit with said analog signal provided by said analog signal multiplexing means; and conversion control means for modifying said initial digital data value until the converted analog output of said digital to analog conversion circuit is equal to said provided analog signal as detected by said comparator, the resultant modified digital data value then representing said digital data signal.

* * * * *